US011549503B2

(12) United States Patent
Gordon

(10) Patent No.: US 11,549,503 B2
(45) Date of Patent: Jan. 10, 2023

(54) FLUID ISOLATING PERISTALTIC PUMP

(71) Applicant: ReelReactor, LLC, Encinitas, CA (US)

(72) Inventor: Michael Sean Gordon, Encinitas, CA (US)

(73) Assignee: ReelReactor, LLC, Encinitas, CA (US)

( * ) Notice: Subject to any disclaimer, the term of this patent is extended or adjusted under 35 U.S.C. 154(b) by 0 days.

(21) Appl. No.: 17/004,991

(22) Filed: Aug. 27, 2020

(65) Prior Publication Data

US 2021/0062801 A1 Mar. 4, 2021

Related U.S. Application Data

(60) Provisional application No. 63/038,581, filed on Jun. 12, 2020, provisional application No. 62/989,906,
(Continued)

(51) Int. Cl.
*F04B 43/12* (2006.01)
*F04B 53/08* (2006.01)

(52) U.S. Cl.
CPC ..... *F04B 43/1284* (2013.01); *F04B 43/1246* (2013.01); *F04B 43/1261* (2013.01); *F04B 53/08* (2013.01)

(58) Field of Classification Search
CPC ..... F04B 43/1246; F04B 43/1261; F04B 43/1276; F04B 43/1253; F04B 45/08;
(Continued)

(56) References Cited

U.S. PATENT DOCUMENTS 2,696,173 A * 12/1954 Jensen ..... F04B 43/0072 417/477.6
3,101,675 A * 8/1963 Isreeli ..... F04B 43/1261 417/475

(Continued)

FOREIGN PATENT DOCUMENTS

EP 0239255 A1 * 9/1987 ..... A61M 5/14232
WO WO 02/066833 A1 8/2002

OTHER PUBLICATIONS

PCT Invitation to Pay Additional Fees, PCT Application No. PCT/US2020/048237, Oct. 14, 2020, two pages.

(Continued)

*Primary Examiner* — Philip E Stimpert
*Assistant Examiner* — Dnyanesh G Kasture
(74) *Attorney, Agent, or Firm* — Fenwick & West LLP

(57) ABSTRACT

Disclosed is a fluid isolating pump. The fluid isolating pump includes a rotating cage, one or more roller assemblies mounted on the rotating cage, a cam plate, and a non-rotating central shaft. The cage includes a front plate and a back plate connected by multiple connecting rods. Each roller assembly is rotatably attached to a corresponding connecting rod of the cage. Each roller assembly includes one or more arms rotatably attached to the connecting rod, a connecting bar coupled to the one or more arms, one or more levers rotatably attached to the connecting rod, one or more suspensions, and a roller. Each suspension is coupled to at least one arm and to at least one lever. The roller is coupled to the one or more levers. The cam plate includes multiple openings having a first end and a second end. The connecting rod of each roller assembly is configured to slide from the first end of the opening to the second end of a corresponding opening.

14 Claims, 53 Drawing Sheets

Related U.S. Application Data filed on Mar. 16, 2020, provisional application No. 62/894,689, filed on Aug. 31, 2019, provisional application No. 62/893,163, filed on Aug. 28, 2019.

(58) Field of Classification Search

CPC ..... F04B 43/12; B41J 13/025; B65H 3/0607; B41F 13/32; B41F 13/14; B41F 13/40

USPC ..... 417/477.3, 477.6, 477.7, 477.8; 101/218, 101/247, 352.01

See application file for complete search history.

(56) References Cited

U.S. PATENT DOCUMENTS

| | | | | |
|---|---|---|---|---|
| 3,116,697 | A * | 1/1964 | Bilichniansky | F04B 43/12 417/475 |
| 3,442,121 | A * | 5/1969 | Wirz | B41F 33/0063 73/159 |
| 3,960,466 | A * | 6/1976 | Taylor | F04B 43/1276 417/234 |
| 5,110,270 | A * | 5/1992 | Morrick | F04B 43/1276 417/477.11 |
| 6,626,867 | B1 | 9/2003 | Christenson et al. | |
| 2001/0006881 | A1 * | 7/2001 | Chopra | B24B 21/04 451/287 |
| 2009/0074597 | A1 | 3/2009 | Martin et al. | |

OTHER PUBLICATIONS

PCT International Search Report and Written Opinion, PCT Application No. PCT/US20/48237, dated Jan. 5, 2021, 17 pages.

* cited by examiner

350

Rear View

Front View

Rear View

Front View

Engaged

Disangeged

FLUID ISOLATING PERISTALTIC PUMP

CROSS REFERENCE TO RELATED APPLICATIONS

This application claims the benefit of U.S. Provisional Application No. 62/893,163, filed Aug. 28, 2019, U.S. Provisional Application No. 62/894,689, filed Aug. 31, 2019, U.S. Provisional Application No. 62/989,906, filed Mar. 16, 2020, and U.S. Provisional Application No. 63/038,581, filed Jun. 12, 2020, all of which are incorporated by reference in their entirety.

BACKGROUND

1. Field of the Disclosure

The present disclosure generally relates to the manufacturing of biological and non-biological materials or fluids, and more specifically to a peristaltic pump and processes for isolating a material or fluid for a predetermined amount of time in continuous flow. This includes but is not limited to the production of chemical compounds, reagents, antibodies, living and non-living biologicals, and various other types of liquids used in the manufacturing of chemicals, compounds, pharmaceuticals and cell and gene therapies.

2. Description of the Related Art

Many chemical and biological products (such as cell and gene therapies, pharmaceutical products, etc.) are manufactured in a "batch" method, meaning that a predetermined volume or "batch" is manufactured at a time. To ensure quality and efficacy of the product, each batch may undergo its own quality control (QC) testing to verify purity, potency, and sterility. Batch processing, however, inherently has limitations on batch size or batch volume and uses significantly more resources when compared to a continuous manufacturing method. Some processes, however, are not ideal candidates for continuous manufacturing.

For example, many of the fluids or products used in the manufacturing of cell and gene therapies are limited to batch manufacturing because they often require complex incubations as part of their workflows. Essentially, during the production process, some ingredients need to mix and then "incubate" for a specified period of time before the next ingredient(s) may be added. In some cases, multiple incubations may be required. In a batch manufacturing environment, this is easily achieved.

An alternative to batch processing is "continuous" processing, meaning that a manufacturing system outputs a product on a consistent basis. Continuous processing removes some of the costs and time constraints found in batch processing. It is also scalable to theoretically achieve any desired throughput. In contrast to batch processing, which may require each batch to undergo strict quality control testing, continuous processing is less resource dependent because quality tests and assays may be performed on a schedule.

In the bioprocessing industry, a standard method of continuous processing involves pumping fluid through sterile tube sets, also known as consumable sets. Peristaltic pumps are often used to transfer the fluid within these sterile tube sets. The benefit of peristaltic pumps is that they apply pressure external to the tubing to transfer fluid within it, effectively maintaining the sterility of the functionally-closed system. This design may be effective at transferring fluids within tubing, such as silicone, PVC or TPE.

However, it can be difficult to achieve proper manufacturing of certain products using continuous flow processing. In particular, it may difficult to achieve proper incubation of fluids when operating in a continuous flow fashion.

SUMMARY

Disclosed is a fluid isolating pump for isolating volumes of liquid to allow the volumes of liquid to incubate for a predetermined amount of time. The fluid isolating pump mechanically and fluidically isolates small volumes of the fluid being incubated to allow for proper incubation of the resulting product.

The fluid isolating pump includes a rotating cage, one or more roller assemblies mounted on the rotating cage, a cam plate, and a non-rotating central shaft. The cage includes a front plate and a back plate connected by multiple connecting rods. Each roller assembly is rotatably attached to a corresponding connecting rod of the cage. Each roller assembly includes one or more arms rotatably attached to the connecting rod, a connecting bar coupled to the one or more arms, one or more levers rotatably attached to the connecting rod, one or more suspensions, and a roller. Each suspension is coupled to at least one arm and to at least one lever. The roller is coupled to the one or more levers. The cam plate includes multiple openings having a first end and a second end. The connecting rod of each roller assembly is configured to slide from the first end of the opening to the second end of a corresponding opening.

In some embodiments, the fluid isolating pump additionally includes a central gear mounted on the non-rotating central shaft. In addition, the fluid isolating pump may include multiple peripheral gears. Each peripheral gear may be mounted to a corresponding connecting rod of the cage. Moreover, the peripheral gears may be engaged to the central gear.

In some embodiments, the roller assembly further includes a roller gear coupled to the roller of the roller assembly. The roller gear may be engaged with a corresponding peripheral gear.

In some embodiments, the peripheral gears are configured to rotate around the central gear as the cage rotates around the non-rotating central shaft.

In some embodiments, the roller gear of a roller assembly is configured to rotate the roller based on the rotation of the corresponding peripheral gear.

In some embodiments, a roller assembly is in a disengaged position when the connecting bar of the roller assembly is in the first end of the corresponding opening, and wherein the rollers assembly is in an engaged position when the connecting bar of the roller assembly is in the second end of the corresponding opening.

In some embodiments, the roller of the roller assembly is compressing a tubing of the consumable when the roller assembly is in the engaged position. In some embodiments, when the roller assembly is in the engaged position, the cam plate applies a pressure to the connecting bar of the roller assembly, compressing the one or more suspensions In some embodiments, the non-rotating central shaft has a non-circular cross section In some embodiments, the fluid isolating pump additionally includes a motor coupled to the cage. The motor axially is aligned with the non-rotating central shaft. The motor is configured to rotate the cage around the non-rotating central shaft.

Additionally, disclosed is a roller assembly to be used in a fluid isolating pump for isolating volumes of liquid to allow the volumes of liquid to incubate for a predetermined amount of time. The roller assembly is configured to be mounted on an axle. The roller assembly includes one or more arms configured to be rotatably attached to the axle, a connecting bar coupled to the one or more arms, one or more levers configured to be rotatably attached to the axle, one or more suspensions, each suspension coupled to at least one arm and to at least one lever, and a roller coupled to the one or more levers.

In some embodiments, the roller assembly further includes a roller gear coupled to the roller of the roller assembly. The roller gear is configured to control a rotation of the roller. Moreover, in some embodiments, the roller assembly further includes a peripheral gear configured to be rotatably attached to the axel. The peripheral gear is configured to be coupled to a central gear. The peripheral gear is additionally configured to control a rotation of the roller gear.

In some embodiments, the roller assembly further includes an auxiliary gear between the roller gear and the peripheral gear. The auxiliary gear is configured to reverse a direction or rotation of the roller gear.

In some embodiments, in an engaged position, the connecting bar of the roller assembly is configured to receive a force compressing the one or more suspensions. In some embodiments, the one or more suspensions are configured to apply a compressive force to the roller to press the rollers against a consumable. In some embodiments, the one or more suspensions may be a spring suspension, a hydraulic suspension, or a pneumatic suspension.

Additionally, disclosed is a consumable to be used in a fluid isolating pump for isolating volumes of liquid to allow the volumes of liquid to incubate for a predetermined amount of time. The consumable includes a rigid tube and a tubing wrapped around the rigid tube. In some embodiments, the rigid tube has a substantially cylindrical shape. Moreover, in some embodiments, the rigid tube has a hollow center.

In some embodiments, the rigid tube has an inlet hole and an outlet hole. The inlet hole and the outlet hole may match an outer diameter of the tubing.

In some embodiments, the consumable additionally includes a back endcap coupled to a first end of the rigid tube and a front endcap coupled to a second end of the rigid tube. The back endcap includes a mounting hole to mount the consumable on an axle. The front endcap includes one or more openings to allow the tubing from entering or exiting the hollow center of the rigid tube.

In some embodiments, the tubing is made of an elastic material.

In some embodiments, the consumable additionally includes electrical connections for transmitting electrical signals to the fluid isolating pump and to receive electrical signals from the fluid isolating pump.

In some embodiments, the consumable additionally includes sensors for determining a property of a liquid flowing through the tubing. For example, a sensor may be a bubble sensor.

In some embodiments, the consumable additionally includes pumps for controlling an intake of fluid into the tubing of the consumable.

In some embodiments, the consumable additionally includes a thermal element (such as a heating element, a cooling element, or a combination thereof) to control a temperature of a fluid disposed inside the tubing. In some embodiments, the consumable additionally includes a temperature sensor to track the temperature of the fluid disposed inside the tubing.

BRIEF DESCRIPTION OF THE DRAWINGS

The teachings of the embodiments can be readily understood by considering the following detailed description in conjunction with the accompanying drawings.

DETAILED DESCRIPTION

The figures (FIG.) and the following description relate to preferred embodiments by way of illustration only. It should be noted that from the following discussion, alternative embodiments of the structures and methods disclosed herein will be readily recognized as viable alternatives that may be employed without departing from the principles of the embodiments.

Reference will now be made in detail to several embodiments, examples of which are illustrated in the accompanying figures. It is noted that wherever practicable, similar or like reference numbers may be used in the figures and may indicate similar or like functionality. The figures depict embodiments for purposes of illustration only.

Abbreviations and Definitions

To facilitate understanding of the invention, a number of terms and abbreviations as used herein are defined below as follows:

Fluid. As used herein, the term "fluid" refers to a substance that flows continuously under an applied shear stress, wherein the substance is in liquid, gas, or plasma phases. As stated above, materials used for cell and gene therapies are examples of fluids that may include biological and non-biological components.

Batch production. As used herein, the term "batch production" refers to a method of manufacturing which can go through a series of steps to make the target product across a number of sets or batches, and steps which often vary across the sets or batches.

Continuous production. As used herein, the term "continuous production" refers to a method of manufacturing that occurs without interruption over a manufacturing time period.

Large molecule: As used herein, the term "large molecule" refers to a protein, synthetic polymer, antibody, lipid, carbohydrate, nucleic acid, or other entities which exceed 1000 atoms.

Small molecule. As used herein, the term "small molecule" refers to an organic and inorganic molecule which does not exceed 1000 atoms.

System and Method for Isolating a Volume of Fluid

Figure 1:
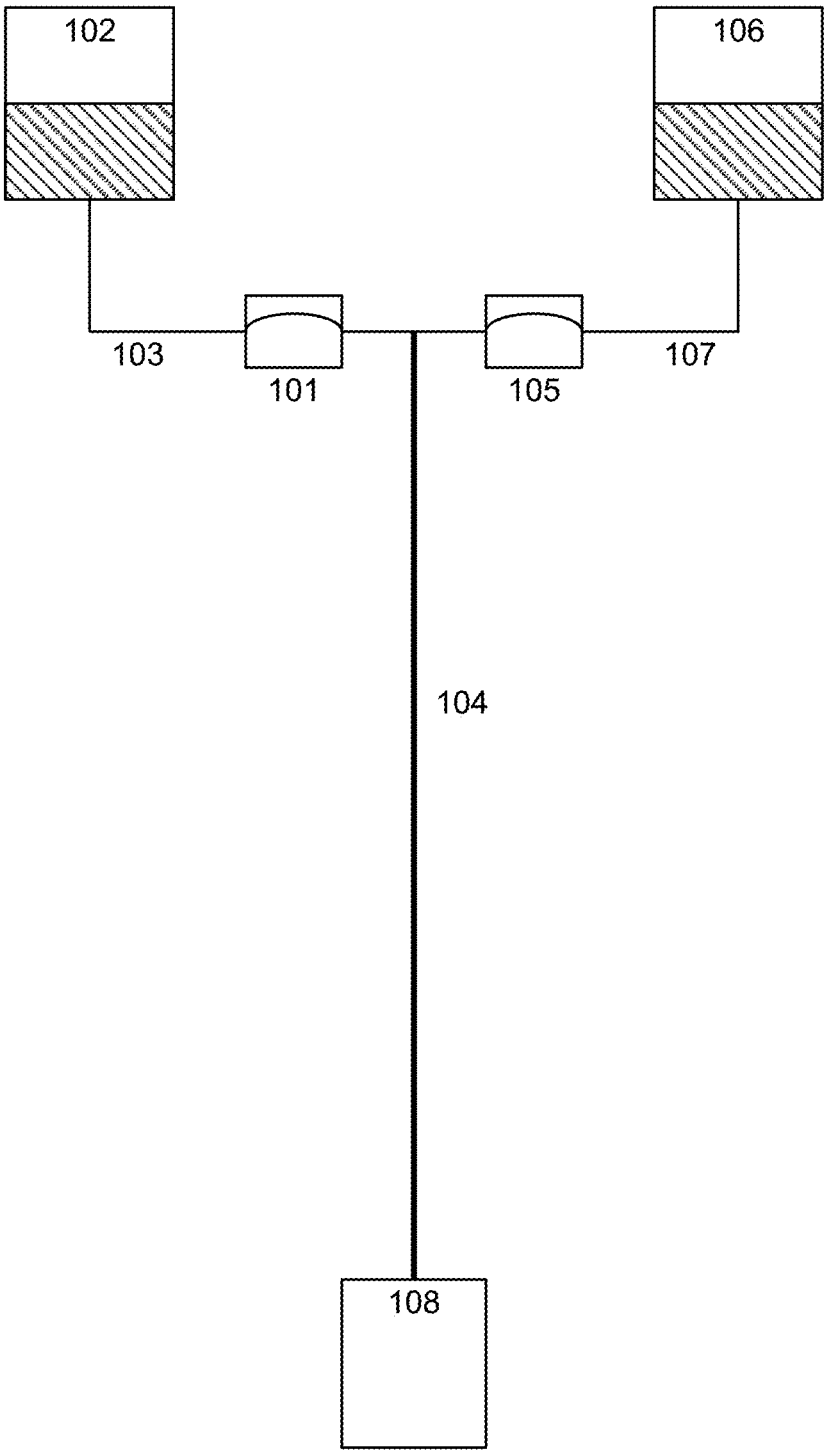
FIG. 1 shows a block diagram of a system for continuous in-line incubation, according to one embodiment.

FIG. 1 shows a block diagram of a system for continuous in-line incubation, according to one embodiment. As shown in FIG. 1, fluid from two vessels may be pumped into a common tube in an effort to incubate the two fluids for a period of time before ultimately entering an output vessel. Peristaltic pump 101 can rotate clockwise to transfer fluid from vessel 102 through tube 103 and into tube 104. Concurrently, peristaltic pump 105 can rotate counterclockwise to transfer fluid from vessel 106 through tube 107 into tube 104. Additionally, the length of tube 104 can be designed to be sufficient to contain fluids from vessels 102 and 106 for the duration of the desired incubation. After the incubation time is complete, the two fluids enter output vessel 108.

In some embodiments, at the end of tube 104, a third reagent may be mixed with the incubated fluid. For example, tube 104 may be connected to T-fitting that connects the tube 104 with a third pump that dispenses the third reagent.

Figure 2A:
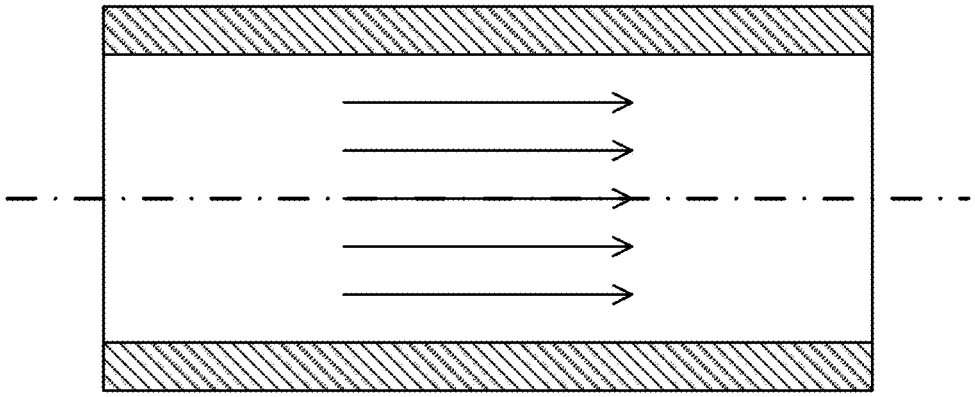
FIG. 2A is a depiction of relative velocities of fluid within a friction-less tube.
Figure 2B:
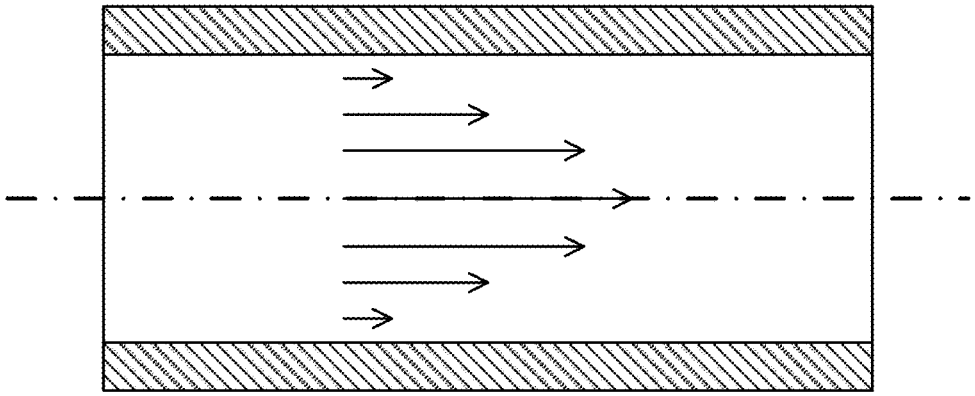
FIG. 2B a depiction of relative velocities of fluid within an actual tube.

The system shown in FIG. 1 is more effective when the friction of the inner surface of the tube 104 is low or when the effect of the friction is negligible (e.g., for short incubation times over a relatively short length of tube, or when only a small amount of reagents are being processed). As shown in FIG. 2A, without friction between the tubing and the fluid, the velocity of fluid near the tubing wall would be the same as at the center of the tubing. The length of each arrow represents its relative velocity. However, when the effect of the friction is more pronounced, this friction results in adhesive forces between the fluid and the inner walls of tube 104. As shown in FIG. 2B, the relative velocity profile within tube 104 is parabolic. Fluid at the fluid-tube boundary has zero velocity or near zero velocity, while fluid at the center of the tube has the highest relative velocity.

This property of fluid-dynamics may prevent adequate incubation within tubing (e.g., tube 104) because, even with the pump speeds of pump 101 and 105 remaining constant, the fluids from vessels 102 and 106 are not maintained at the correct ratios for the duration of the incubation. If collected and analyzed over a period of time, the incubated fluid entering output vessel 108 will contain inconsistent amounts of each ingredient and the fluid entering output vessel 108 will contain molecules that have experienced different incubation times, some more and some less than the desired time.

If the friction of the inner surface of the tube 104 is significant, a fluid isolating pump may be used in conjunction with the tube 104 to mechanically and fluidically isolate small volumes of the fluid being incubated, and to help each small volume of fluid to move in tandem as they travel through the tube 104.

In a continuous in-line incubation process using a fluid isolating pump, two or more fluids are combined and mixed prior to entering a long tube. Upon entering the long tube, the fluid is segmented into small volumes by means of mechanical rollers external to the tubing and then progressed down the length of the tube. Each small volume of fluid remains mechanically and fluidically isolated as the volume of fluid travels along a length of a tubing. Each fluid segment will move from a first end to a second end of the tubing in an amount of time equal to, or approximately equal to, the desired incubation time. As incubated fluid continuously exits at the second end, new non-incubated fluid is continuously drawn into the first end of the tubing.

Since each volume of fluid is isolated as it travels through the tubing, and therefore cannot communicate or interact with adjacent isolated segments of fluid, the system can ensure adequate incubation of the fluid while maintaining a continuous manufacturing method. As such, a continuous in-line incubation process using a fluid isolating peristaltic pump mitigates many of the limitations and problems that are associated with batch manufacturing. Example processes that may utilize continuous in-line incubation include the manufacturing of thioamide and the manufacturing of recombinant proteins. Some example processes that may benefit from a continuous in-line incubation process are explained in more detail hereinbelow.

Figure 3A:
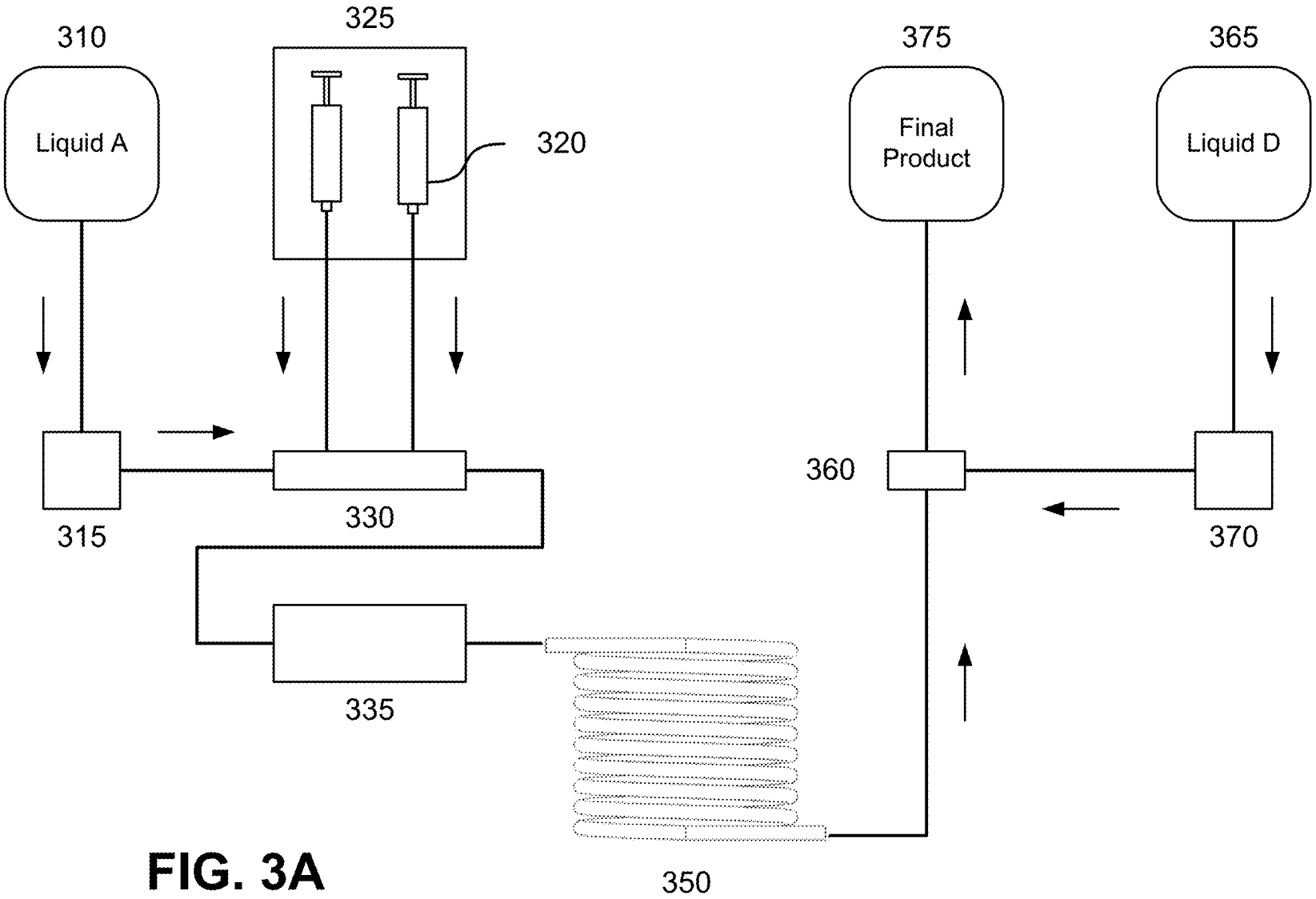
FIG. 3A shows a block diagram of a system for continuous in-line incubation, according to various embodiment.
Figure 3B:
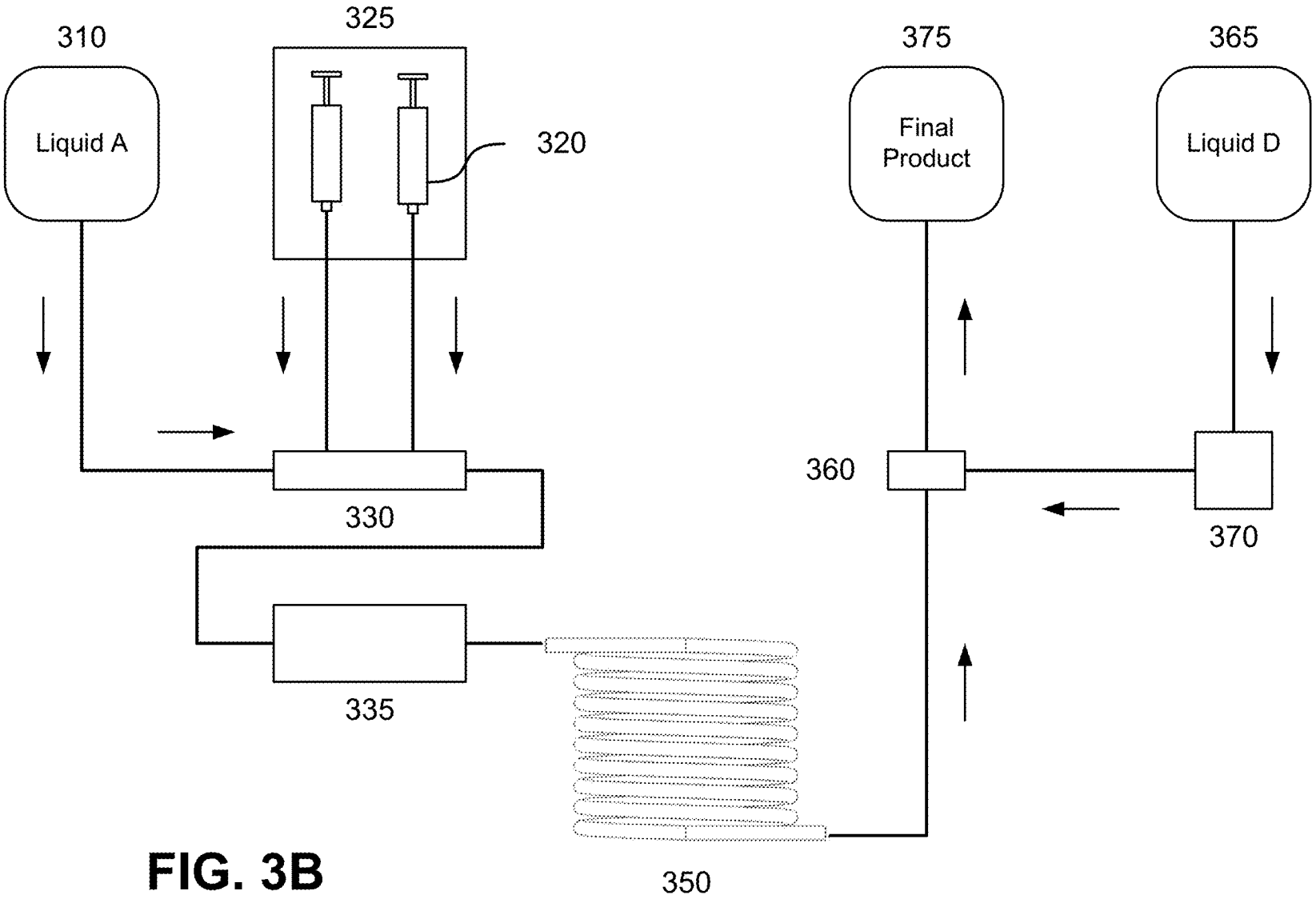
FIG. 3B shows a block diagram of a system for continuous in-line incubation, according to another embodiment.
Figure 3C:
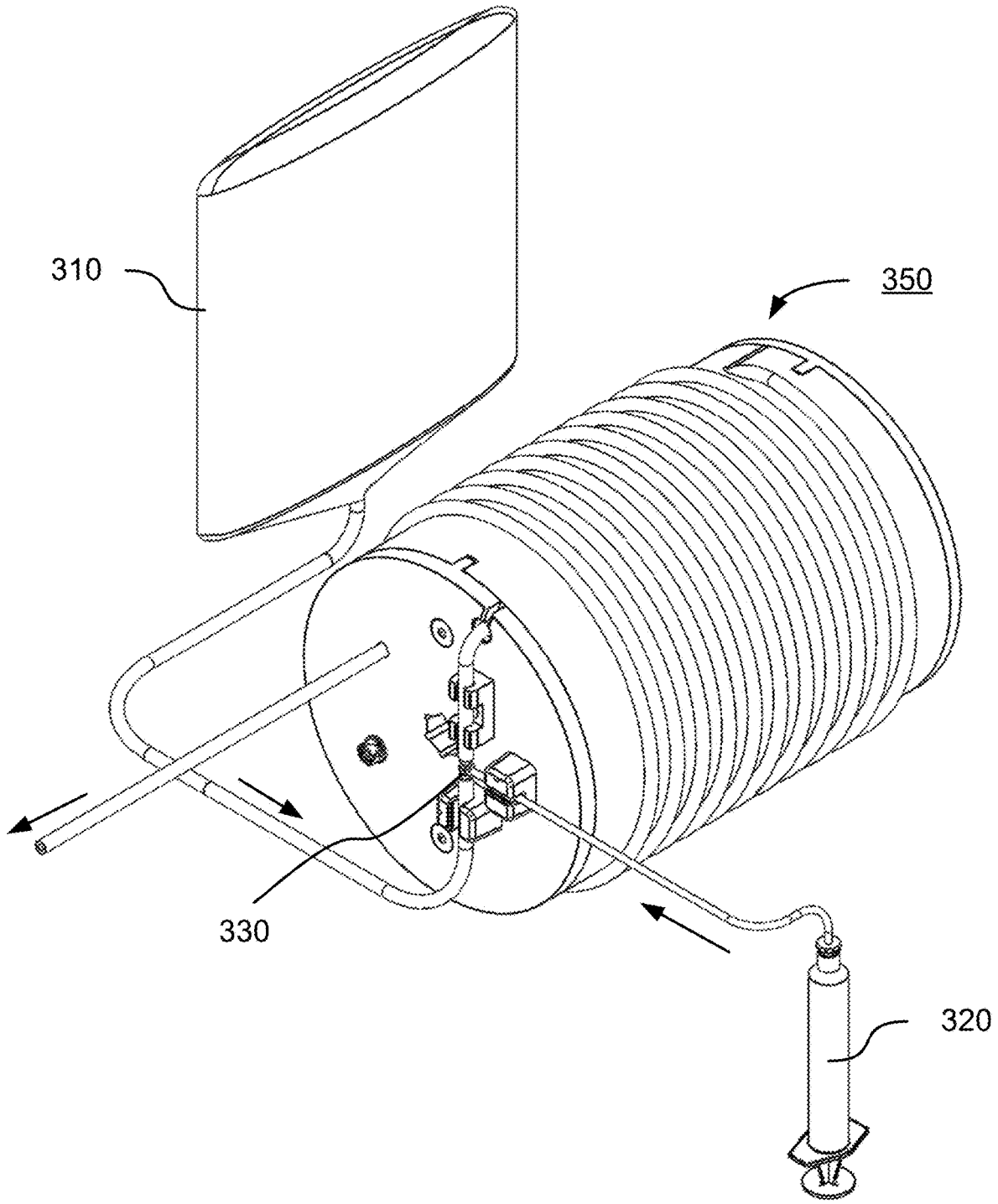
FIGS. 3C and 3D show perspective views of some of the components of the system shown in FIG. 3B, according to one embodiment.
Figure 3D:
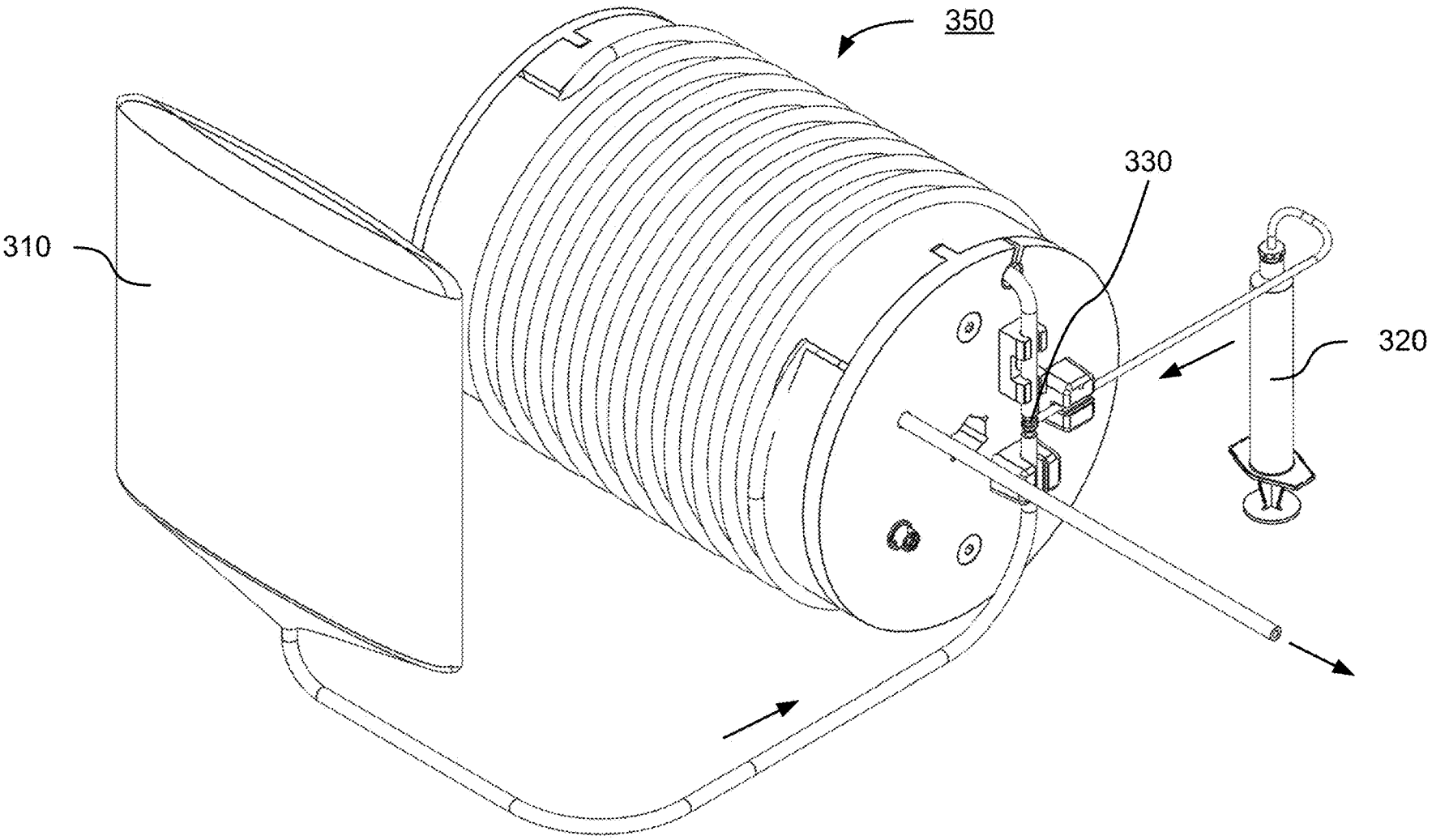

FIGS. 3A and 3B show block diagrams of different configurations of a system for continuous in-line incubation, according to other embodiments. FIGS. 3C and 3D show perspective views of some of the components of the system shown in FIG. 3B, according to one embodiment. In the example of FIGS. 3A and 3B, a bulk reagent (liquid A) (e.g., acetophenone in the manufacturing of thioamide) is to be mixed with other reagents (liquids B and C) (e.g., morphine and $S_8$ in the manufacturing of thioamide). The bulk reagent is typically the reagent with the highest relative volume. The bulk reagent may be stored in a bag 310, while other reagents may be stored in syringes 320. The syringes are installed on a syringe pump 325 which is capable of accurately and independently dispensing the contents of both syringes. In some embodiments, as shown in the configuration of FIG. 3A, the bag 310 is connected to a pump 315 (e.g., a peristaltic pump or a gear pump) to control the dispensing of the bulk reagent. In other embodiments, as shown in the configuration of FIG. 3B, the fluid isolating pump 350 is used to control the dispensing of the bulk reagent. As such, in this embodiment, pump 315 may be omitted because the fluid isolating pump will draw or pull the bulk reagent during operation.

Fluidic junction 330 is a junction where liquids A, B, and C intersect. The fluidic junction 330 is coupled to a mixer 335 where liquids A, B, and C mix. For example, in the configuration shown in FIG. 3A, the mixer 335 may be an active mixer. Here, the pump 315 draws liquid A from bag 310 into the active mixer while syringe pump 325 doses contents from syringes 320 into the active mixer. The active mixer may include a sterile container having blades coupled to a motor. As the blades rotate, the blades provide agitation that causes the liquids held inside the sterile container become homogenous. In some embodiments, the liquid to be mixed is provided and mixed in batches. For example, the pumps 315 and 325 are configured to pump liquids A, B, and C into the active mixer when the fluid level inside the mixer reaches a lower threshold, and stops dispensing the liquids into the active mixer when the fluid level inside the mixer reaches an upper threshold. In another example, in the configuration shown in FIG. 3B, the mixer 335 may be a static mixer. The output of the mixer 335 is then coupled to a fluid isolating pump 350 to allow the mixed fluid to incubate or react for a specified amount of time.

In some embodiments, the fluid isolating pump is then coupled to a fluidic junction 360 where the output of the fluid isolating pump is intersected with an additional reagent (liquid D) (e.g., nickel (II) chloride solution in the manufacturing of thioamide). Liquid D may be stored in a reservoir 365. In some embodiments, the additional reagent is pumped to the fluidic junction 360 by means of a peristaltic pump 370. The final product is then collected or distributed to a collection reservoir 375.

Fluid isolating pump 350 supports the continuous production or manufacturing of various fluidic chemistries historically restricted to batch processing. The fluid isolating pump 350 allows for the continuous production of liquid products by providing the capability of performing complex incubations in a continuous flow environment within a functionally-closed (sterile) system.

Using peristalsis, the fluid isolating pump 350 is capable of isolating predetermined volumes of fluid (e.g., liquid) within a continuous flow environment (e.g., a tube) to facilitate incubation or biological/chemical reaction(s). The system achieves fluid isolation by compressing portions of a tubing using multiple rollers that traverse the length of the tubing. As the rollers move from one end of the tubing to an opposite end of the tubing, the fluid that is confined within the space between two rollers is isolated from the rest of the fluid. Moreover, as the rollers traverse the length of the tubing, the compression of the tubing forces the fluid to also move across the length of the tubing.

Figure 4B:
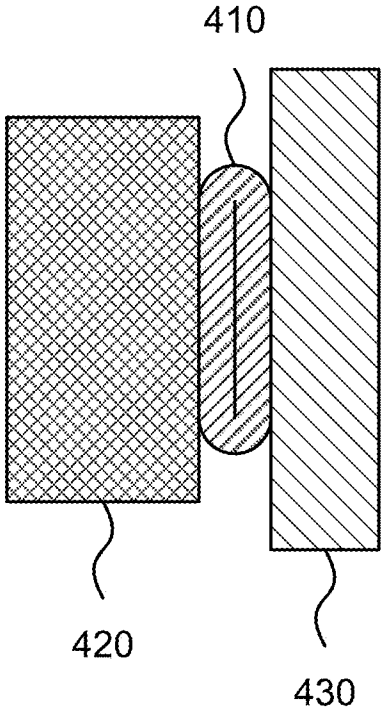
FIG. 4B shows a cross-sectional view of a tubing in a compressed state.
Figure 4A:
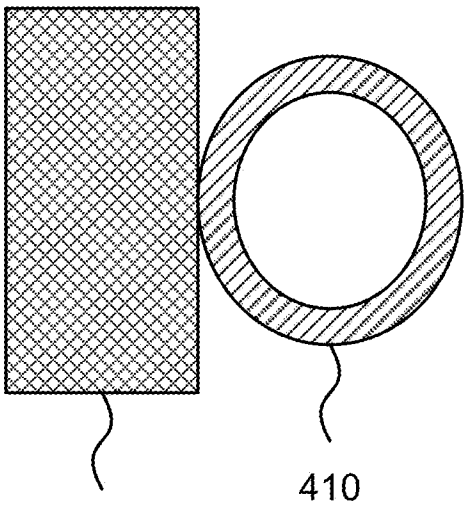
FIG. 4A shows a cross-sectional view of a tubing in an uncompressed state.

FIG. 4A shows a cross-sectional view of a tubing in an uncompressed state. The tubing 410 is disposed over a rigid surface 420. In an uncompressed state, center of the tubing 410 is open and may enclose a fluid that can travel through/along the tubing.

FIG. 4B shows a cross-sectional view of a tubing in a compressed state. In the compressed state, roller 430 applies a compressive force to the tubing 410. As the gap between the roller 430 and the rigid surface 420 decreases, the opening at the center of the tubing 410 collapses, isolating a fluid on one side of the collapsed region from the fluid at the opposite side of the collapsed region. That is, fluid is prevented from traveling across the compressed portion of the tubing.

Figure 5:
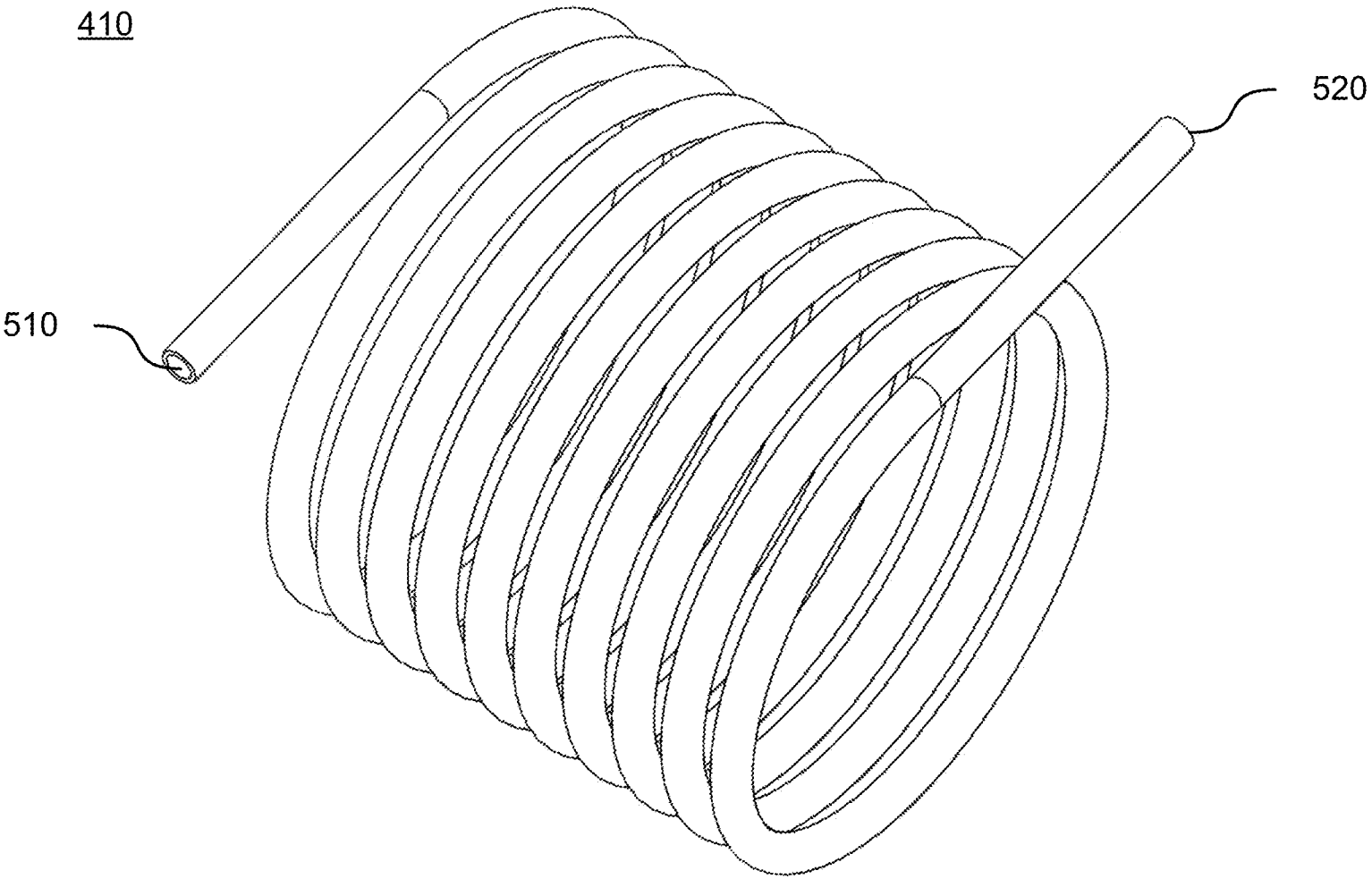
FIG. 5 shows a perspective view of a tubing for use in a fluid isolating pump, according to one embodiment.

FIG. 5 shows a perspective view of a tubing for use in a fluid isolating pump, according to one embodiment. In the embodiment of FIG. 5, the tubing is configured to have a helical structure. The tubing 410 may be wound into a helix while maintaining an input port 510 and an output port 520. The geometry of a helical tubing 410 allows for a significantly larger fluid volume in a smaller footprint when compared to a linear embodiment. This results in a higher throughput from a smaller device. Elongated rollers, which apply pressure across the length of the helix are able to provide mechanical and fluidic isolation. In some embodiments, the tubing may be configured in structures other than a helix. For example, the tubing may be configured having a linear structure, a zigzag pattern, and the like. Various configurations of the tubing are described below.

There are two proposed configurations herein for implementing a fluid isolating pump using a helical tubing. In the first configuration, a force or pressure is applied from the outside of the helical tubing. This configuration is referred to as an "external roller pump." In the second configuration, a force or pressure is applied from the inside of the helical tubing. This configuration is referred to as an "internal roller pump."

The helical tubing may be multiple individual tubes or a single tube with multiple coils around a cylindrical rigid tube. The chambers in each loop of the helical tubing are individually isolated for incubation, reaction, or other operations.

External Roller Pump

Figure 6A:
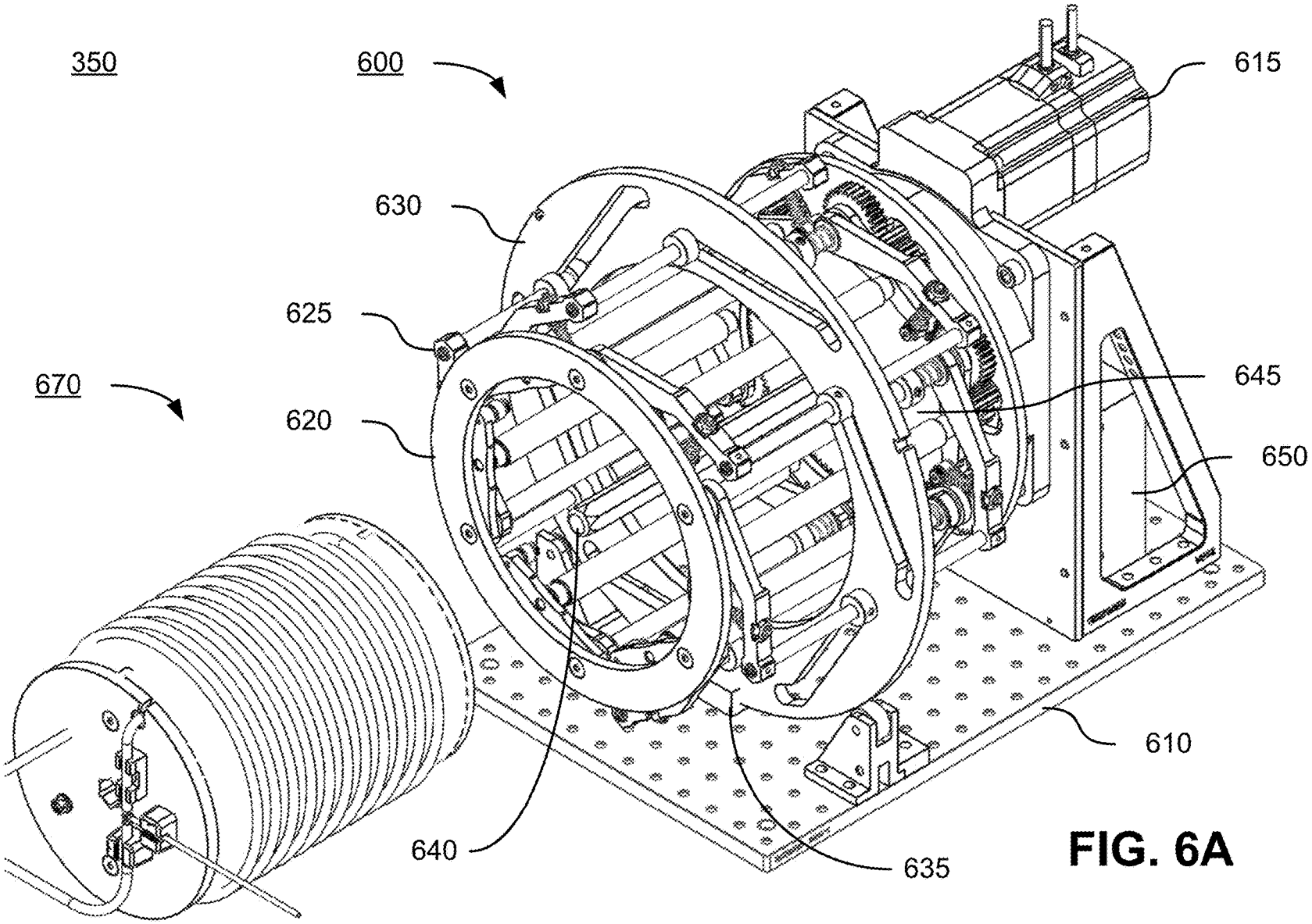
FIG. 6A shows a perspective view of an "external roller pump," according to one embodiment.
Figure 6B:
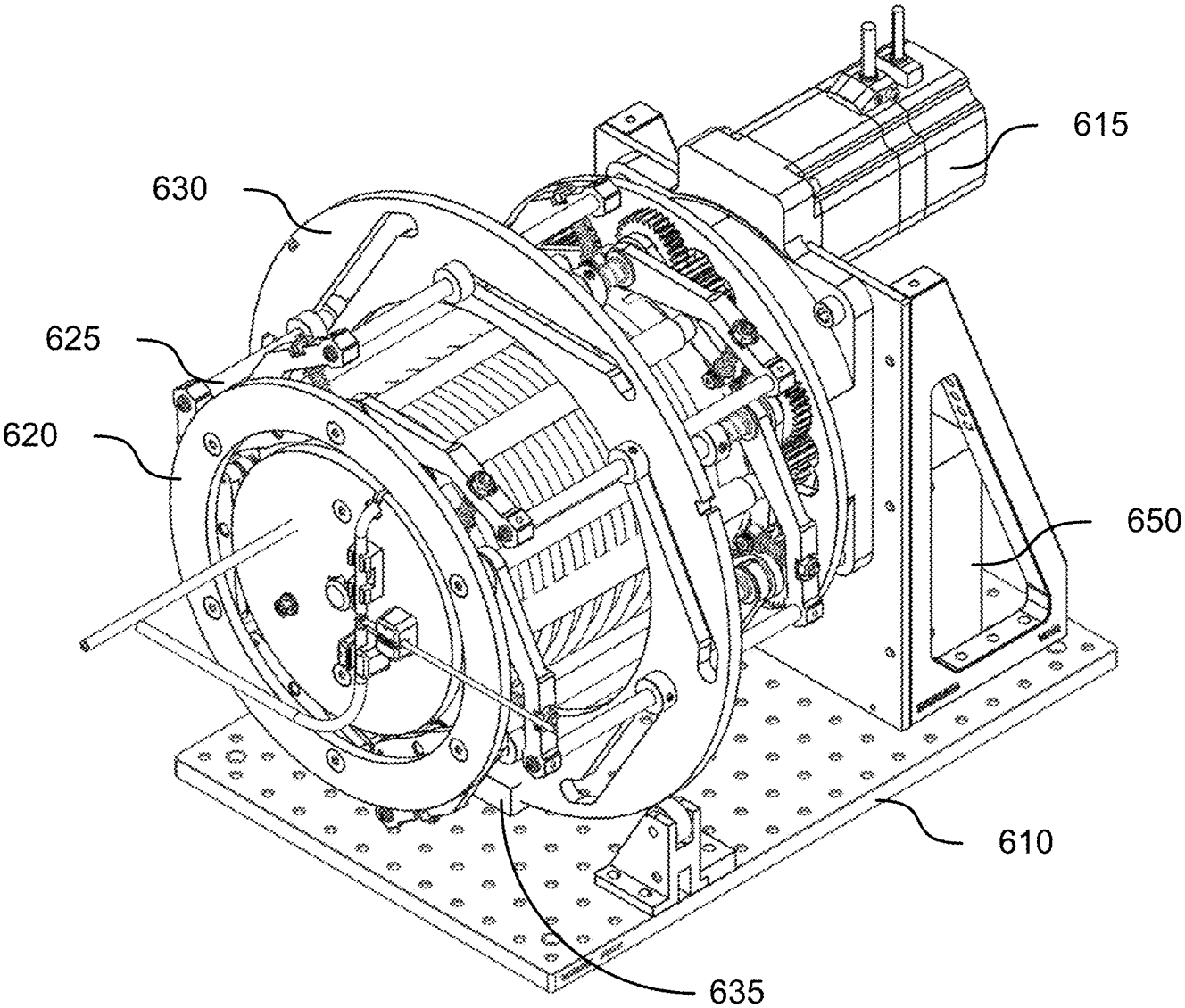
FIG. 6B shows a perspective view of the external roller pump with a consumable inserted, according to one embodiment.
Figure 6C:
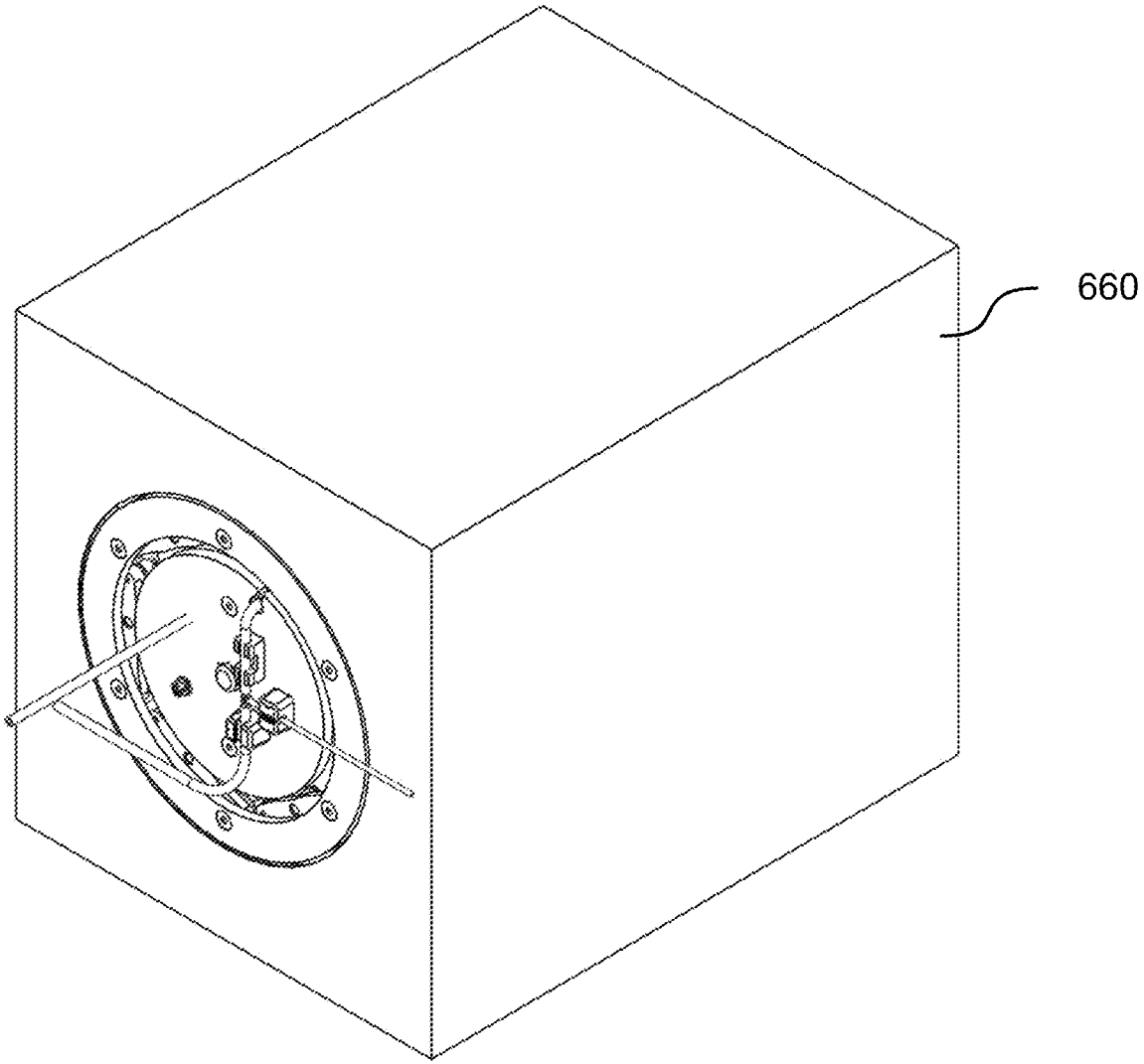
FIG. 6C shows a perspective view of an external roller pump inside an external enclosure, according to one embodiment.
Figure 6D:
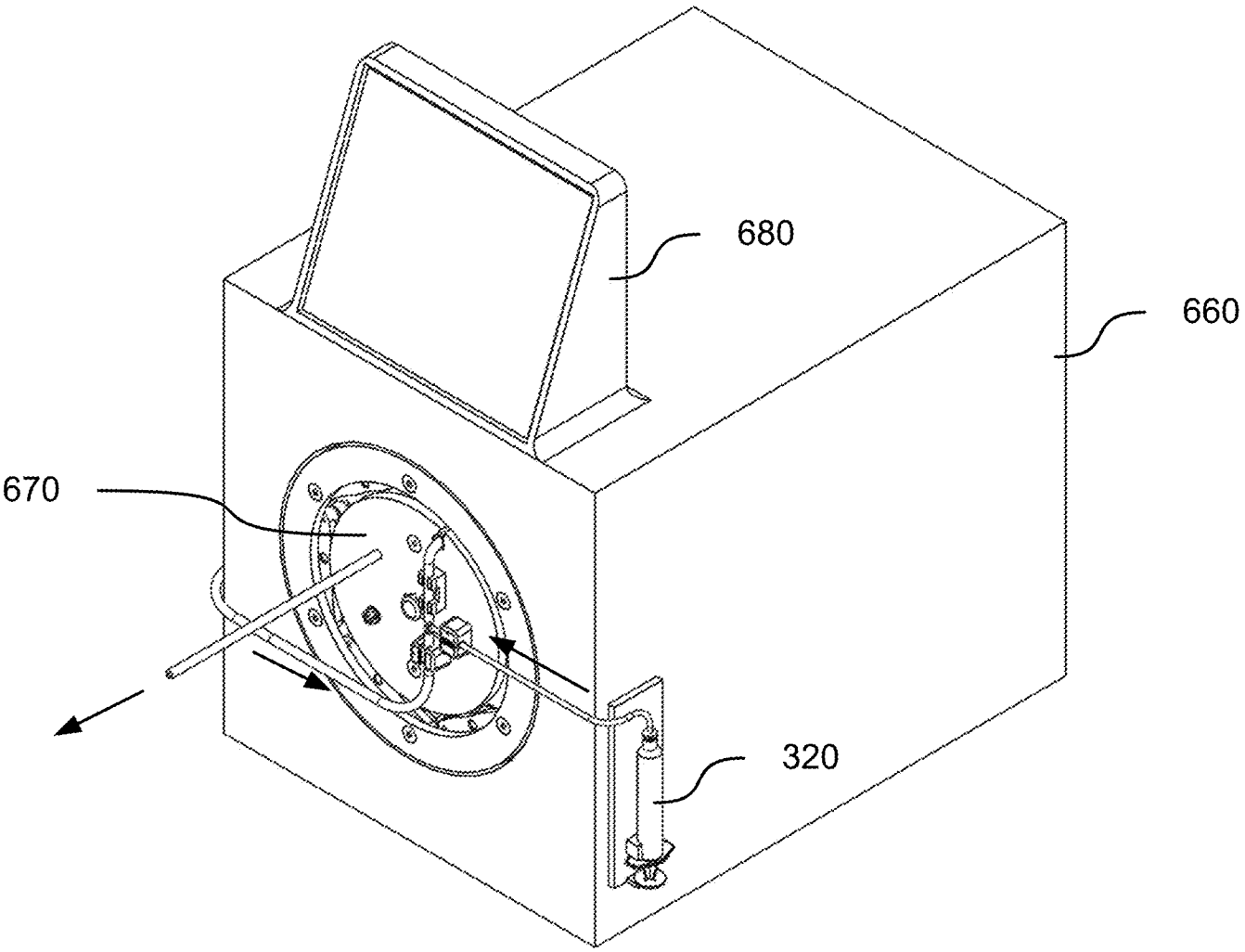
FIGS. 6D-G show perspective views of an external roller pump with a graphical user interface and peripheral components, according to one embodiment.
Figure 6E:
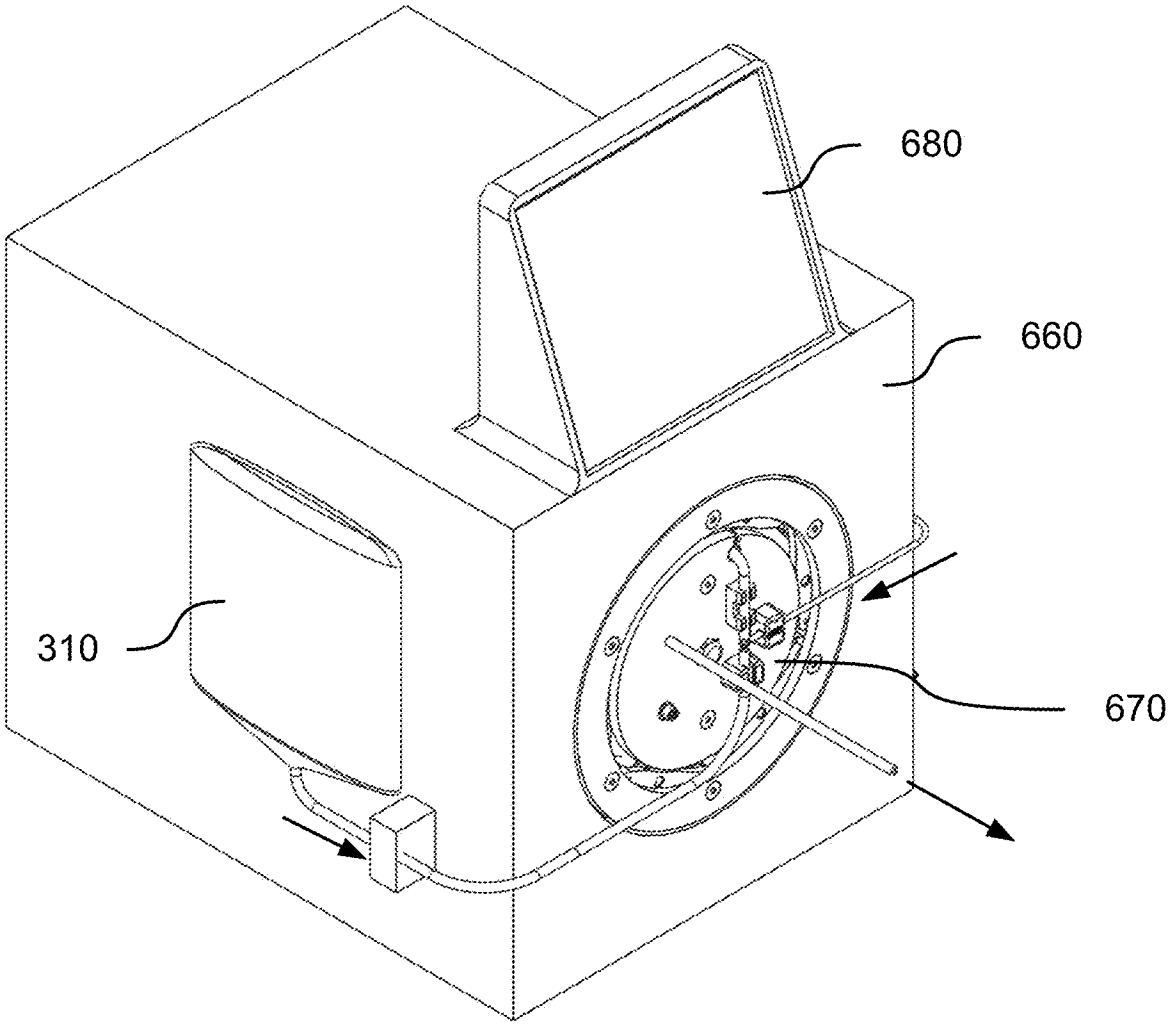
Figure 6F:
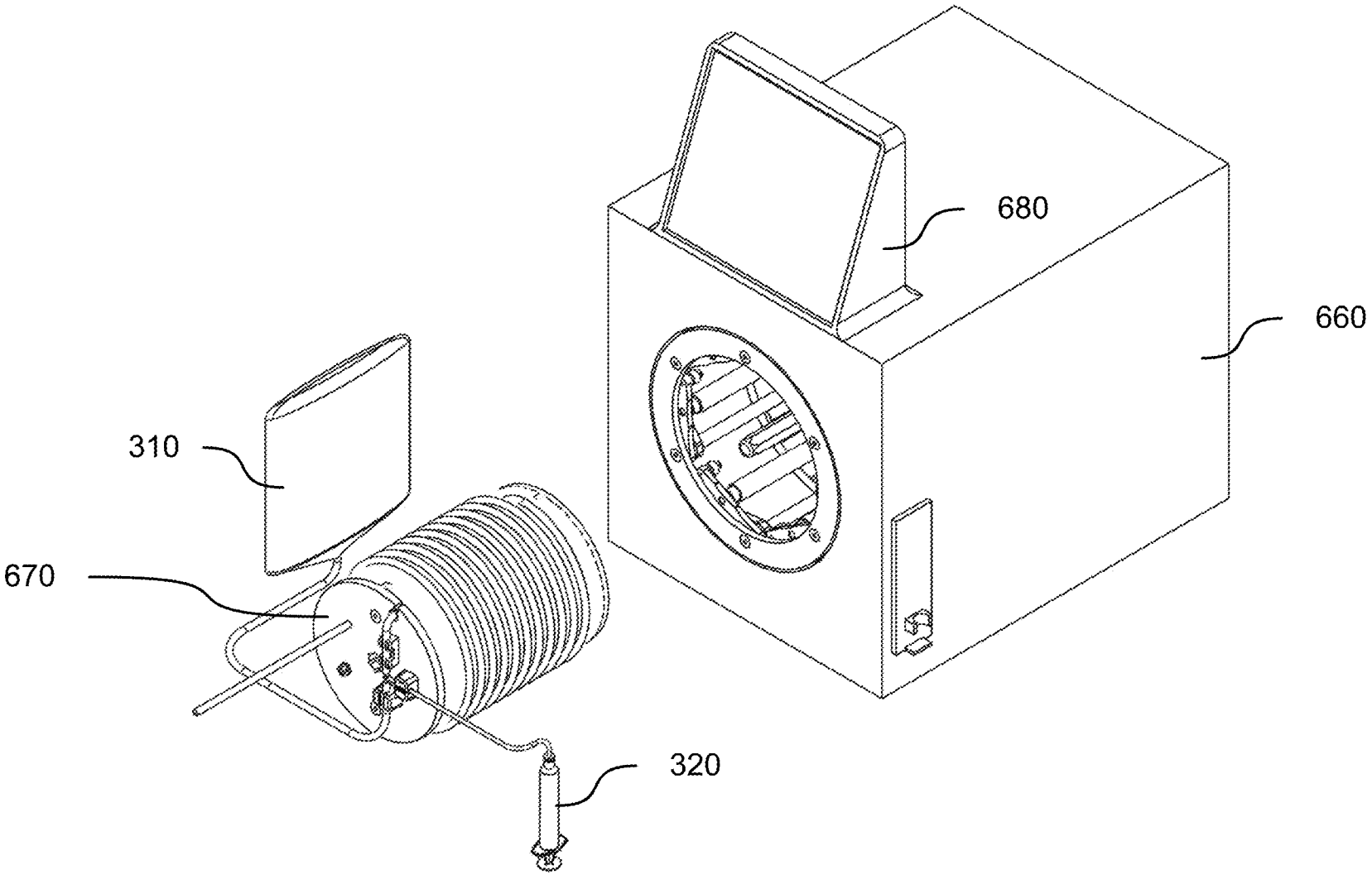
Figure 6G:
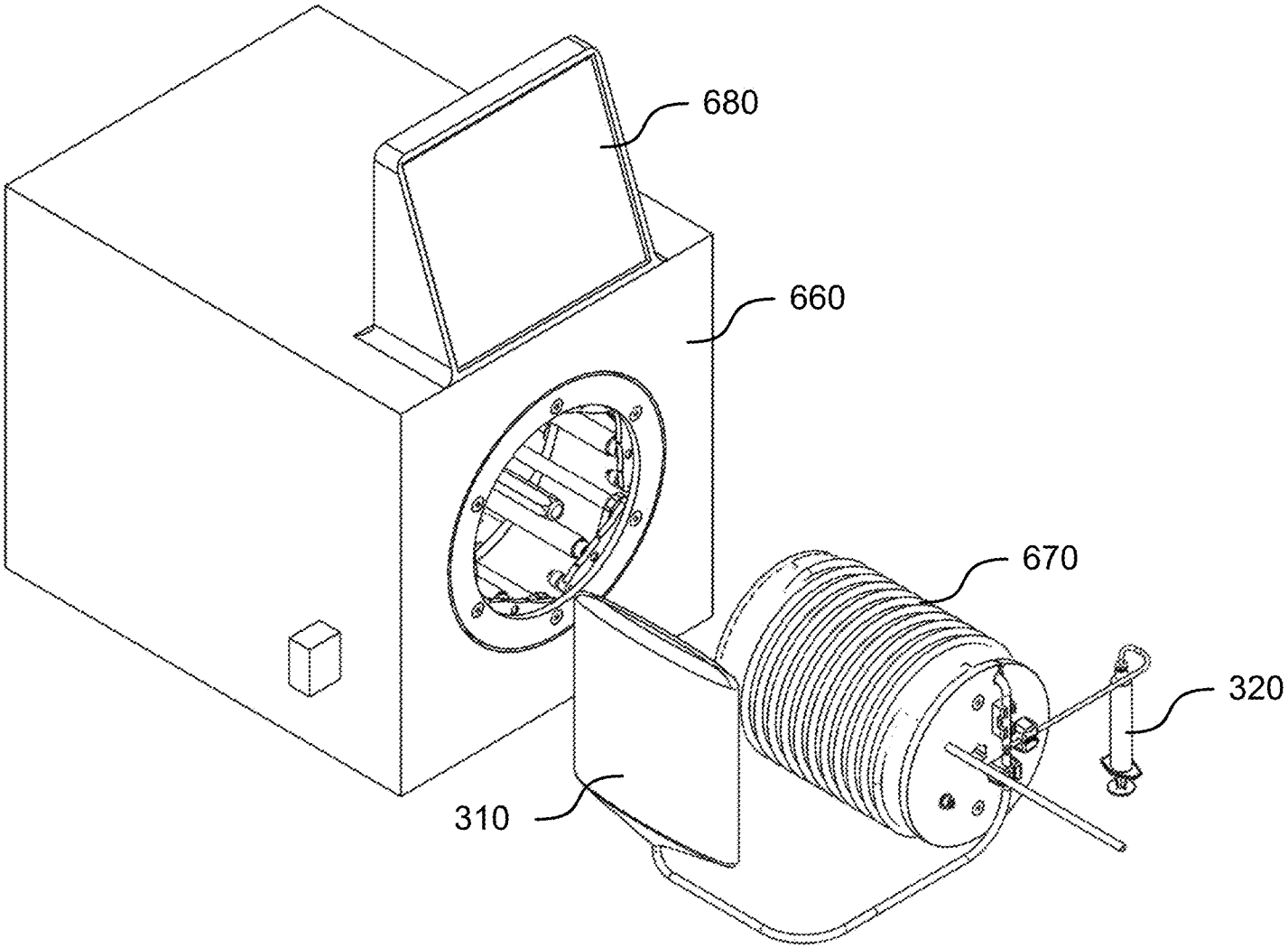

FIG. 6A shows a perspective view of an "external roller pump," according to one embodiment. FIG. 6B shows a perspective view of the external roller pump with a consumable inserted, according to one embodiment. FIG. 6C shows a perspective view of an external roller pump inside an external enclosure, according to one embodiment. FIGS. 6D through 6G show perspective views of an external roller pump with a graphical user interface and peripheral components, according to one embodiment.

The external roller pump is a fluid isolating pump 350 configured to have rollers positioned radially outward from the tubing or consumable. The fluid isolating pump 350 shown in FIG. 6A has a roller pump assembly 600 and a consumable assembly 670. In some embodiments, other components of the continuous in-line incubation system 300, such as pump 315, syringe pumps 325, fluidic junction 330, or mixer 335, may be attached to the roller pump assembly 600.

The roller pump assembly 600 includes a rigid base 610, a motor 615, a cage 620, one or more roller assemblies 625, one or more cam plates 630, a cam brake 635, a non-rotating central shaft 640, a central gear 645, and control electronics 650. In some embodiments, the roller pump assembly 600 additionally includes an external enclosure 660 to protect the components, to assist with thermal insulation, to prevent a user from improperly operating the components of roller pump assembly 600, and to improve safety in the operation of the roller pump assembly 600.

The rigid base 610 provides a structure to support the various components of the roller pump assembly 600. In some embodiments the rigid base 610 is made of a sturdy material such as a metal. In some embodiments, the base includes mounting holes to secure the roller pump assembly 600 to an external surface, such as to a table or workbench, to reduce the vibrations resulting from the operation of the fluid isolating pump. In the embodiment shown in FIG. 6A, the rigid base further includes a vertical mounting structure. The vertical mounting structure provides surfaces for mounting some of the components of the roller pump assembly 600.

The non-rotating central shaft 640 is mounted to the vertical mounting structure of the rigid base 610. The non-rotating central shaft 640 provides an interface to attach to the consumable 670. For example, the non-rotating central shaft 640 has a cross-section (e.g. a hexagonal cross section) that matches a shape of central hole of the consumable 670.

In some embodiments, if the consumable includes thermal control and measurement devices, then heat is evenly distributed to the fluid within the tubing based on the secured position of the non-rotating central shaft 640. Heat can be continuously sent to other regions from the secured position. This can reduce variability during production runs as a consistent heat profile is maintained. Large scale biopolymer synthesis and protein functionalization are often difficult to reproduce due to conformational dynamics and inherent distribution of varied molecular weights. Thermal runways which can impact polydispersity and induce variability in polymeric structures can be minimized or eliminated by securing the position of the thermal control and measurement devices.

The central gear 645 is configured to be mounted on the non-rotating central shaft 640. In some embodiments, the central gear 645 has a central opening that matches the cross-section of the non-rotating central shaft 640. As such, similar to the non-rotating central shaft 640, the central gear 645 is also configured to be non-rotating.

Motor 615 is mounted to the rigid base 610. In some embodiments, the motor 615 is mounted on the vertical mounting structure of the rigid base 610. In some embodiments, the motor 615 is a hollow rotary actuator. A hollow rotary actuator is a motor that includes a rotating disc (also referred to as a rotating table) that has a hollow center. The hollow rotary actuator is positioned such that the center of the rotating disc is axially aligned with the non-rotating central shaft 640. As such, the hollow rotary actuator allows the central shaft 640 and the consumable 670 to remain stationary while other components, such as the cage 620 and the roller assemblies 625 rotate about the non-rotating central shaft 640.

The cage 620 is mounted to the motor 615 and provides an interface to mount the roller assemblies 625. The cage 620 is described in more detail hereinbelow in conjunction with FIGS. 8A and 8B.

The roller assemblies 625 are attached to the cage 620 and are configured to press a tubing of the consumable 670. In some embodiments, the roller pump assembly 600 includes six roller assemblies. In other embodiments, the roller pump assembly 600 includes more or less roller assemblies depending on the size of the fluid isolating pump and the parameters of the process being run. The roller assemblies 625 are described in more detail hereinbelow in conjunction with FIGS. 9A and 9B.

The cam plate 630 interfaces with the roller assemblies 625 to position the roller assemblies 625 in an engaged or a disengaged position. In the disengaged position, the rollers assemblies 625 are positioned such that pressure is not applied to the consumable 670. This position allows for the installation or removal of the consumable 670. In the engaged position, the roller assemblies 625 are positioned such that pressure is applied to the consumable 670. This is the position of the roller assemblies 625 during normal operation of the fluid isolation pump. The pressure applied by the roller assemblies 625 allows for the mechanical isolation of the fluid as the fluid traverses the consumable 670. The cam plate 630 is described in more detail hereinbelow in conjunction with FIG. 10.

Cam brake 635 is mounted on the rigid base 610. The cam brake 635 may be used to prevent or permit the rotation of cam plate 630. When engaged, cam plate 630 is prevented from rotating. Since each roller assembly 625 is connected to the cam plate 630, the roller assemblies 625 drive radially inward or radially outward depending on the direction of motor 615. Cam brake 635 may be engaged by a pin, by a pneumatic or hydraulic brake caliper, or by other mechanisms for achieving the same outcome.

A. Base

Figure 7A:
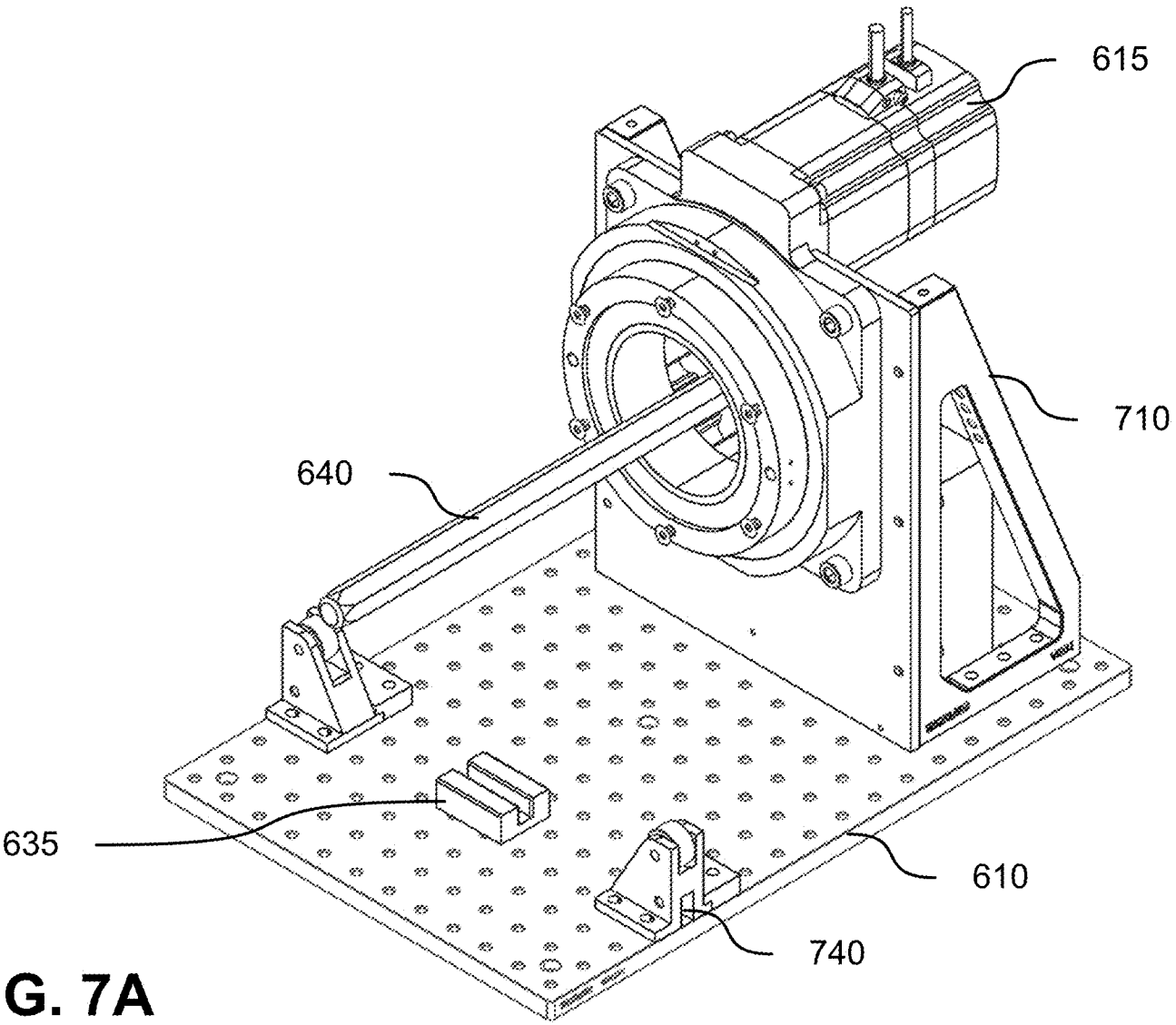
FIG. 7A shows a perspective view of the front of the rigid base, according to one embodiment.
Figure 7B:
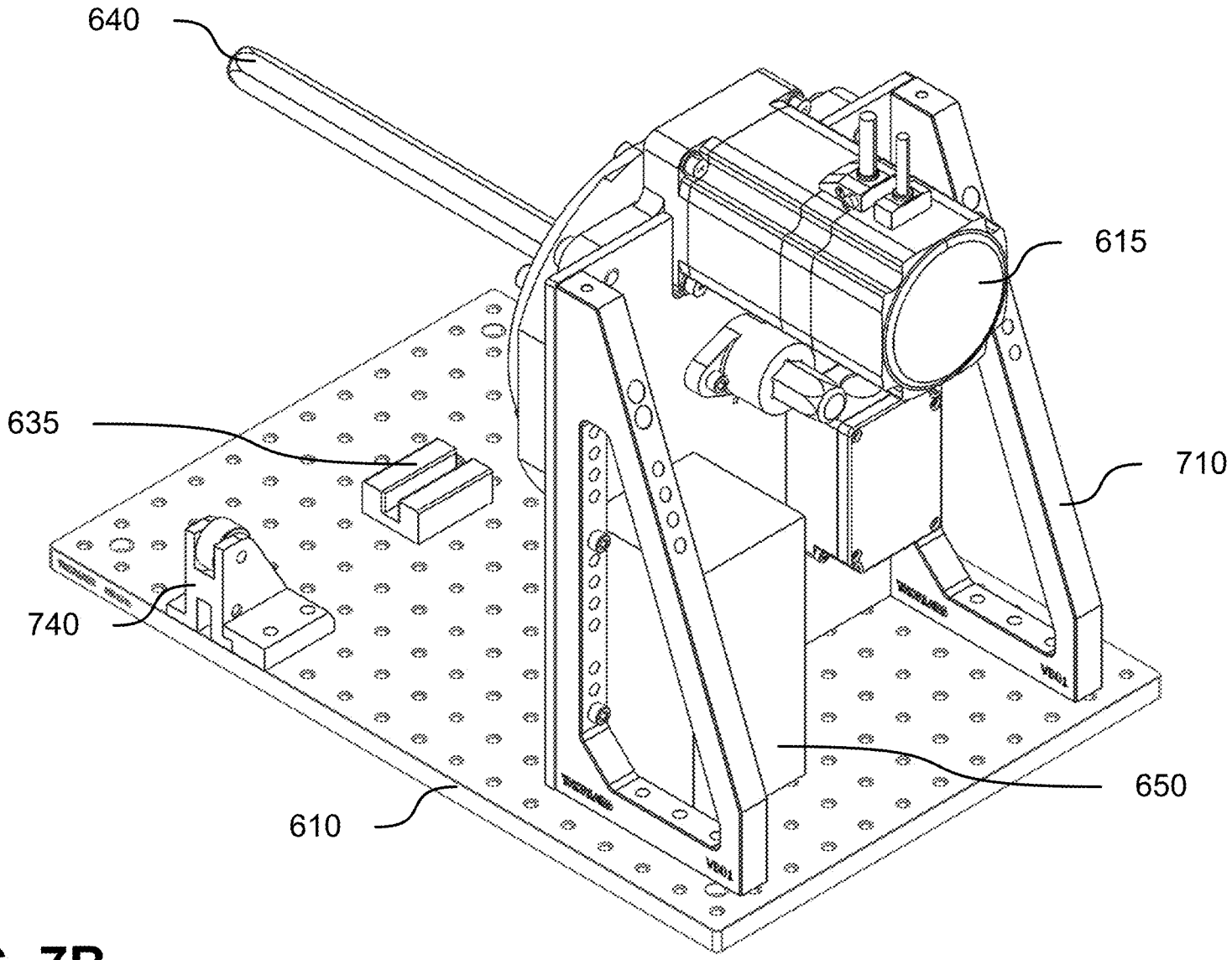
FIG. 7B shows a perspective view of the back of the rigid base, according to one embodiment.
Figure 7C:
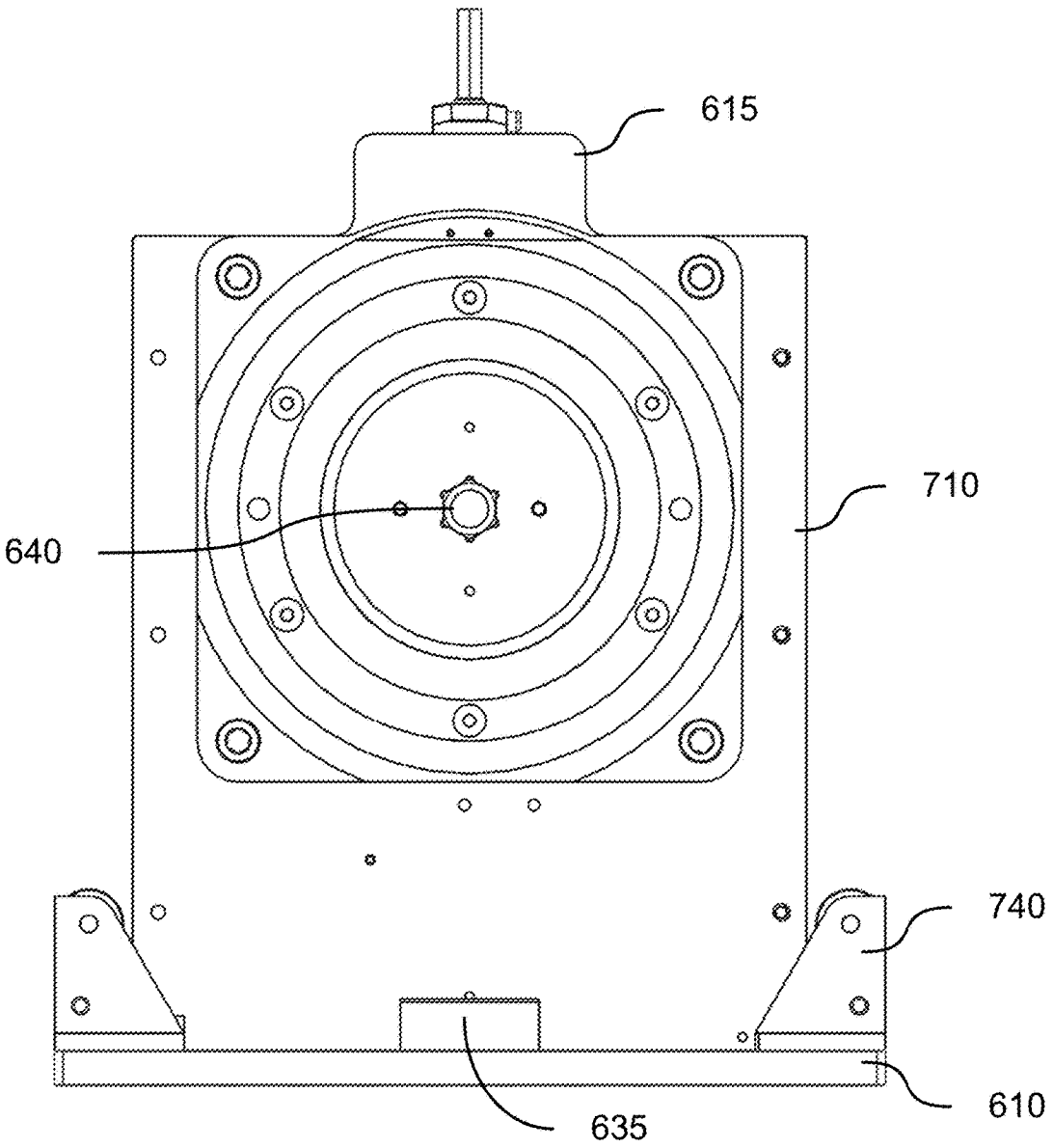
FIG. 7C shows a front view of the rigid base, according to one embodiment.

FIG. 7A shows a perspective view of the front of the rigid base 610, according to one embodiment. FIG. 7B shows a perspective view of the back of the rigid base 610, according to one embodiment. FIG. 7C shows a front view of the rigid base 610, according to one embodiment.

The rigid base 610 provides a rigid body to mount the various components of the roller pump assembly 600. The rigid base 610 may be constructed of metal, or any suitable rigid material. The rigid base 610 includes a vertical mounting structure 710. In the embodiment of FIG. 7A, the vertical mounting structure has two vertical supports and a mounting plate attached to the vertical supports.

The motor 615 is attached to the mounting plate of the vertical mounting structure 710. Similarly, the non-rotating central shaft 640 is also attached to the mounting plate of the vertical mounting structure 710. As such, both the motor 615 and the non-rotating central shaft 640 are secured to the rigid base 610 and are prevented from moving relative to the rigid base 610. Moreover, the components that are directly attached to the non-rotating central shaft 640 are also prevented from rotating relative to the rigid base 610. However, the components that are attached to the output table or output shaft of the motor 615 are allowed to rotate relative to the rigid base 610.

In some embodiments, the rigid base 610 includes rollers 740. Rollers 740 provide support and aid in maintaining axial alignment for one or more rotating components of the roller pump assembly 600. For example, the rollers 740 shown in FIG. 7A provide support for the cam plate 630. However, the rigid base 610 may also include rollers for providing support to the cage 620.

In some embodiments, the rigid base 610 provides a mounting surface for additional components such as auxiliary pumps (e.g., one or more peristaltic pumps, and one or more syringe pumps), static mixers, dynamic mixers, fluidic junctions, and the like. Moreover, the rigid base 610 provides a mounting surface for electronics 650 to control the motor 615, cam brake 635, and auxiliary pumps. The electronics 650 may include a digital interface (e.g., a Universal Serial Bus (USB) interface), a motor driver, and an alternating current (AC) to direct current (DC) converter. The electronics 650 may further include a user interface 680 such as one or more buttons or a touch screen to control set operating parameters of the fluid isolating pump. The electronics 650 may further include a system controller that reads data from various internal and/or external sensors, and controls the motor drivers. The system controller may be a single board computer, an application specific integrated circuit (ASIC), a system-on-a-chip (SoC), or the like.

B. Cage

Figure 8A:
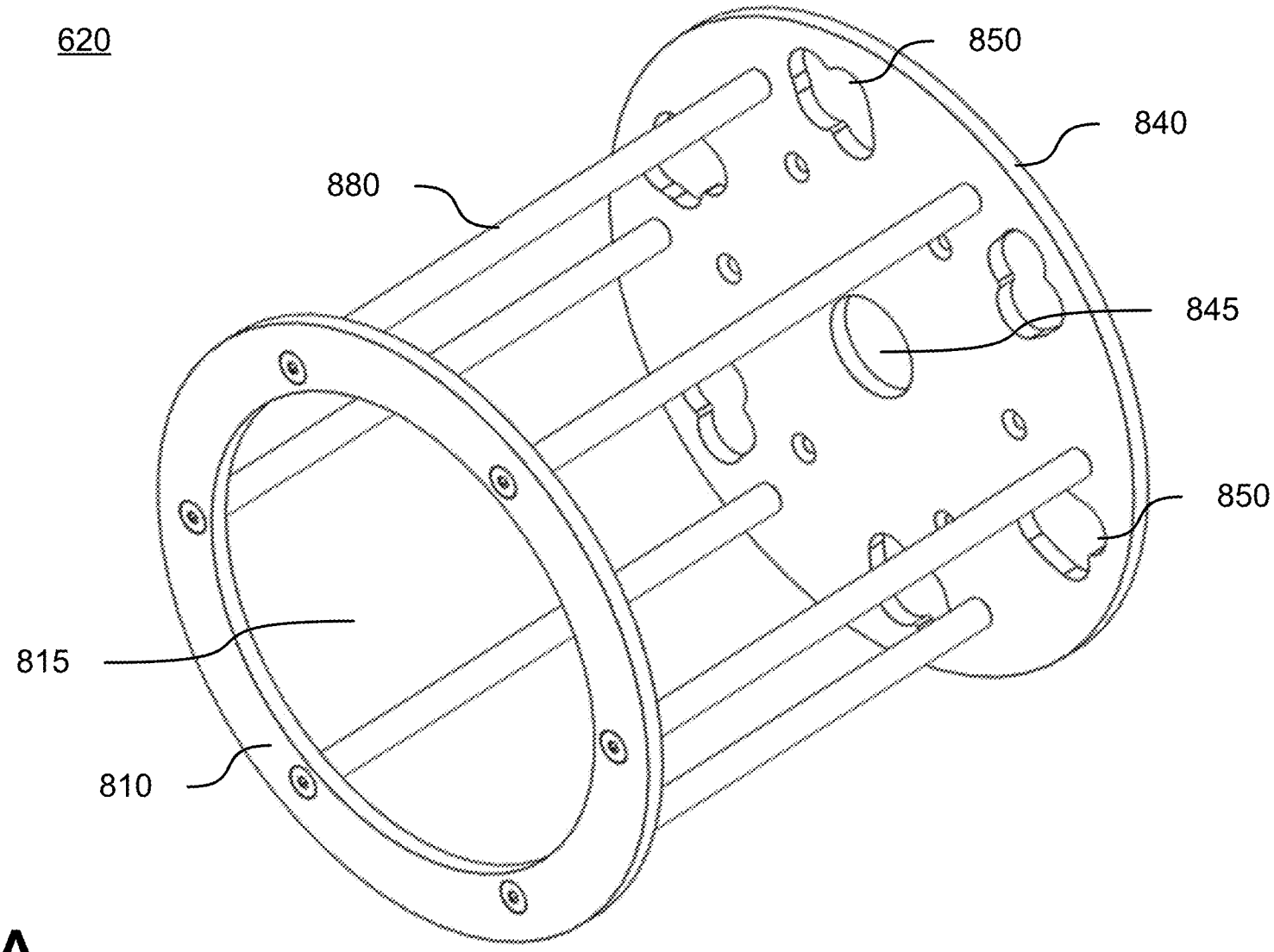
FIG. 8A shows a perspective view of the cage, according to one embodiment.
Figure 8B:
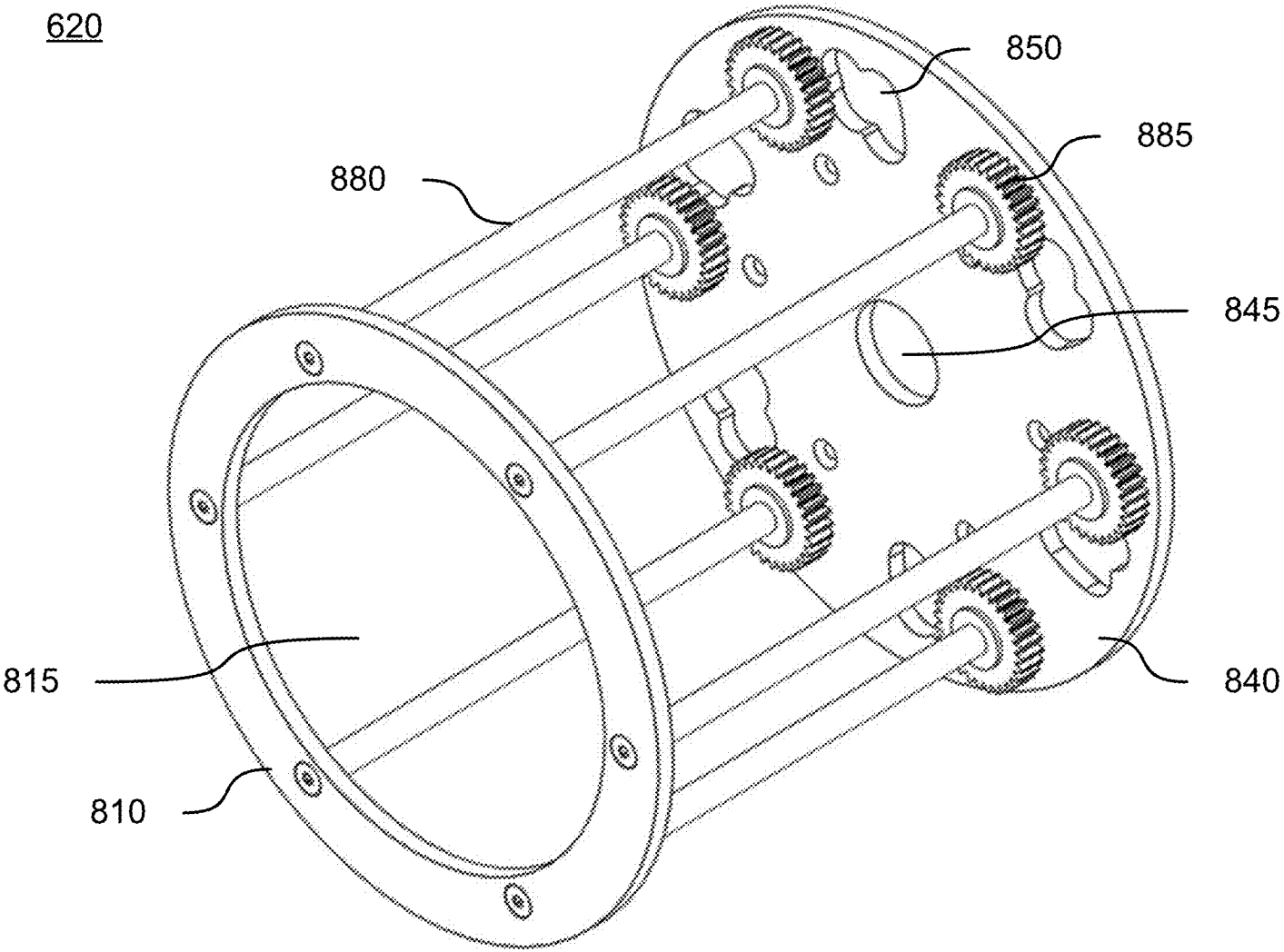
FIG. 8B shows a perspective view of the cage having peripheral gears, according to one embodiment.

FIG. 8A shows a perspective view of the cage 620, according to one embodiment. FIG. 8B shows a perspective view of the cage 620 having peripheral gears, according to one embodiment. The cage 620 is mounted to the motor 615 and provides an interface to mount the roller assemblies 625. The cage 620 is configured to rotate during operation. In some embodiments, the cage 620 is directly mounted to the motor 615. For example, the cage 620 is secured to a rotating table of a hollow rotary actuator. In other embodiments, the cage 620 is coupled to the motor via one or more gears or belts.

The cage 620 includes a front plate 810, a back plate 840, and one or more connecting rods 880. In some embodiments, the cage 620 further includes peripheral gears 885 that are configured to be linked to the central gear 645. In some embodiments, the front plate 810 and the back plate 840 are metal plates, however, other suitable materials are also possible. Moreover, in some embodiments, the connecting rods 880 are metal rods however, other suitable materials are also possible.

The connecting rods 880 have a front end and a rear end. The front end of each connecting rod 880 is attached to the front plate 810. The rear end of each connecting rod 880 is attached to the back plate 840. In some embodiments, the connecting rods 880 are attached to the front and back plates with screws. In other embodiments, the connecting rods 880 are welded to the front and back plates. In yet other embodiments, other suitable methods for attaching the connecting rods 880 to the front plate 810 and the back plate 840 may be used.

The connecting rods 880 are constructed of a metal, such as steel, or any other suitable material. In addition to connecting the front plate 810 and the back plate 840, the connecting rods provide an attaching point to other components of the roller pump assembly 600. For instance, the connecting rods 880 provide an attaching point for the roller assemblies 625. Moreover, the connecting rods 880 may have a circular cross-section to allow for relative rotation of components installed. For example, the connecting rods 880 serve as pivots for the roller assemblies 625. In the example of FIG. 6A, there are six roller assemblies, and thus there are six units of connecting rods 880, however, other number of rods may be used depending on the application.

The front plate 810 adds rigidity and strength to the cage 620. Moreover, the front plate 810 provides a connecting point to the connecting rods 880 to increase the parallelism of the connecting rods 880. The front plate 810 may have a circular shape, however, other shapes are also possible. Moreover, the front plate 810 may be constructed of a metal, however, any other suitable material may also be used. The front plate 810 has an opening 815. In some embodiments, the front opening 815 has a circular shape. The front opening 815 allows the consumable 670 to be inserted inside the cage 620. Thus, the size of the front opening 815 is larger than the diameter of the consumable 670. In some embodiments, the front opening 815 is axially aligned with the center of rotation of the cage 620. Moreover, in some embodiments, the front opening 815 is aligned with the center of the front plate 810.

The back plate 840 may have a circular shape, however, other shapes are also possible. The back plate 840 has an opening 845. In some embodiments, the back opening 845 has a circular shape. In some embodiments, the back opening 845 is aligned with the center of rotation of the cage 620. Moreover, in some embodiments, the back opening 845 may be aligned with the center of the back plate 840. The back opening 845 is configured to allow the non-rotating central shaft 640 to go through the back opening 845. Thus, the size of the back opening 845 is larger than the cross-section of the non-rotating central shaft 640.

In some embodiments, the back plate 840 further includes one or more peripheral openings 850. The peripheral openings 850 allow a portion of the roller assemblies 625 to penetrate. For example, the peripheral openings 850 allow gears of the roller assemblies 625 to move radially inward and outward as the roller assemblies are moved back and forth between an engaged and a disengaged position.

In some embodiments, the cage 620 further includes peripheral gears 885. The central gear 645 and the peripheral gears 885 may form a planetary gear system, wherein the central gear 645 is the sun gear and the peripheral gears 885 are the planet gears. The central gear 645 is aligned with the center of rotation of the cage 620. Moreover, each peripheral gear 885 is axially aligned with a connecting rod 880. In some embodiments, each peripheral gear 885 is mounted on a corresponding connecting rod 880. In this embodiment, the peripheral gears 885 are configured to be able to rotate about the corresponding connecting rod 880. The peripheral gears 885 are configured to be linked to a gear of a corresponding roller assembly 625. The central gear 645 and the peripheral gears 885 allow the rollers of the roller assemblies 625 to rotate with a rotational velocity that is proportional to the rotational velocity of the cage 620.

C. Roller Assembly

Figure 9A:
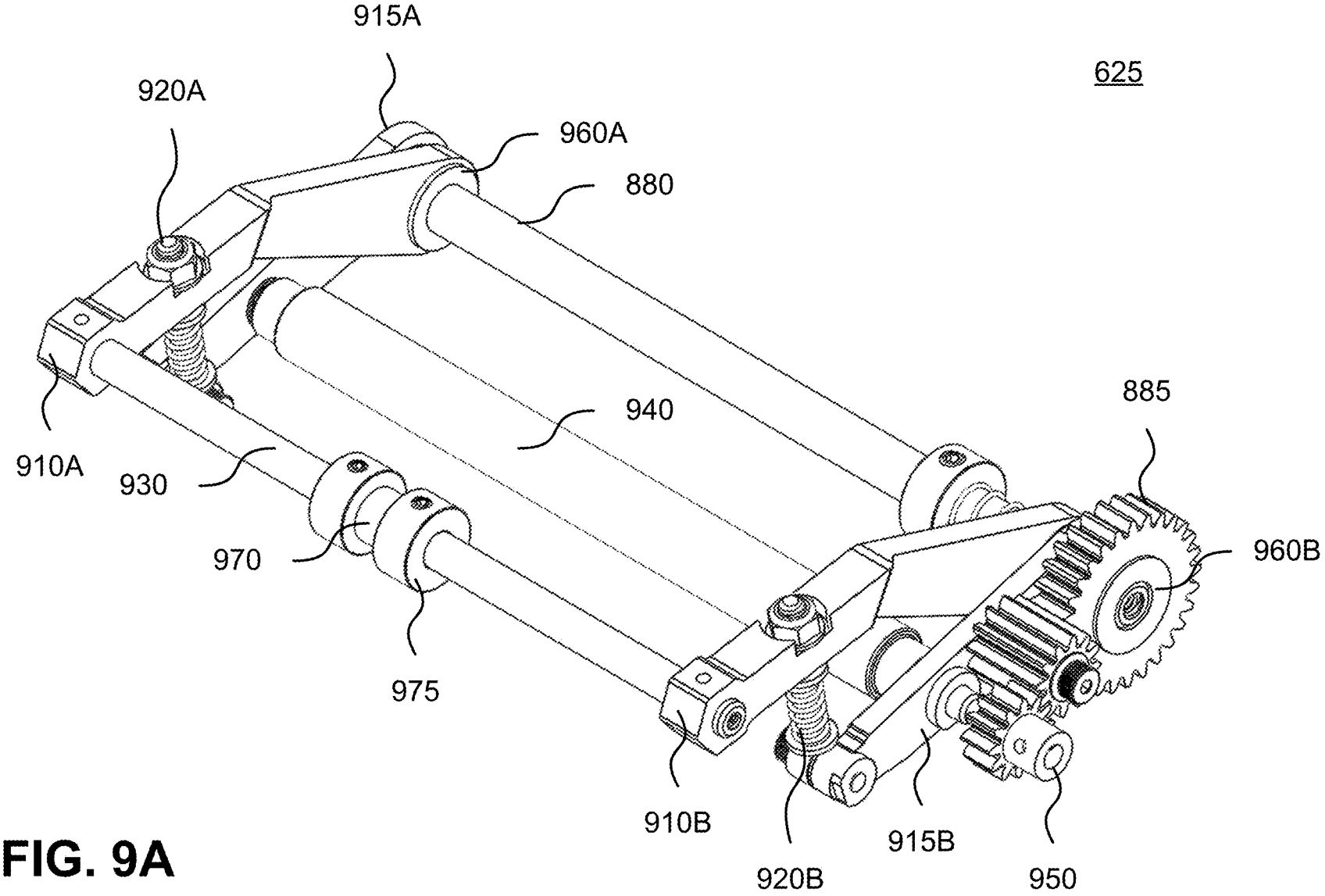
FIGS. 9A and 9B show perspective views of a roller assembly, according to one embodiment.
Figure 9B:
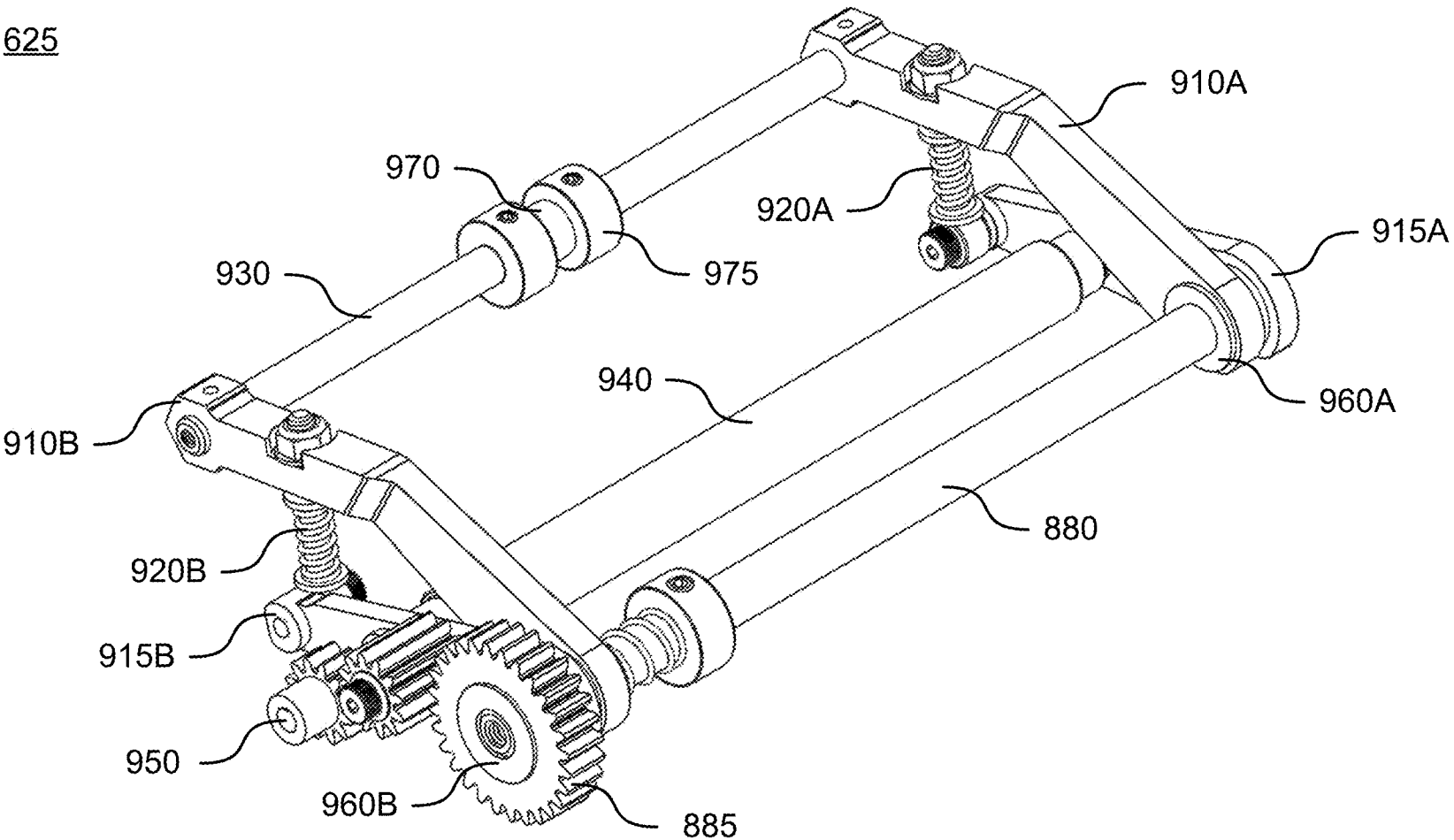

FIGS. 9A and 9B show perspective views of a roller assembly 625, according to one embodiment. The roller assemblies 625 are attached to the cage 620 and are configured to compress a tubing of the consumable 670. Although the embodiments below are described using rollers, other embodiments may use structures that do not roll (e.g., structures that slide along the tubing instead of rolling).

The roller assembly 625 includes a front arm 910A, a back arm 910B, a front lever 915A, a back lever 915B, a front suspension 920A, a back suspension 920B, a connecting bar 930, a roller 940, and one or more gears 950. In some embodiments, the roller assembly 625 further includes one or more bearings or bushings 960 to allow the front and back arms 910, and the front and back levers 915 to rotate. Moreover, in some embodiments, the roller assembly 625 further includes one or more bearings or bushings 970 mounted on the connecting bar 930 to reduce friction between the connecting bar 930 and the cam plate 630.

The front arm 910A and the back arm 910B are configured to pivot about the connecting bar 880 of the cage 620. The front arm 910A and the back arm 910B transfer forces from the cam plate 630 into the suspensions 920 to press the roller 940 onto the consumable 670.

The front arm 910A is connected to the back arm 910B by the connecting bar 930. In some embodiments, the connecting bar has a bushing 970 that is configured to interface with the cam plate 630. In some embodiments, the bushing 970 includes shaft collars 975 on either side that are configured to align the cam plate 630 perpendicular to the axis of rotation and prevent the cam plate 630 from moving axially along the connecting bar 930. That is, the shaft collars 975 prevent the cam plate 630 from sliding to the back or the front of the roller assembly 625. In some embodiments, the shaft collar 975 includes a shaft clamp, such as an e-ring.

In some embodiments, the front arm 910A has a bearing or bushing 960A. Similarly, the back arm 910B has a bearing or bushing 960B. The bearings 960 are configured to have a size corresponding to the connecting rods 880 of the cage 620. As such, the connecting rods 880 of the cage 620 are configured to go through the bearings 960 of a corresponding roller assembly 625, thus, attaching the roller assembly 625 to the cage 620.

The front lever 915A and the back lever 915B are configured to pivot about a connecting rod 880 of the cage 620. The front lever 915A and the back lever 915B transfer forces from the suspensions 920 into the roller 940.

The front lever 915A is connected to the front arm 910A through the front suspension 920A. The back lever 915B is connected to the back arm 910B through the back suspension 920B. The front suspension 920A and the back suspension 920B transfer force from the cam plate 630 to push the roller 940 onto the consumable 670. In some embodiments, the front and back suspensions 920 are spring suspensions. In other embodiments, the front and back suspensions 920 are hydraulic suspensions. In yet other embodiments, the front and back suspensions 920 are pneumatic suspensions. In yet other embodiments, any other suitable type of suspension may be used. In some embodiments, the front and back suspensions 920 have an adjustable preload. As such, the force applied to the roller 940 may be controlled based on the application.

The front and back suspensions 920 provide adjustability in the force applied by the rollers 940. That is, the front and back suspensions 920 allow for the fluid isolation pump to correct for a variation in the thickness of the consumable 670 used. For example, when a thicker tubing is used in the consumable 670, a larger force may be used to provide sufficient fluid isolation. Since a thicker tubing would provide a larger amount of compression of the front and back suspensions 920, the front and back suspensions 920 would provide a larger amount of force to the rollers 940. Moreover, the front and back suspensions 920 allow for the fluid isolation pump to account for variability in the manufacturing of the various components used and misalignment of the various components in the assembled system.

In some embodiments, the front lever 915A is further connected to the front arm 910A through bearing or bushing 960A. In other embodiments, the front lever 915A has a separate bearing or bushing 960 that is configured to be coupled to a corresponding connecting rod 880 of the cage 620. In some embodiments, the bearing or bushing 960A of the front arm 910A and the bearing or bushing 960 of the front lever 915A are coupled to the same connecting rod 880. Similarly, the back lever 915B is further connected to the back arm 910B through bearing or bushing 960B. In other embodiments, the back lever 915B has a separate bearing or bushing 960 that is configured to be coupled to a corresponding connecting rod 880 of the cage 620. In some embodiments, the bearing or bushing 960B of the back arm 910B and the bearing or bushing 960 of the back lever 915B are coupled to the same connecting rod 880.

The roller 940 is configured to provide pressure to the consumable to compress a tubing to isolate a volume of fluid traveling through the tubing of the consumable. In some embodiments, the roller 940 is constructed from metals, such as stainless steel, or plastics, such as polycarbonate. The roller may be solid or hollow. In some embodiments, the roller has a diameter sufficient to prevent the roller from bending during operation. For example, the roller may have a diameter between 0.25 inches and 3 inches.

The roller 940 is attached at a first end to the front lever 915A, and at a second end to the back lever 915B. In one embodiment, the roller 940 is attached to the front and back levers 915 by bearings or bushings. As such, the roller 940 is allowed to rotate with respect to the front and back levers 915. The roller 940 is attached to a gear 950. The gear 950 is then coupled to a corresponding peripheral gear 885 of the cage 620. As such, the angular velocity of the roller 940 is a function of the angular velocity of the peripheral gear 885 of the cage 620. The gear 950 causes the roller 940 to rotate as the roller travels round the consumable, reducing the wear and stress of the tubing, increasing longevity of the consumable. In some embodiments, the rotation of the roller 940 increases consistency of the flow-rate of the fluid isolating pump by reducing tube walking and stretching. In some embodiments, the gear 950 is coupled to the peripheral gear 885 through additional gears. The additional gears may be selected to control the proportionality between the angular velocity of the roller 940 and the peripheral gear 885 of the cage 620. Moreover, the additional gears may reverse the direction of rotation of the gear 950. The additional gears may be attached to the back lever 915B.

The connected combination of components in the roller assembly may reduce the amount of energy used by the fluid isolation pump system. The components used in the roller assembly may significantly reduce the force required to compress the tubing due to mechanical leverage and thus reduce the torque requirements of motor 615.

In some embodiments, an alignment mechanism, such as an alignment spring is used to bias the roller assemblies 625 to one side of the connecting rods 880. The alignment mechanism may provide a force that presses the roller assembly onto the back plate 840 of the cage 620. The alignment mechanism may improve the coupling between the various gears used. That is, the alignment mechanism improves the coupling between the central gear 645 and the peripheral gear 885, and the coupling between the peripheral gear 885 and the one or more gears 950 of the roller assembly.

In some embodiments, the peripheral gears 885 are part of the roller assemblies 625 instead of the cage 620. That is, each peripheral gear 885 is attached to the back lever 915B of a roller assembly 625. In some embodiments, the peripheral gears 885 are attached to a bearing or bushing 960 of a roller assembly 625.

D. Cam Plate

Figure 10B:
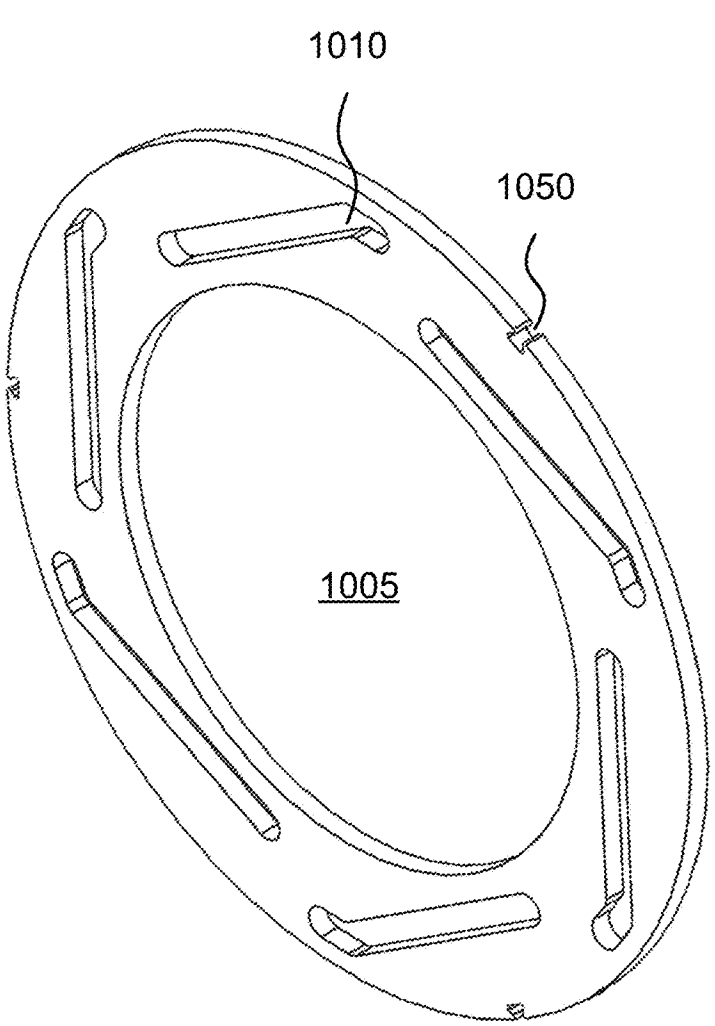
FIG. 10B shows a perspective view of the cam plate, according to one embodiment.
Figure 10A:
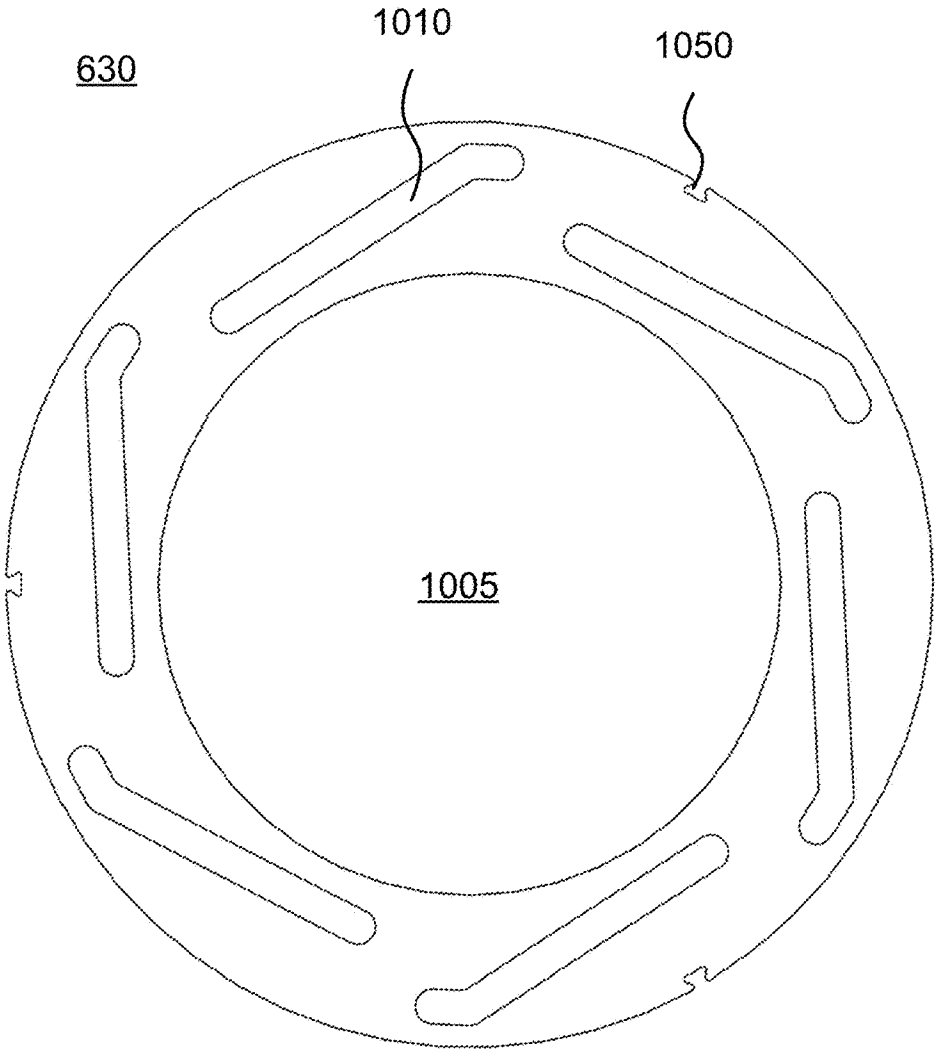
FIG. 10A shows a front view of the cam plate, according to one embodiment.
Figure 10C:
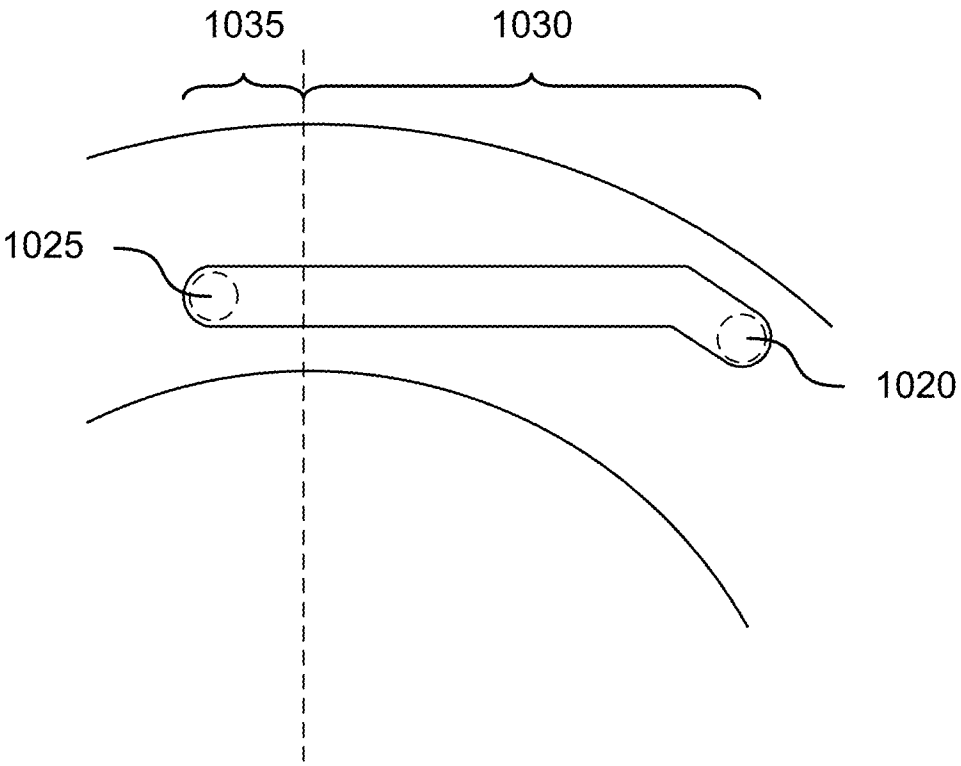
FIG. 10C shows a zoomed in version of the front view of the cam plate illustrating a single opening, according to one embodiment.

FIG. 10A shows a front view of the cam plate 630, according to one embodiment. FIG. 10B shows a perspective view of the cam plate 630, according to one embodiment. FIG. 10C shows a zoomed in version of the front view of the cam plate 630 illustrating a single opening 1010, according to one embodiment. The cam plate 630 interfaces with the roller assemblies 625 to position the roller assemblies 625 in an engaged or a disengaged position. In the disengaged position, the rollers assemblies 625 are positioned such that pressure is not applied to the consumable 670. This position allows for the installation or removal of the consumable 670. In the engaged position, the roller assemblies 625 are positioned such that pressure is being applied to the consumable 670.

In some embodiments, the cam plate 630 is a rigid disk with a hollow center 1005. The cage 620 is then configured to fit in the hollow center of the cam plate 630. The cam plate 630 includes one or more openings 1010 and one or more notches 1050. In some embodiments, a cam brake 635 is used instead of the one or more notches 1050. Each cam opening 1010 has a first side 1020 and a second side 1025. The bushing 970 of each roller assembly 625 is configured to mate with a corresponding cam opening 1010.

The first side 1020 of the cam opening 1010 and the second side 1025 of the cam opening 1010 are stable positions for the bushing 970. When the bushing 970 is in one of those two positions, the bushing 970 is configured to stay in that position until a threshold amount of force is applied to move the bushing 970 from the stable position. In some embodiments, if the bushing 970 is not in one of the stable positions, if a force lower than the threshold amount of force is applied, the bushing 970 slides to one of the two stable positions. In some embodiments, the bushing 970 slides to the first side 1020 of the cam opening 1010 if the bushing 970 is within the first opening region 1030 and a force less than the threshold amount is being applied. That is, when the bushing 970 is in the first side 1020 of the cam opening 1010 (in the disengaged position), the bushing 970 is prevented from moving to the engaged position unless a threshold amount of force is applied. Once the threshold amount of force is applied and the bushing 970 moves from the first side 1020 to second opening region 1035, the bushing 970 would slide over to the second side 1025 of the cam opening transitioning to the engaged configuration. Similarly, the bushing 970 slides to the second side 1025 of the cam opening 1010 if the bushing 970 is within the second opening region 1035 and a force less than the threshold amount is being applied. That is, when the bushing 970 is in the second side 1025 of the cam opening 1010 (in the engaged position), the bushing 970 is prevented from moving to the disengaged position unless a threshold amount of force is applied. Once the threshold amount of force is applied and the bushing 970 moves from the second side 1025 to first opening region 1030, the bushing 970 would slide over to the first side 1020 of the cam opening transitioning to the disengaged configuration.

Figure 10D:
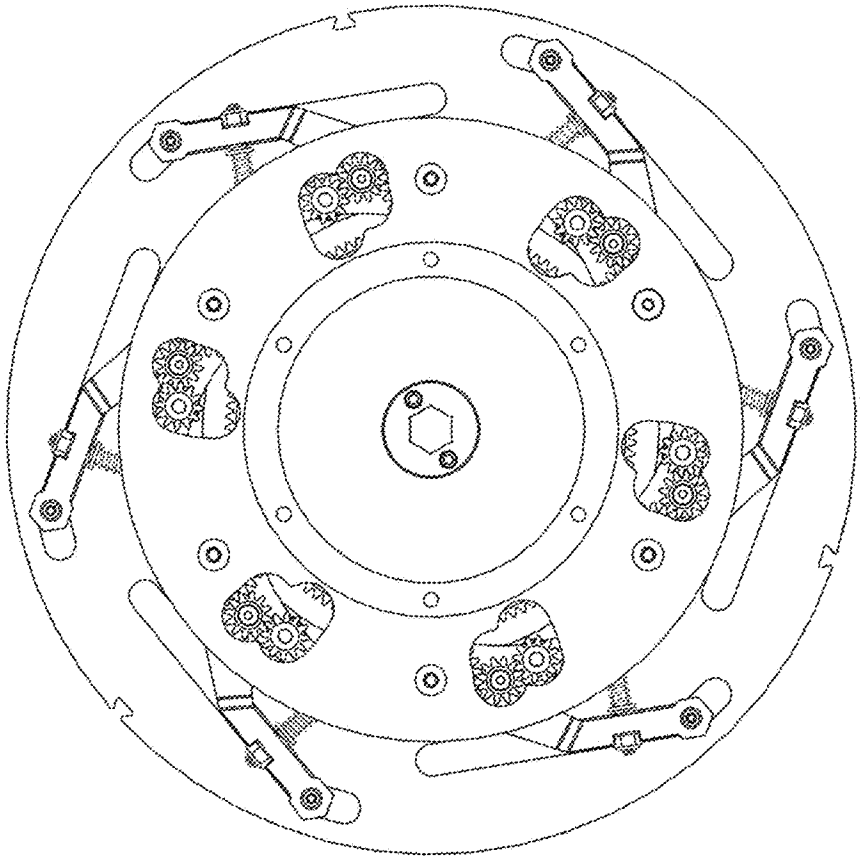
FIG. 10D shows a front and rear view of the cam plate with roller assemblies 625 in the disengaged position, according to one embodiment.
Figure 10D:
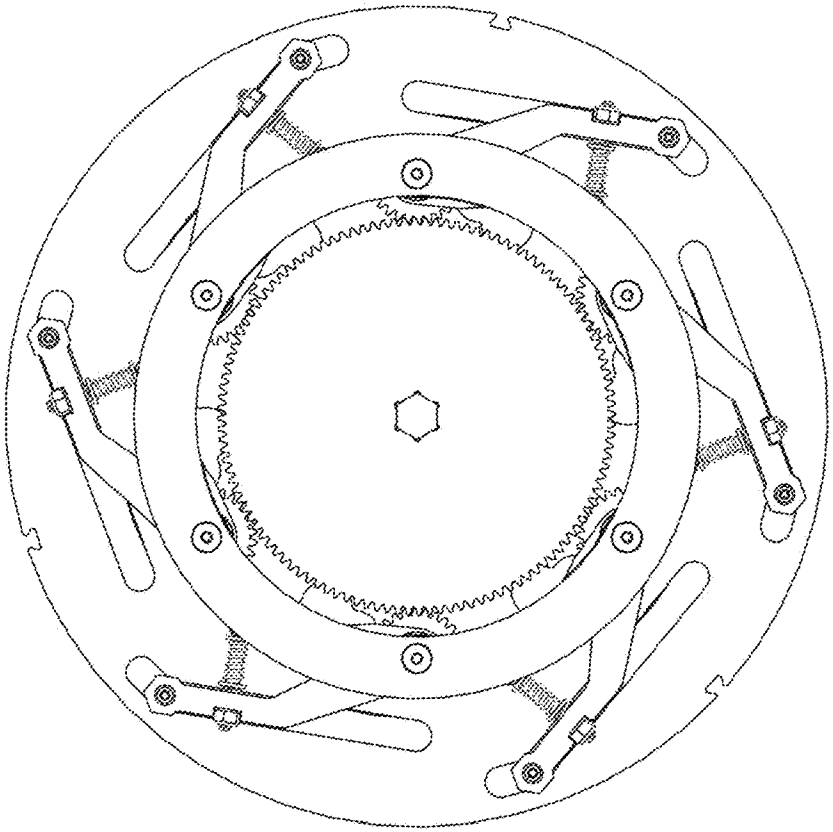
Figure 10E:
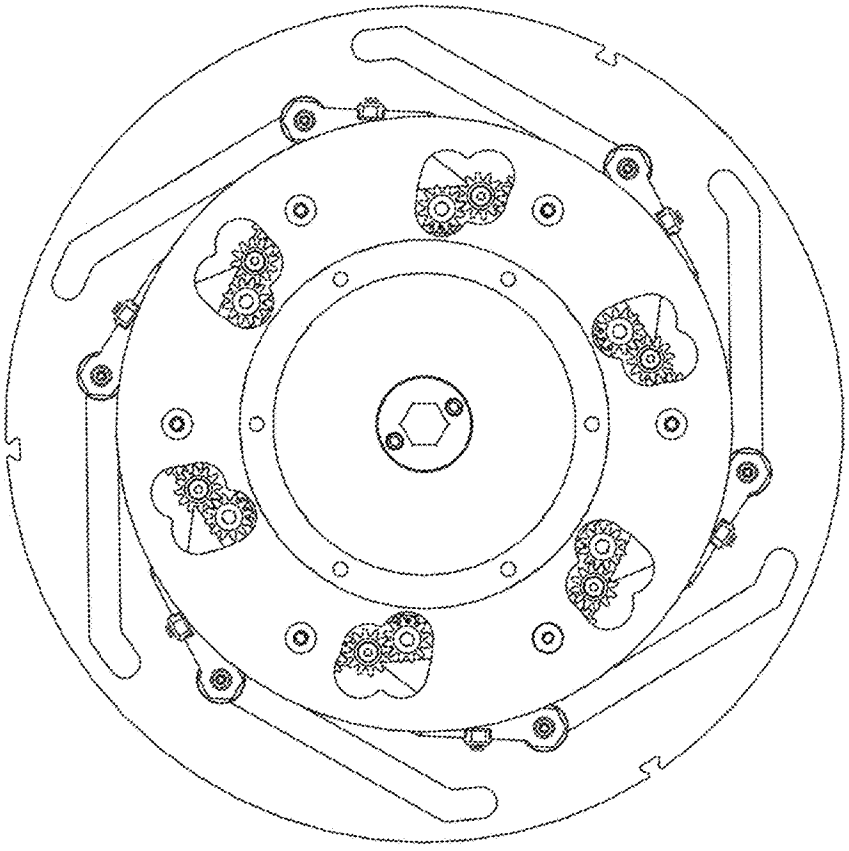
FIG. 10E shows a front and rear view of the cam plate with roller assemblies in the engaged position, according to one embodiment.
Figure 10E:
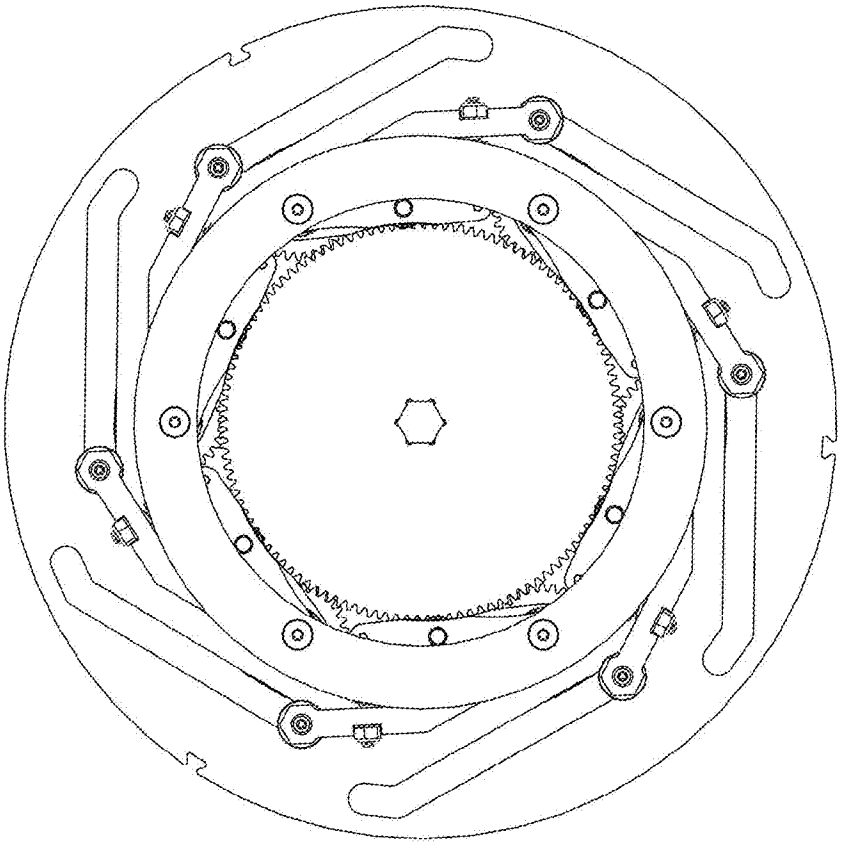
Figure 10G:
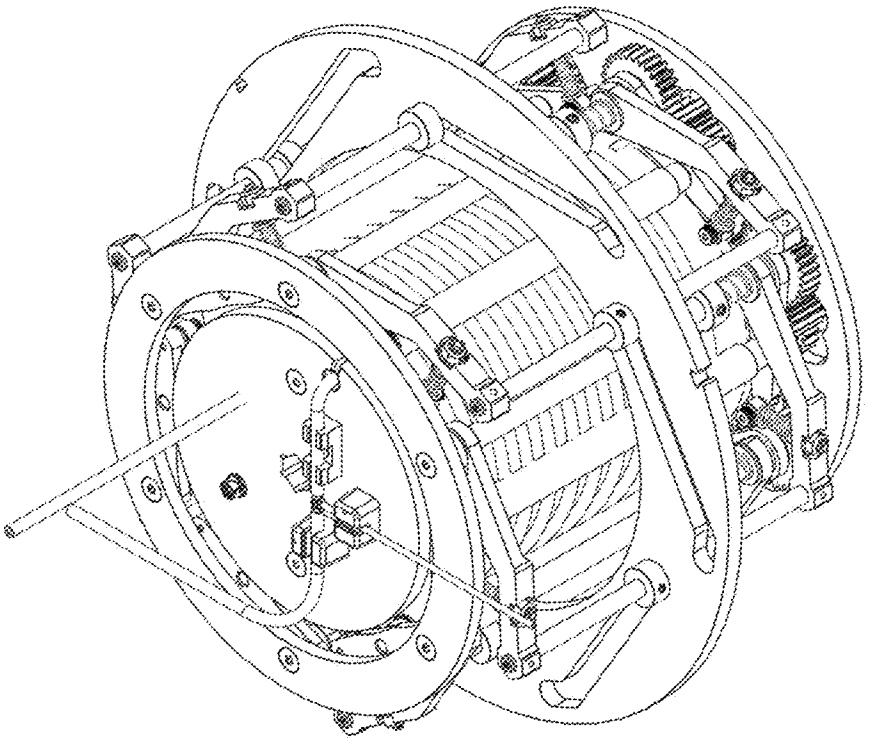
FIG. 10G shows a perspective view of the cam plate with roller assemblies in the engaged position, according to one embodiment.
Figure 10F:
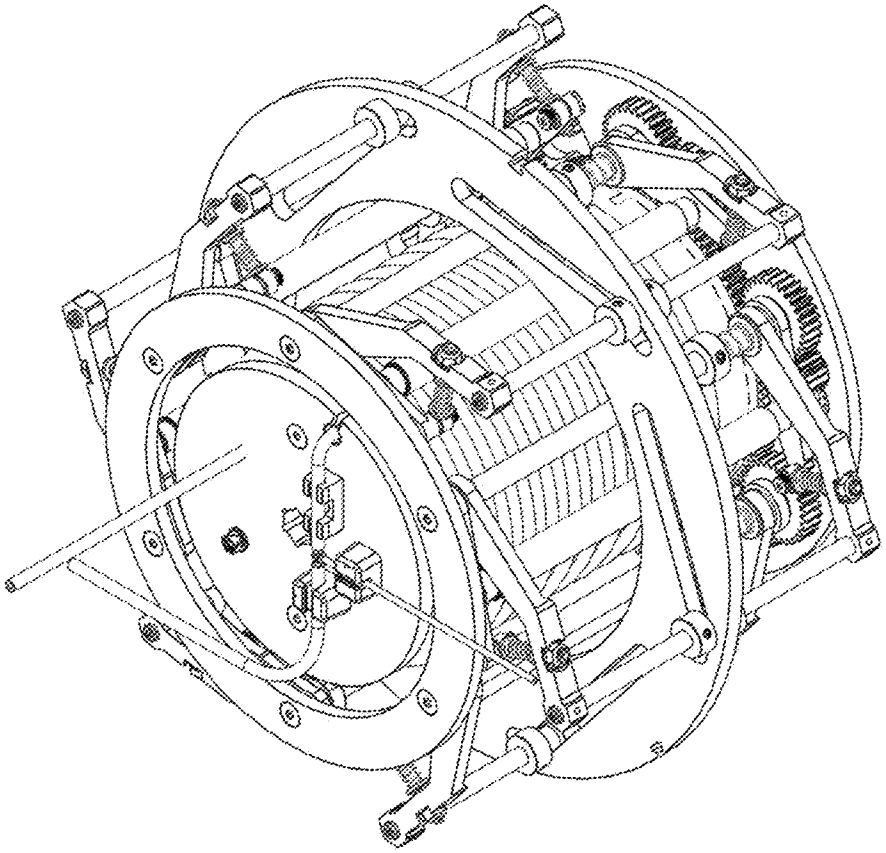
FIG. 10F shows a perspective view of the cam plate with roller assemblies in the disengaged position, according to one embodiment.

FIGS. 10D-G show the operation of the cam plate 630. FIG. 10D shows a front and rear view of the cam plate 630 with roller assemblies 625 in the disengaged position, according to one embodiment. FIG. 10F shows a perspective view of the cam plate 630 with roller assemblies 625 in the disengaged position, according to one embodiment.

In the configuration of FIGS. 10D and 10F, the bushing 970 of each of the roller assemblies 625 are positioned radially within the first side 1020 of the openings 1010. When a bushing 970 of a roller assembly 625 is positioned within the first side 1020 of a corresponding opening 1010 of the cam plate 630, the connecting bar 930 of the roller assembly 625 lifts one end of the front arm 910A and back arm 910B of the roller assembly 625. Since the front and back arms 910 of the roller assembly 625 are held by a connecting rod 880 of the cage 620, the front and back arms 910 of the roller assembly 625 pivot or rotate about the connecting rod 880. As the bushing 970 of the roller assembly 625 is moved towards the first side 1020 of the corresponding opening 1010 of the cam plate 630, the front and back arms 910 move radially outwards to disengage the rollers 940.

At this position, the gap between the location on the front and back arms 910 where the suspensions 920 are attached and the consumable is larger than the height of the suspensions 920. As such, the suspensions 920 raise the front and back levers 915, raising the roller 940. As a result, the roller 940 is prevented from applying pressure to the consumable 670.

FIG. 10E shows a front and rear view of the cam plate 630 with roller assemblies 625 in the engaged position, according to one embodiment. FIG. 10G shows a perspective view of the cam plate 630 with roller assemblies 625 in the engaged position, according to one embodiment. In the figures, some of the components have been made translucent to better demonstrate the mechanisms.

In the configuration of FIGS. 10E and 10G, the bushings 970 of each of the roller assemblies 625 are positioned within the second side 1025 of the openings 1010. When a bushing 970 of a roller assembly 625 is positioned within the second side 1025 of a corresponding opening 1010 of the cam plate 630, the connecting bar 930 of the roller assembly 625 lowers one end of the front arm 910A and back arm 910B of the roller assembly 625. Since the front and back arms 910 of the roller assembly 625 is held by a connecting rod 880 of the cage 620, the front and back arms 910 of the roller assembly 625 pivot or rotate about the connecting rod 880. As the bushing 970 of the roller assembly 625 is moved towards the second side 1025 of the corresponding opening 1010 of the cam plate 630, the front and back arms 910 move radially inwards to engage the rollers 940.

At this position, the gap between the location on the front and back arms 910 where the suspensions 920 are attached and the consumable is smaller than the resting height of the suspensions 920. As such, the suspensions 920 are compressed, thus applying pressure to the front and back levers 915. As a result, the roller 940 is pressed against the consumable 670.

Moreover, since the front and back levers 915 of the roller assembly 625 are attached to a corresponding connecting rod 880 of the cage 620, as the front and back levers 915 move from the disengaged position to the engaged position, and from the engaged position to the disengaged position, the gears 950 of the roller assembly 625 stay engaged to the peripheral gears 885. That is, as the front and back levers 915 rotate about the connecting rods 880, since the gears 950 of the roller assembly 625 are also fixed to the front or back levers 915, the gears 950 of the roller assembly 625 rotate together with front and back levers 915. As the peripheral gears 885 are centered with the connecting rods 880, the distance between the peripheral gear 885 and the gears 950 of the roller assembly 625 stay constant.

Notches 1050 are locations where cam plate 630 may be pinned, or captured, to prevent rotation. For example, a pin may be mounted to the rigid base 610 such that the pin would align with one of the notches 1050. When the pin is engaged, the pin locks the cam plate 630 in a specific position. In some embodiments, the cam brake 635 is used instead or in conjunction with the notches 1050 to prevent the cam plate 630 from rotating. When the cam plate 630 is locked and prevented from rotating, if the cage 620 is rotated (e.g., by the motor 615), the rotation of the cage 620 results in the movement of the roller assemblies 625, resulting in the bushing 970 of each of the roller assemblies 625 sliding from one position to a second position of the openings 1010 of the cam plate 630. For example, if the bushing 970 of each of the roller assemblies 625 are in the first side 1020, and the cage 620 is rotated counterclockwise, the bushings 970 of each of the roller assemblies 625 are forced to slide from the first side 1020 of the opening 1010 to the second side 1025 of the opening 1010 of the cam plate 630. Similarly, if the bushings 970 of each of the roller assemblies 625 are in the second side 1025, and the cage 620 is rotated clockwise, the bushings 970 of each of the roller assemblies 625 are forced to slide from the second side 1025 of the opening 1010 to the first side 1020 of the opening 1010 of the cam plate 630.

In some embodiments, the torque of motor 615 is restricted or limited to prevent damage of the cam plate 630 or the roller assemblies 625. For example, if the bushings 970 of each of the roller assemblies 625 are in the first side 1020, and the cage 620 is rotated clockwise, the bushings 970 of each of the roller assemblies 625 are forced against the cam plate 630 while the cam plate 630 is prevented to rotate. Similarly, if the bushings 970 of each of the roller assemblies 625 are in the second side 1025, and the cage 620 is rotated counter-clockwise, the bushings 970 of each of the roller assemblies 625 are forced against the cam plate 630 while the cam plate 630 is prevented to rotate. If excessive torque is applied, this force could cause damage in the cam plate 630 or the roller assemblies 625. That is, in this configuration, the motor 615 (though the cage 620) is applying a torque to the roller assembly in one direction, while the cam plate 630 is applying a torque in the opposite direction. To prevent damaging the cam plate 630 or the roller assemblies 625, the motor may be controlled to stop providing a torque after a threshold amount of resistance is sensed.

E. Central Gear

Figure 11:
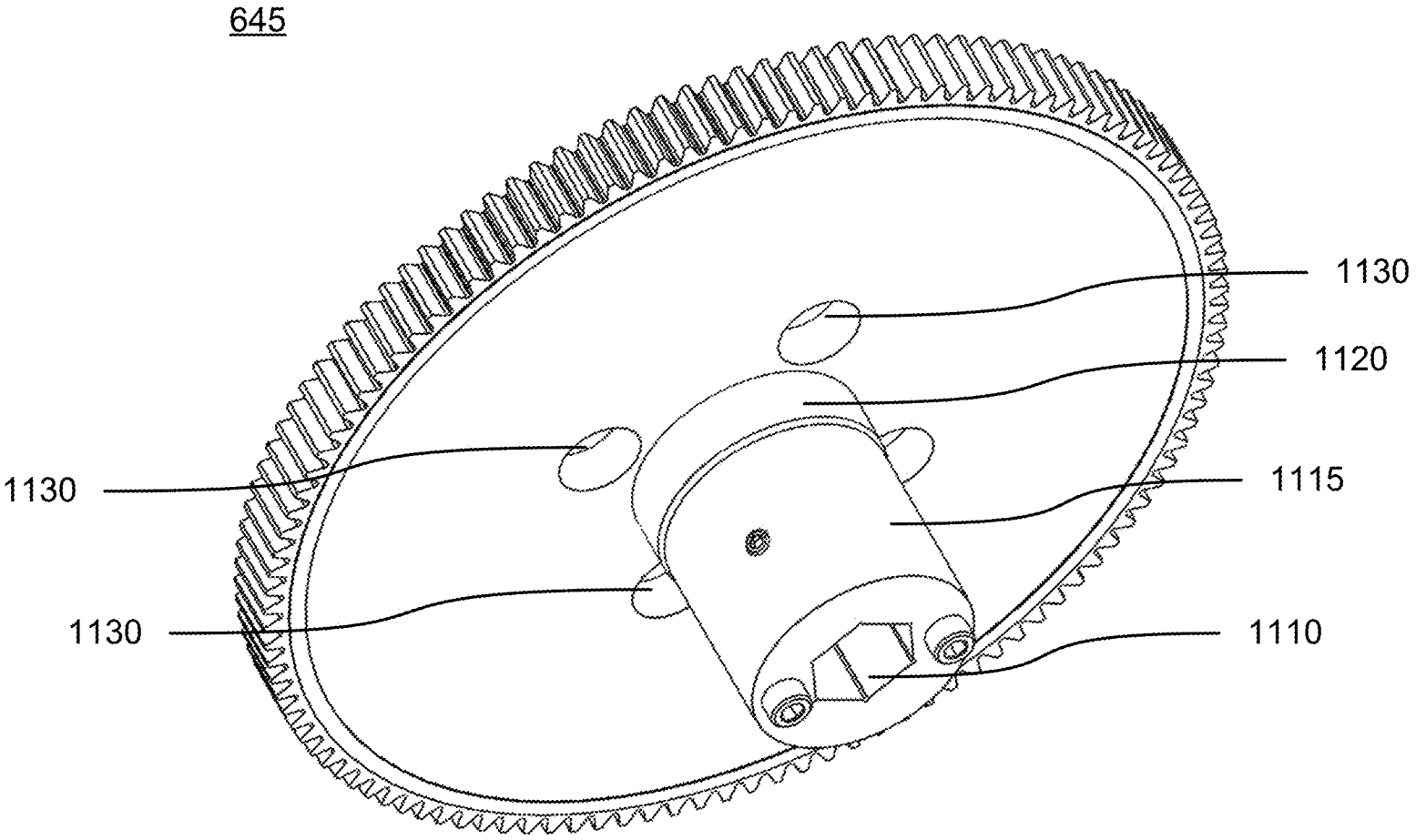
FIG. 11 shows a perspective view of the central gear, according to one embodiment.

FIG. 11 shows a perspective view of the central gear 645, according to one embodiment. The central gear 645 is configured to be mounted on the non-rotating central shaft 640. In some embodiments, the central gear 645 is press-fit onto the non-rotating central shaft 640. The central gear 645 has a central opening 1110 that matches the cross-section of the non-rotating central shaft 640. In some embodiments, the central opening 1110 is part of an anchor block 1115 that is attached to the center of the central gear 645. The central opening 1110 and the anchor block 1115 prevent the central gear 645 from sliding axially and rotating about the non-rotating central shaft 645.

In some embodiments, the central gear 645 further includes a locating boss feature 1120. The locating boss feature is axially aligned with the back plate 840 of the cage 620. In some embodiments, the back opening 845 of the back plate 840 closely matches the size of the locating boss feature 1120. In some embodiments, the locating boss feature 1120 fits inside the back opening 845 of the back plate 840. The locating boss feature may act as a bushing and allows the cage 620 to rotate with respect to the central gear 645.

In some embodiments, the pitch diameter of the central gear 645 matches the diameter of the consumable 670. In some embodiments, the pitch diameter of the central gear 645 matches the diameter of the consumable 670 when the tubing of the consumable 670 is in a compressed state.

In some embodiments, the central gear 645 further includes magnet counterbores 1130. Magnets may then be mounted in the magnet counterbores 1130. The magnets are not shown for simplicity. The magnets may align with magnets in the consumable 670 and provide an attractive force to hold the consumable 670 in place.

F. Consumable

Figure 12A:
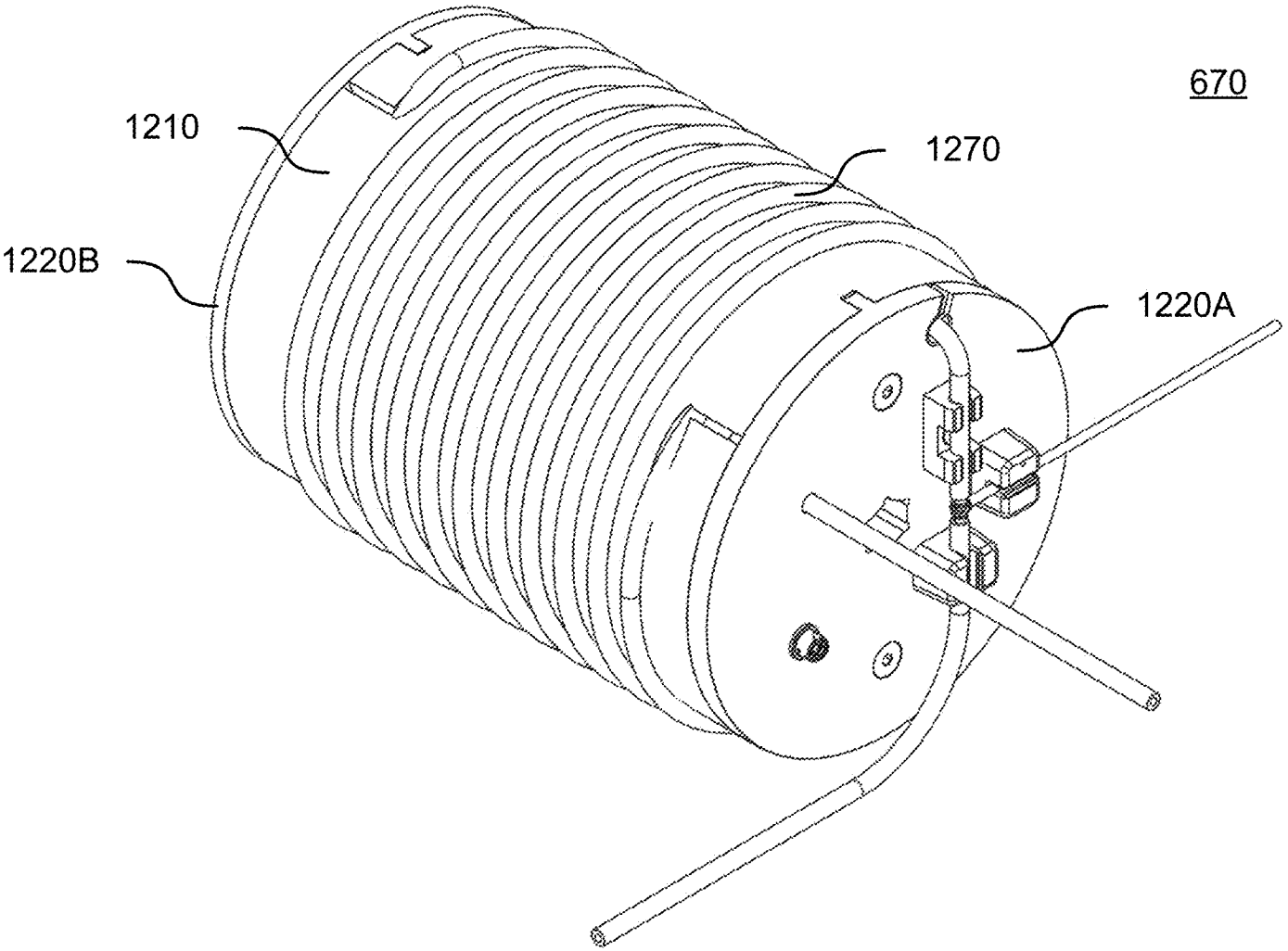
FIGS. 12A and 12B show perspective views of the consumable, according to one embodiment.
Figure 12B:
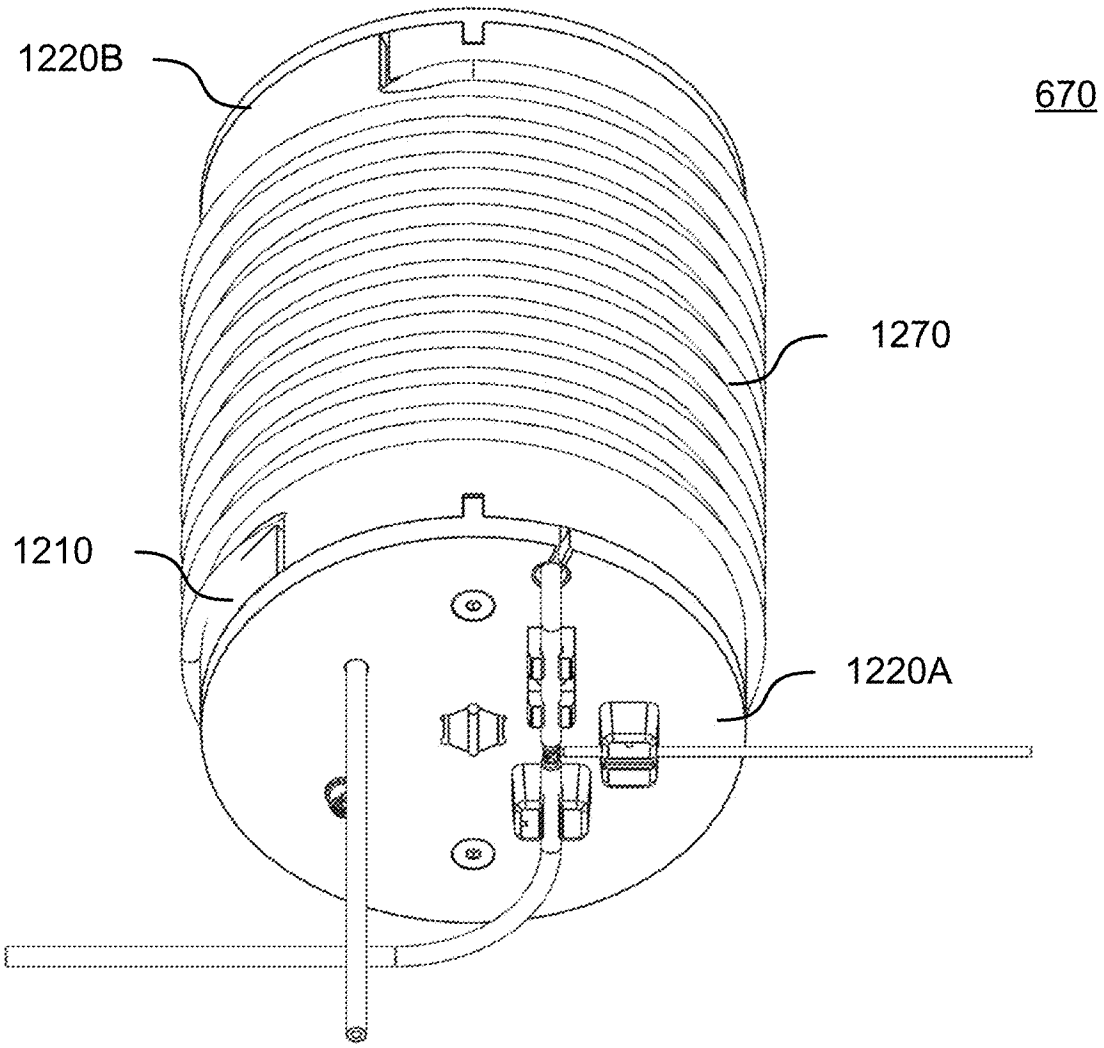
Figure 12C:
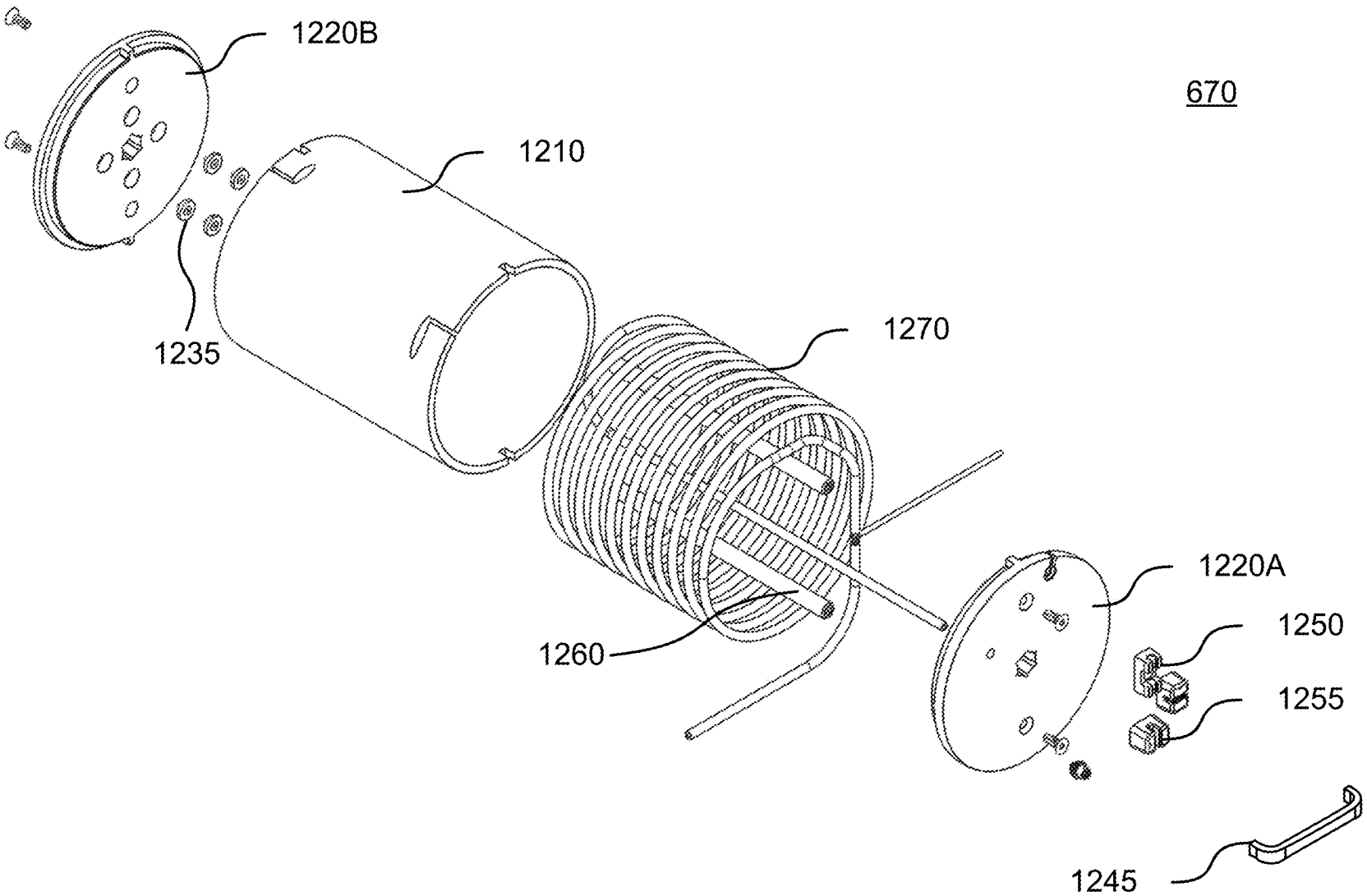
FIG. 12C shows an exploded view of the consumable, according to one embodiment.
Figure 12D:
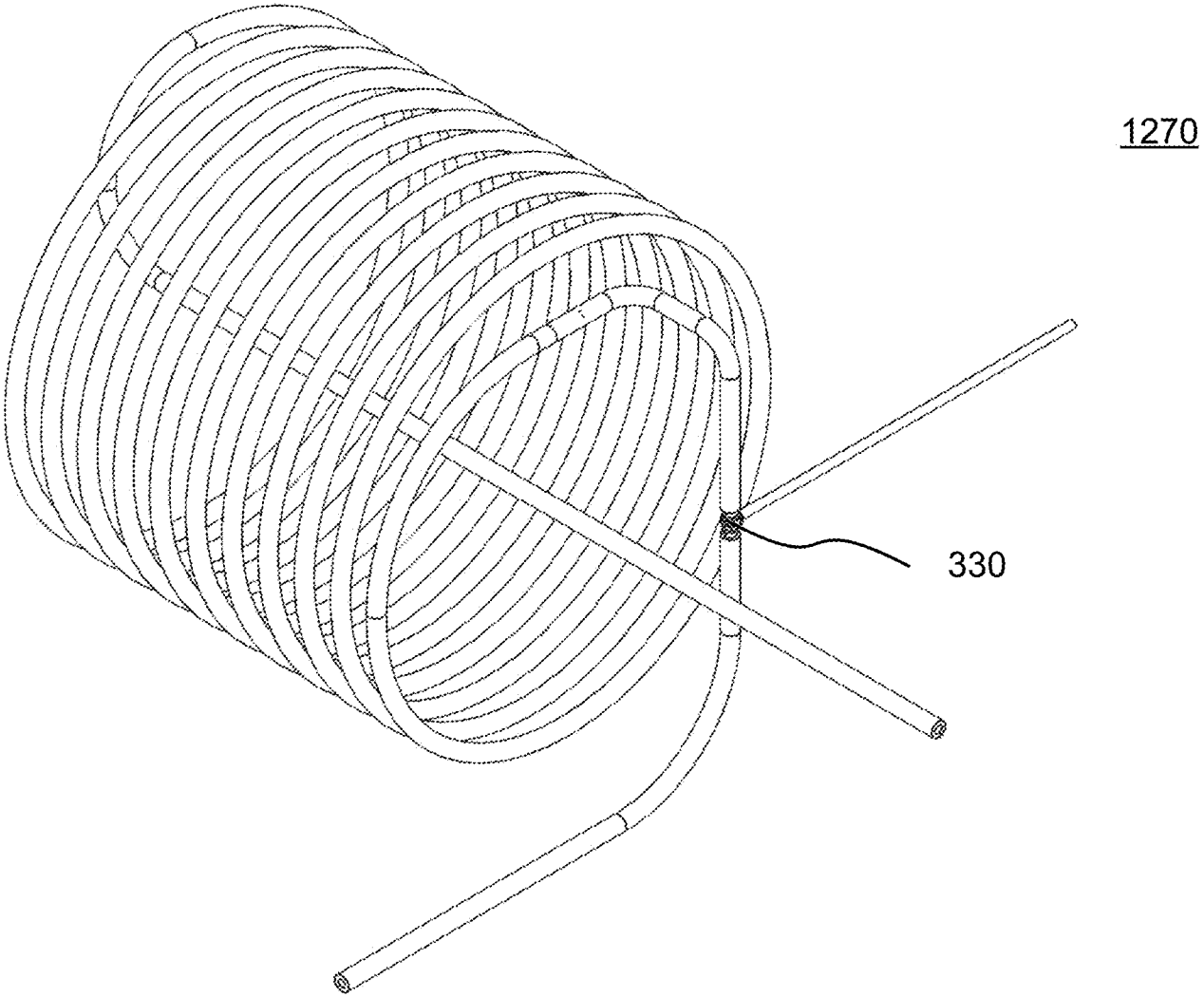
FIG. 12D shows a perspective view of the tubing, according to one embodiment.
Figure 12E:
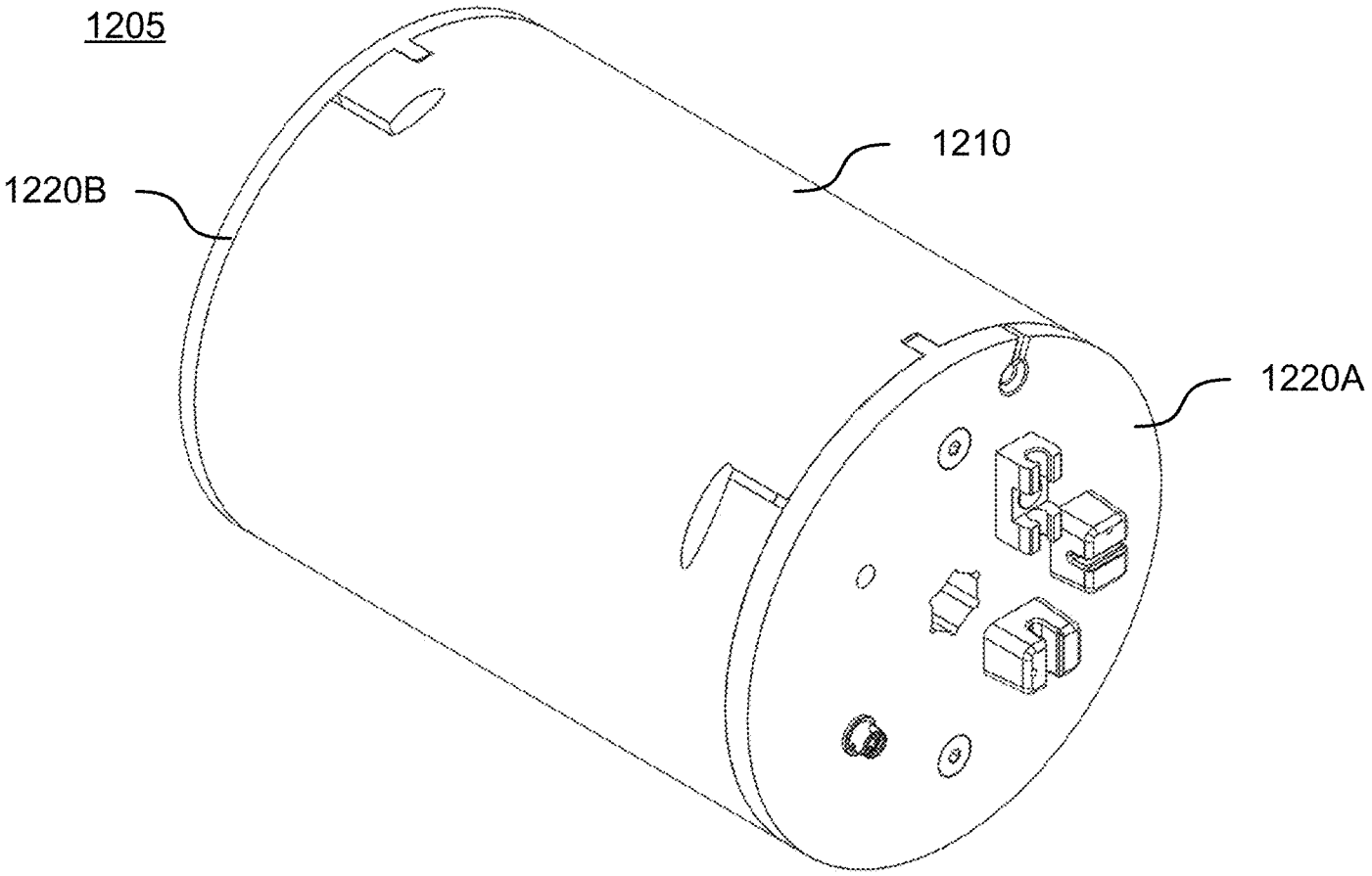
FIG. 12E shows a perspective view of the consumable cartridge, according to one embodiment.

FIGS. 12A and 12B show perspective views of the consumable 670, according to one embodiment. FIG. 12C shows an exploded view of the consumable 670, according to one embodiment. The consumable 670 is configured to be inserted and removed from the roller pump assembly 600. The consumable 670 provides the space to isolate volumes of fluid for a predetermined amount of time. The consumable 670 includes a consumable cartridge 1205 and a tubing 1270. Moreover, the consumable cartridge 1205 includes a rigid tube 1210, a front endcap 1220A, a back endcap 1220B, and support bars 1260 connecting the back endcap 1220B and the front endcap 1220A together, according to one embodiment. FIG. 12D shows a perspective view of the tubing 1270, according to one embodiment. FIG. 12E shows a perspective view of the consumable cartridge 1205, according to one embodiment.

The tubing 1270 provides the space to isolate the volume of fluid. The tubing 1270 wraps around the rigid tube 1210. For instance, the tubing 1270 wraps around the rigid tube 1210 in a helical pattern. The tubing 1270 may be made from PVC, TPE, Tygon, C-Flex, silicone, or other common tubing material that is compatible with peristaltic pumps. The tubing 1270 may have different dimensions depending on the application. In some embodiments, the tubing 1270 may have an inner diameter between 1/16 of an inch and 1 inch, and a wall thickness between 1/16 of an inch and 1/4 of an inch. Moreover, the length of the tubing may vary depending on the desired isolation/incubation time and flow rate of the fluid isolating pump. In some embodiments, the length of the tubing 1270 is increased to increase a flow rate of the fluid isolating pump. In one embodiment, the tubing has a length between 2 ft. and 150 ft.

The tubing 1270 is not parallel to the direction of travel of each roller 940. This is due to the multiple loops used to make a helical structure and the resulting pitch of each loop. Since each loop of the helical tubing 1270 is not parallel to the travel direction of each roller 940, resulting forces are applied to the tubing 1270 which forces tubing 1270 back and forth in the direction of each roller's axis. This is known as tube "walking" or "travel."

As shown in FIG. 12D, the tubing 1270 is may be connected to fluidic junction 330. The fluidic junction allows multiple fluid sources to be combined before entering the tubing 1270. As shown in the diagram of FIG. 3, the fluidic junction 330 may connect a bulk reagent with other lower volume reagents. In some embodiments, the fluidic junction allows the coupling of tubing of different internal diameters. For example, the fluidic junction may connect a first tubing with a first inner diameter for supplying the bulk reagent, and a second tubing with a second inner diameter (e.g., smaller than the first inner diameter) for supplying low volume reagents. In the embodiment of FIG. 12D, a barbed T-fitting reducer is used as the fluidic junction 330, however, other suitable fluidic junctions may be used instead, including but not limited to Luer-style fittings.

In some embodiments, the inlets and outlets of the tubing are sealed or connected to a Luer lock or other type of aseptic connector when the consumable is not in use. Moreover, the inlet and outlets of the tubing may be weldable for use with a sterile tube welder.

Tubing 1270 may be installed onto the cartridge 1205 by means of a coil winding machine to maintain consistency in tube tension and pitch. Tubing 1270 may be sterilized by means of ethylene oxide, gamma irradiation, autoclave or other suitable means.

Figure 12F:
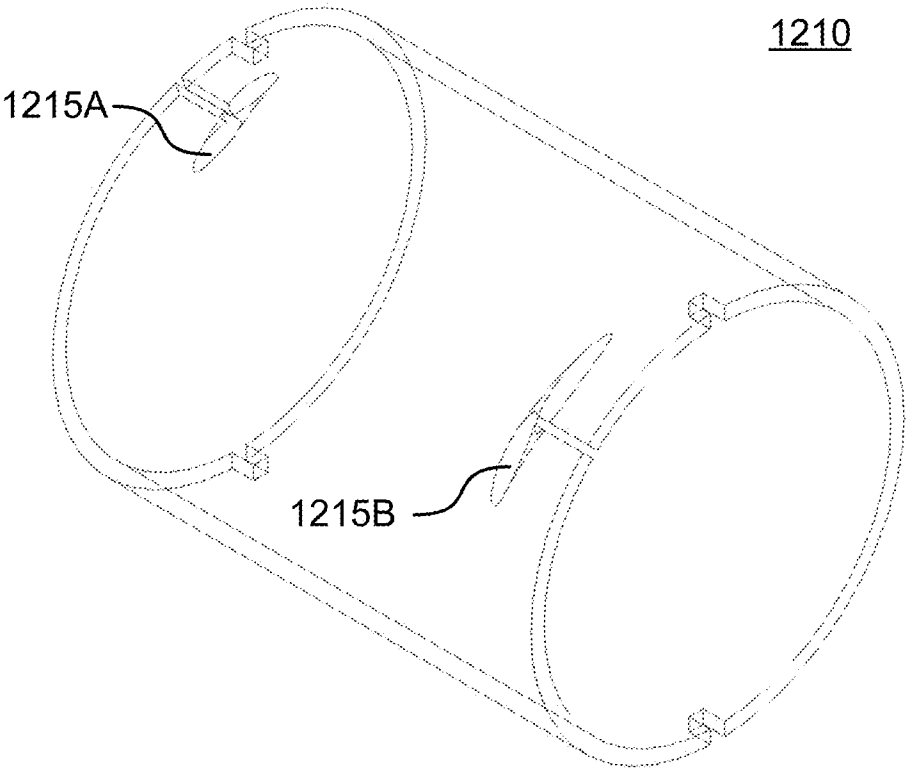
FIG. 12F shows a perspective view of the rigid tube of the consumable cartridge, according to one embodiment.

FIG. 12F shows a perspective view of the rigid tube 1210, according to one embodiment. Rigid tube 1210 provides a minimally-compliable surface for tubing 1270 to be wrapped around. Rigid tube 1210 has sufficient strength to counter the compressive forces of the rollers 940. The rigid tube 1210 is constructed of metals (such as stainless steel), plastics (such as acetal or polycarbonate), ceramics, or any other suitable material. The rigid tube 1210 includes an inlet hole 1215A and an outlet hole 1215B. The inlet and outlet holes 1215 allow the tubing 1270 to pass through them. In some embodiments, the diameter of the inlet and outlet holes 1215 matches the outer diameter of the tubing 1270. The inlet and outlet holes 1215 may additionally aid in preventing the tubing 1270 from sliding due to forces applied to the tubing by the rollers 940 of the roller assemblies 625. In some embodiments, the rigid tube 1210 includes notches to align to the front and back endcaps 1220. The notches prevent the rigid tube 1210 from rotating relative to the endcaps 1220.

In some embodiments, the rigid tube 1210 is made from a single piece. In other embodiments, the rigid tube 1210 is made from multiple pieces that may rotate independently of each other. The multiple pieces may be used to aid in the tensioning of the tubing 1270. A consumable 670 having a rigid tube 1210 made from multiple sections is described hereinbelow in conjunction with FIGS. 17A-C.

In some embodiments, the rigid tube 1210 allows the transfer of heat to or from the liquid contained inside the tubing 1270. That is, the rigid tube 1210 may be a heat exchanger having a controllable temperature. The temperature of the rigid tube 1210 may be controlled using a thermal element that is activated based on signals received from the fluid isolating pump 350. In some embodiments, the thermal element includes a heating element. For instance, the rigid tube 1210 may include resistive filaments or Peltier devices that are able to heat up when electrical current is applied. Moreover, the temperature of the rigid tube 1210 may additionally be controller by a cooling element that is activated based on signals received from the fluid isolating pump 350. In some embodiments, the rigid tube 1210 further includes sensors to control the temperature of the rigid tube 1210 or the fluid contained within the tubing 1270.

The front and back endcaps 1220 fit into respective ends of the rigid tube 1210. The endcaps 1220 provide additional rigidity to the consumable 670. In some embodiments, the front endcap 1220A includes a handle 1245 to ease the installation and removal of the consumable 670. The end caps 1220 may be constructed of metals (such as stainless steel), plastics (such as acetal or polycarbonate), or any other suitable material.

The endcaps 1220 may have a central mounting hole 1225 that matches the cross-section of the non-rotating central shaft 640. As such, the endcaps allow the consumable 670 to be mounted onto the non-rotating central shaft 640, while preventing the consumable 670 from rotating about the non-rotating central shaft 640.

Figure 12G:
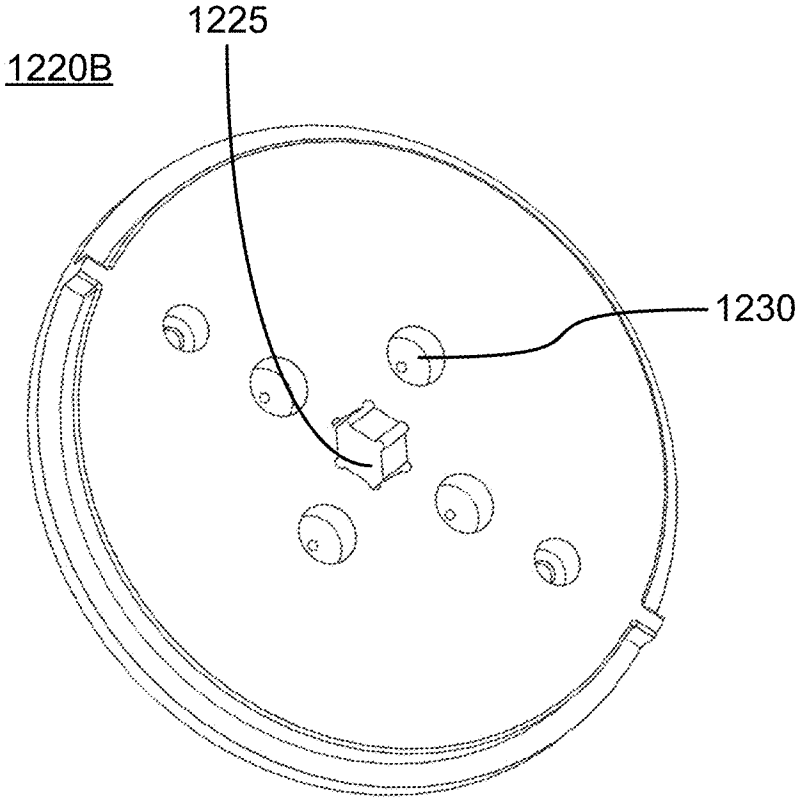
FIG. 12G shows a perspective view of the back endcap, according to one embodiment.

FIG. 12G shows a perspective view of the back endcap 1220B, according to one embodiment. The back endcap 1220B may include magnet counterbores 1230. The position of the magnet counterbores 1230 of the consumable 670 match the position of the magnet counterbores 1130 of the central gear 645. Magnets 1235 may then be mounted in the magnet counterbores 1230.

Figure 12H:
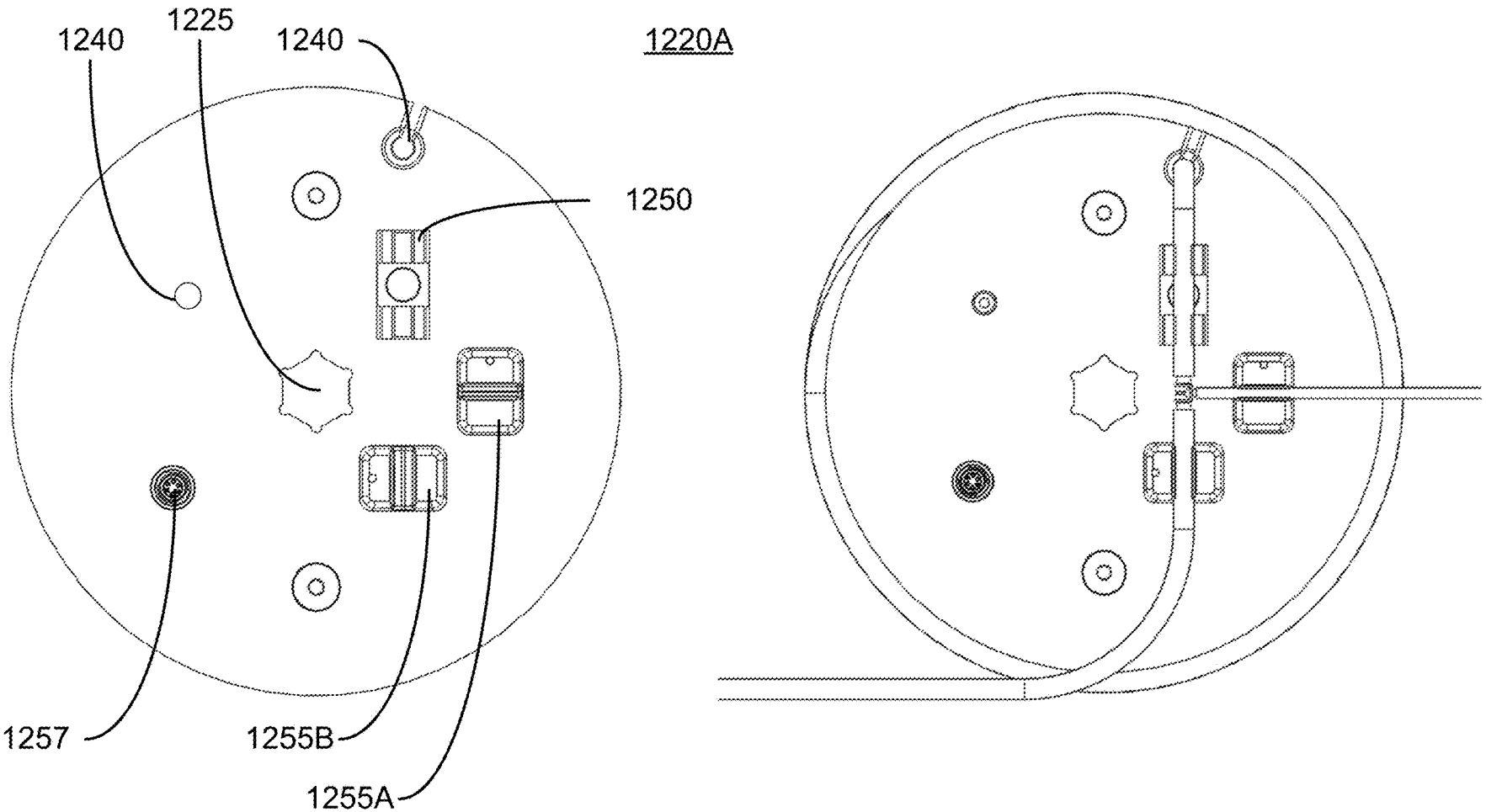
FIG. 12H shows a front view of the front endcap, according to one embodiment.

FIG. 12H shows a front view of the front endcap 1220A, according to one embodiment. The front endcap 1220A may include openings 1240 to allow the tubing 1270 from entering and exiting. That is, the openings 1240 of the front endcap 1220A allows the tubing to penetrate the front endcap 1220A. As such, the tubing 1270 may be attached to other components of a system, such as fluid sources or reservoirs, through the front side. In some embodiments, the front endcap may include fittings to attach to the tubing 1270 and external tubing. The fittings allow for fluidic coupling between the external tubing and the tubing 1270.

In some embodiments, the front endcap 1220A additionally includes a vibrating tube holder 1250. The vibrating tube holder 1250 holds a section of the tubing 1270. The vibrating tube holder 1250 includes a vibrating motor that causes bubbles trapped in the tubing to progress through the tubing. In some embodiments, the portion of the tubing 1270 that is attached to the vibrating tube holder 1250 is equipped with a static mixer. In this embodiment, the vibrating tube holder 1250 causes bubbles trapped within the tubing 1270 to move through the static mixer to ensure consistent mixing performance of the static mixer.

In some embodiments, the front endcap 1220A additionally includes bubble sensors 1255. For example, in FIG. 12H, the front endcap 1220A includes a first bubble sensor 1255A for detecting bubbles in the inlet tubing that receives the bulk reagent, and a second bubble sensor 1255B for detecting bubbles in the inlet tubing that receives the lower volume reagent. The bubble sensors 1255 detect the presence of liquid in the inlet tubing and is used for priming the tubing. Moreover, the bubble sensors 1255 may be used to detect when a reagent has been depleted.

In some embodiments, the front endcap 1220A includes electrical connectors 1257 for connecting the consumable 670 to external electronic components. Additionally, in some embodiments, the front endcap 1220A includes electrical connectors for connecting the consumable 670 to internal electronics. For example, the electrical connectors may allow internal electronics to receive a signal from a bubble sensor or to provide a signal to a vibrating motor attached to the consumable 670. In another example, the electrical connector may facilitate thermal control to the heating of the isolated fluid as the isolated fluid travels through the tubing 1270.

Figure 12I:
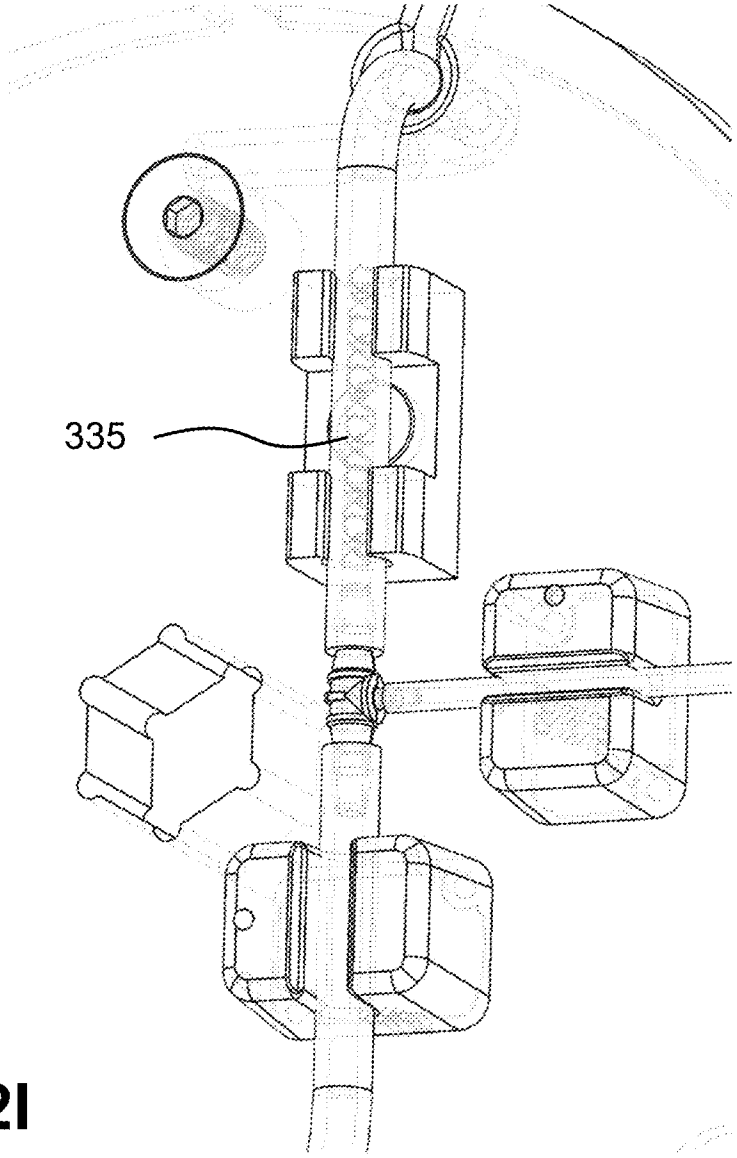
FIG. 12I illustrates a perspective view of the static mixer, according to one embodiment.
Figure 12I:
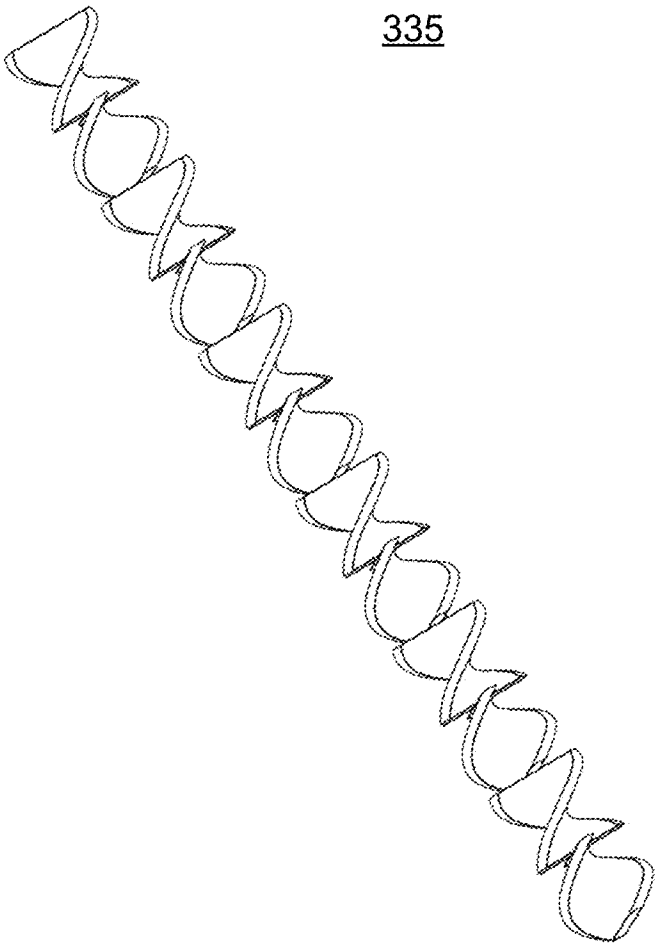

In some embodiments, the consumable 670 includes a static mixer 335. FIG. 12I illustrates a perspective view of the static mixer 335, according to one embodiment. The static mixer is installed within tubing 1270 after the fluidic junction 330. The static mixer aids in mixing the various reagents being provided to the fluid isolating pump.

In some embodiments, the endcaps 1220 may have features for guiding the tubing 1270 and holding the tubing 1270 in place. In addition, the features for guiding the tubing 1270 may introduce slight tension to the tubing 1270 to keep the tubing 1270 from getting loose over time.

In some embodiments, instead of having a replaceable consumable as depicted in FIGS. 12A-C, the fluid isolating pump is configured to receive the tubing 1270 and the fluid isolating pump wraps the tubing 1270 around the rigid tube 1210. As such, the rigid tube, as well as the endcaps 1220 and the components mounted on the end endcaps do not need to be replaced each time the tubing 1270 is to be replaced. Instead, the old tubing 1270 maybe unwrapped from the rigid tube 1210 and the fluid isolating pump 350 is able to load the new tubing 1270 with a predetermined amount of tension.

In some embodiments, to wrap the new tubing 1270 around the rigid tube 1210, the fluid isolating pump 350 rotates the rigid tube at a predetermined angular velocity while the roller assemblies 625 are in the disengaged position. In some embodiments, the rigid tube 1210 extends outwards from the cage 620, protruding towards a user, during the installation of a new tubing 1270. While the rigid tube 1210 is outside of the cage 620, the user is able to install the new tubing 1270 around the rigid tube 1210. Once the new tubing 1270 is installed, the rigid tube 1210 retracts back into the cage 620. Moreover, while the rigid tube 1210 is rotating, one end of the tubing 1270 is kept secured to the rigid tube to provide tension to the tubing to enable the tubing 1270 to be fed into the fluid isolating pump 350 and to be wrapped around the rigid tube 1210. In some embodiments, after the new tubing 1270 has been loaded onto the rigid tube 1210, the ends of the new tubing 1270 are connected to fittings (e.g., a T-fitting) to fluidically couple the new tubing 1270 to other components of the system.

G. Method for Operating Fluid Isolating Pump

Figure 13:
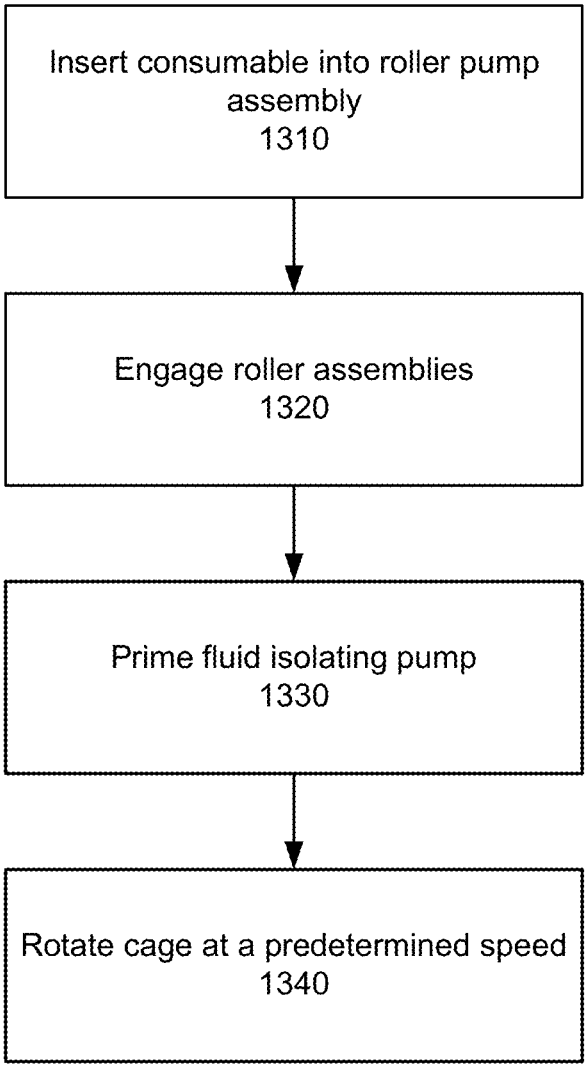
FIG. 13 shows a flow diagram of a process for operating the fluid isolating pump, according to one embodiment.

FIG. 13 shows a flow diagram of a process for operating the fluid isolating pump.

The consumable 670 is inserted 1310 into the roller pump assembly 600. The consumable 670 is mounted on the non-rotating central shaft 640 inside the cage 620. In some embodiments, the consumable 670 is inserted in an orientation such that magnets embedded in the consumable 670 align to magnets embedded in the central gear 645. Moreover, the consumable 670 is inserted in an orientation such that electrical contacts embedded in the consumable 670 align with electrical contacts embedded in the central gear 645. The electrical contacts may provide an interface to operate and communicate with sensors and other electronics embedded in the consumable 670.

Additionally, the consumable 670 is fluidically connected to the input reagents and a collection reservoir. In some embodiments the consumable is connected to external pumps, such as external peristaltic pumps, or to a mixer, such as a static mixer or a dynamic mixer. In other embodiments, the consumable 670 is equipped with onboard peripheral pumps (e.g., syringe pumps, gear pumps, peristaltic pumps, piezo pumps, diaphragm pumps, and the like). In yet other embodiments, the peripheral pumps are installed on the roller pump assembly 600, and the consumable 670 is fluidically coupled to the peripheral pumps when the consumable 670 is installed in the roller pump assembly 600.

In some embodiments, the roller pump assembly 600 communicates with the consumable 670 to identify the properties of the consumable. For example, the consumable 670 may transmit data indicating the tubing thickness, tubing length, tube flow rates, calibration data, manufacturing lot number, expiration date, material data, consumable identification number, and the like. The roller pump assembly 600 may log this information and may modify operating parameters of the system.

The roller assemblies 625 are engaged 1320. To engage the roller assemblies, cam brake 635 is engaged such that the cam plate 630 is prevented from rotating and the motor 615 is rotated until the bushings 970 of the roller assemblies 625 translate from the first side 1020 of the openings 1010 of the cam plate 630 to the second side 1025 of the openings 1010 of the cam plate 630. As the bushings 970 translate to the engaged position, the arms 910 of the roller assemblies 625 are lowered compressing the suspensions 920, thus pressing the rollers 940 onto the tubing 1270 of the consumable 670.

The fluid isolating pump is primed 1330. In some embodiments, the fluid isolating pump is primed with the bulk reagent. For example, pump 315 is operated to pump the bulk reagent into the tubing 1270 of the consumable 670. In some embodiments, the roller pump assembly 600 may be operated at a reduced speed during the priming process. For instance, the motor 615 may be driven at a priming speed to aid the bulk reagent to flow through the tubing 1270 of the consumable 670.

After the fluid isolating pump has been primed with the bulk reagent, the other reagents may also be primed. For instance, the syringe pump 325 may be operated to prime the other reagents used in the process.

In some embodiments, sensors attached to the consumable 670 or the roller pump assembly 600 are used to determine if the priming process has been completed. For example, the consumable may include one or more sensors 1255 that detect the presence of bubbles inside the tubing 1270. When the sensors 1255 determine that the priming process has been completed, the consumable 670 may send a signal to the roller pump assembly 600 to end the priming process. In some embodiments, the signals are sent from the consumable 670 to the roller pump assembly 600 via contacts terminal embedded in the consumable 670 and the central gear 645. In other embodiments, the consumable sends the signals wirelessly (e.g., though a Wi-Fi or Bluetooth signal).

Once the system has been primed, the fluid isolating pump is operated by rotating 1340 the cage 620 at a predetermined speed. The angular velocity of the cage 620 and the length of the tubing 1270 determine the length of time each volume of fluid will be isolated. In some embodiment, sensors such as a mass flow controller (liquid flow sensor), coupled to the consumable 670, or load cells measuring the weight of the bag 310 containing the bulk reagent, are used to determine an amount of reagent being processed. This information may be used by the fluid isolating pump to balance flow rates.

After the processing has been completed, the roller assemblies 625 are disengaged to allow the removal of the consumable 670 from the roller pump assembly 600. To disengage the roller assemblies 625, the cam brake 635 is engaged such that the cam plate 630 is prevented from rotating and the motor 615 is rotated in a reverse direction until the bushings 970 of the roller assemblies 625 translate from the second side 1025 of the openings 1010 of the cam plate 630 to the first side 1020 of the openings 1010 of the cam plate 630. As the bushings 970 translate to the disengaged position, the arms 910 of the roller assemblies 625 are lifted releasing the compression of the suspensions 920, thus, lifting the rollers 940.

Methods to Prevent Tube Walking

Four methods herein may eliminate or mitigate tube walking to the maximum extent practical for continuous and long-term pump use.

The first method to mitigate tube walking involves the installation of tube tensioning mechanisms within the hollow center of the consumable's rigid tube 1210. These tensioning mechanisms may apply tension to the helical tubing 1270 as the tube enters the center of rigid tube 1210 at holes 1215. If tension is applied to both ends of the helical tubing, the forces exerted by the rollers are less likely to cause tube walking.

These tube tensioning mechanisms may be in the form of cams, springs, pneumatics, actuators, or any combination thereof.

Tensioning mechanisms may be pre-loaded during the assembly of each consumable or engaged prior to pump operation.

The second method to mitigate tube walking involves the modification of the geometry of the rigid tube such that the helical tubing (e.g., helical tubing 1270) is reoriented. When reoriented, the majority of the helical tubing remains parallel to the travel direction of each roller. This method ensures that the rollers only apply significant compressive forces to the helical tubing when the helical tubing is parallel to the travel direction of each roller. In this case, the forces applied to the helical tubing are perpendicular to the rollers and result in significantly less tube walking.

Figure 14B:
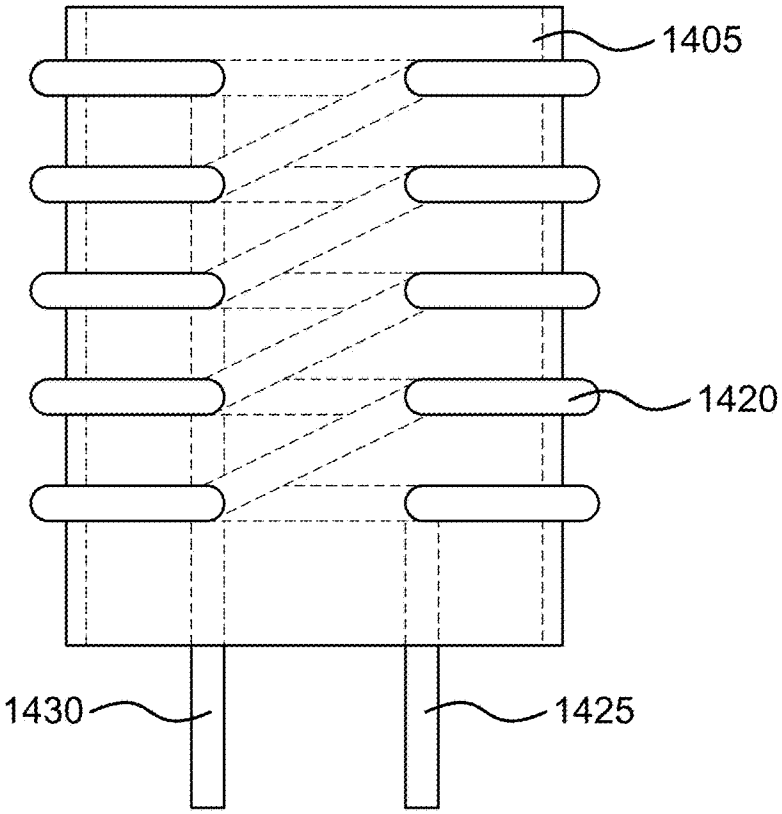
FIG. 14B is a depiction of outlet and inlets of a helical tube, according to one embodiment.
Figure 14A:
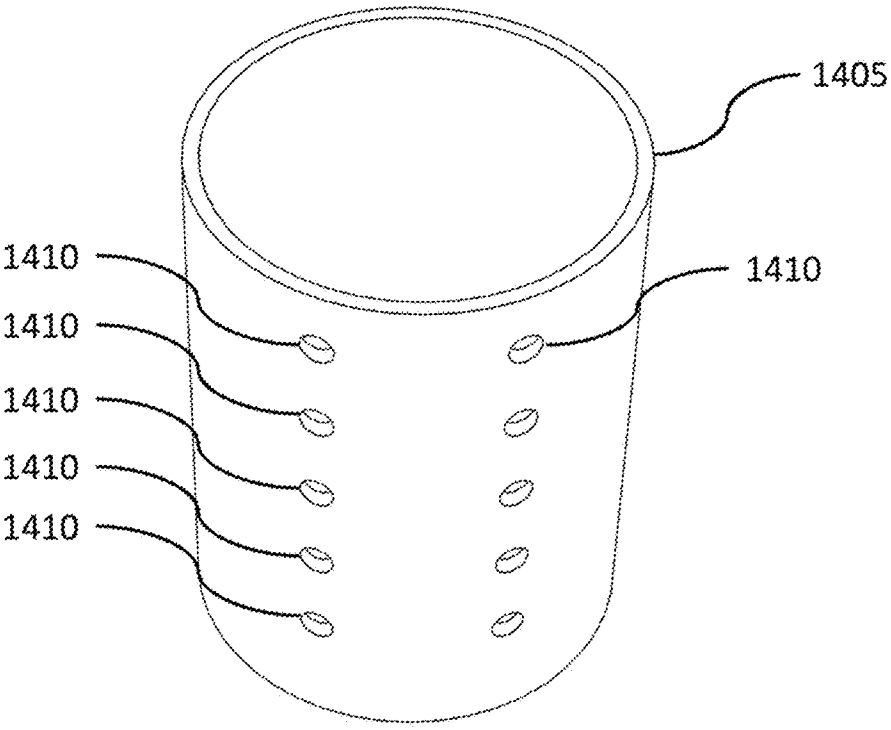
FIG. 14A is a depiction of two rows of holes added to a side of the rigid tube of the consumable cartridge, according to one embodiment.

To achieve this, a series of holes may be added to one side of the rigid tube as shown in FIGS. 14A-D. Two rows of holes 1410 are required as shown in FIG. 14A. These holes are used to briefly divert the helical tubing into the center of the rigid tube 1405. Once in the center of the rigid tube, the helical tubing 'jogs' to the next row of holes before exiting rigid tube 1405. This is repeated until the tubing is installed.

This tube routing method allows the tubing to depart from the geometry of a traditional helix and instead have several sections of tubing parallel to each roller's direction of travel, as shown in FIG. 14B. As shown in FIG. 14B, tubing coil 1420 remains parallel to the direction of travel of each roller on all sections of tubing external to rigid tube 1405. Thereby, the sections of tubing within the rigid tube 1405 are not subjected to compressive forces from the rollers.

In FIG. 14B, items 1425 and 1430 represent the inlet and outlet of the helical tubing. Fluidic chemical and/or biological entities are: (i) loaded into tubing via the inlet; (ii) passed through the tubing for transformative processing (e.g., incubations or pulverization); and (iii) move out of the tubing via the outlet. Note that both the inlet and the outlet are diverted towards the same side of the consumable. This makes loading the fluidic connections easier for the end user.

Figure 14D:
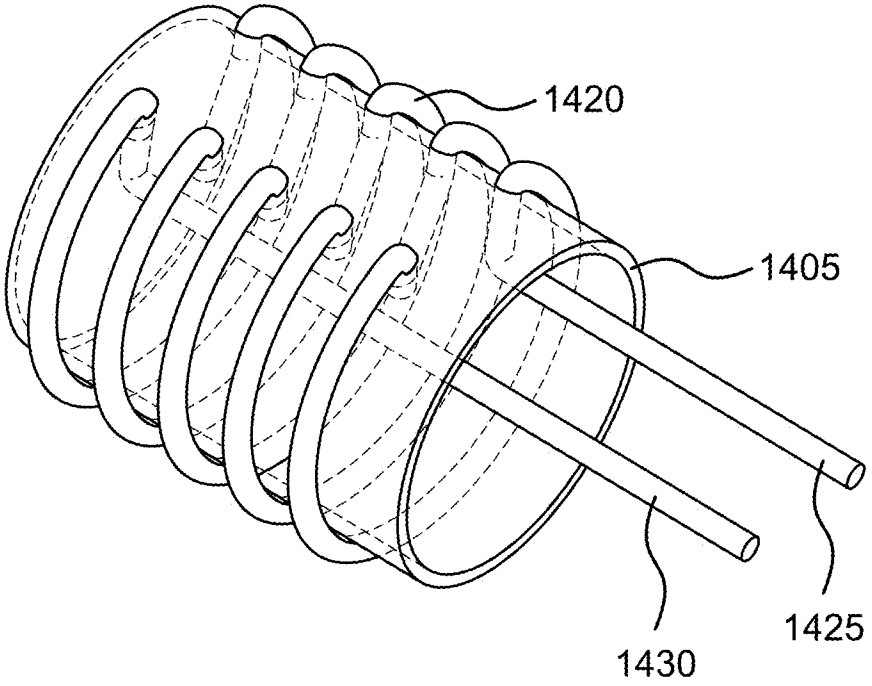
FIG. 14D is a depiction of an isometric view of FIG. 14B, according to one embodiment.
Figure 14C:
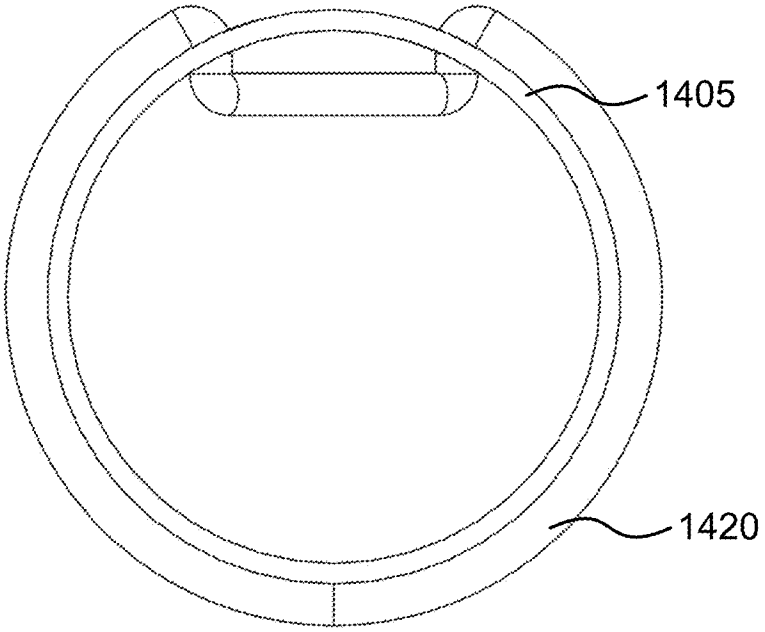
FIG. 14C is a depiction of a front view of FIG. 14B, according to one embodiment.

FIG. 14C is a front-end view of FIG. 14B. FIG. 14D is an isometric view of FIG. 14B for further clarification.

The third method to mitigate tube walking involves the usage of slots instead of holes in the rigid tube. FIG. 15A shows a top view of a rigid tube 1501 with six (6) slots 1502. In other embodiments, a different number of slots may be used. Each slot 1502 is angled from the axis of the rigid tube 1503 by theta degrees. As shown, theta or item 1504 is less than 90 degrees.

Figure 15B:
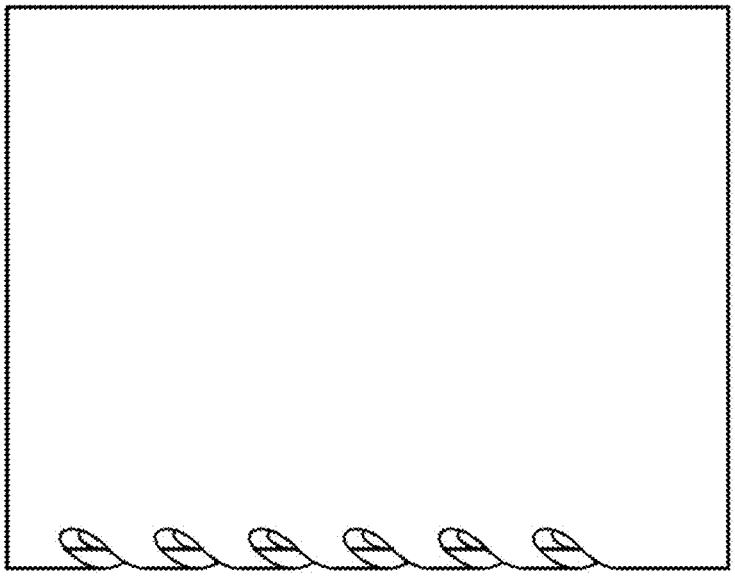
FIG. 15B is a depiction of a side view of FIG. 15A, according to one embodiment.
Figure 15A:
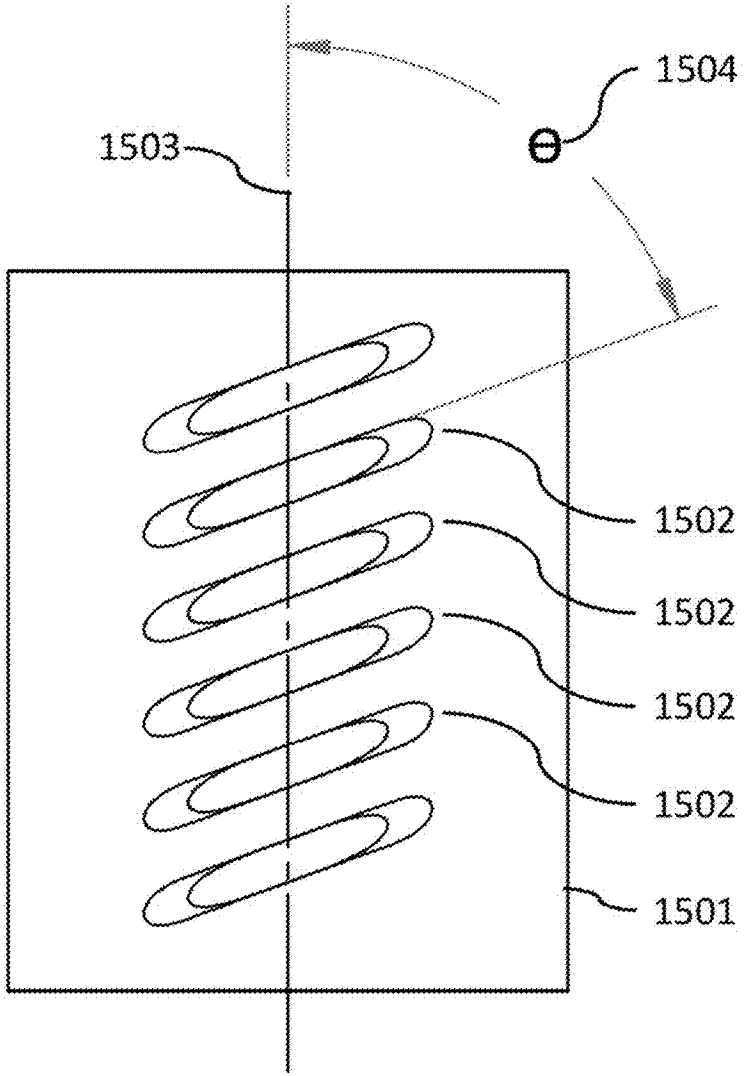
FIG. 15A is a depiction of a top view of the rigid tube of the consumable cartridge with diagonal slots, according to one embodiment.
Figure 15C:
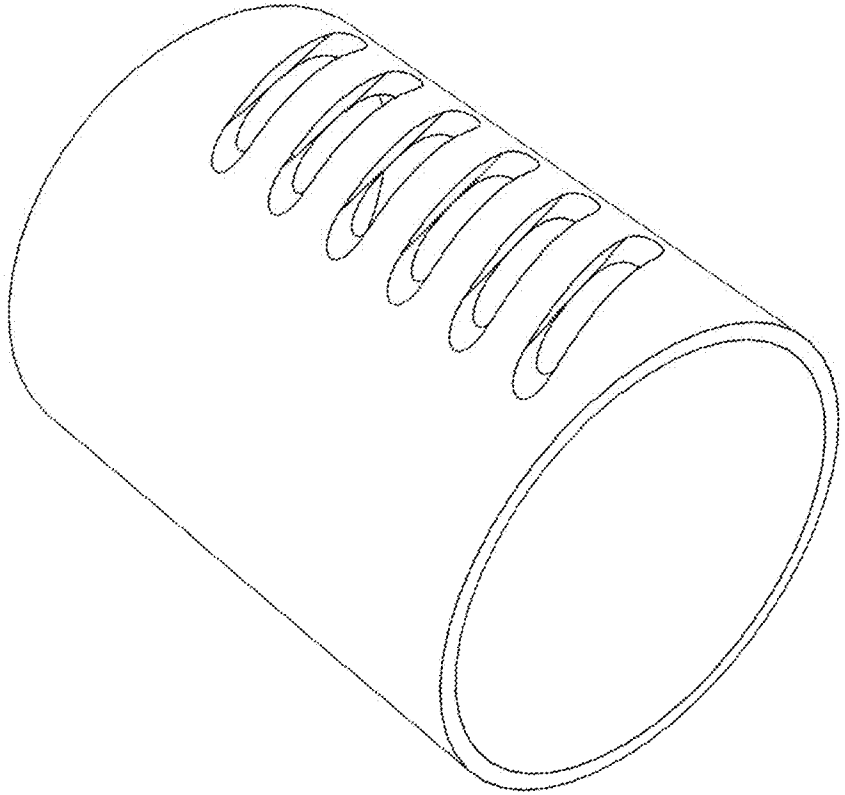
FIG. 15C is a depiction of an isometric view of FIG. 15A, according to one embodiment.

A side view of FIG. 15A may be seen in FIG. 15B. An isometric view of FIG. 15A may be seen in FIG. 15C.

A benefit of this slotted method over the previously discussed method where holes were employed, is that the tubing can be easily assembled by laying the tubing into the slots as opposed to weaving or lacing the tubing through holes.

Figure 16A:
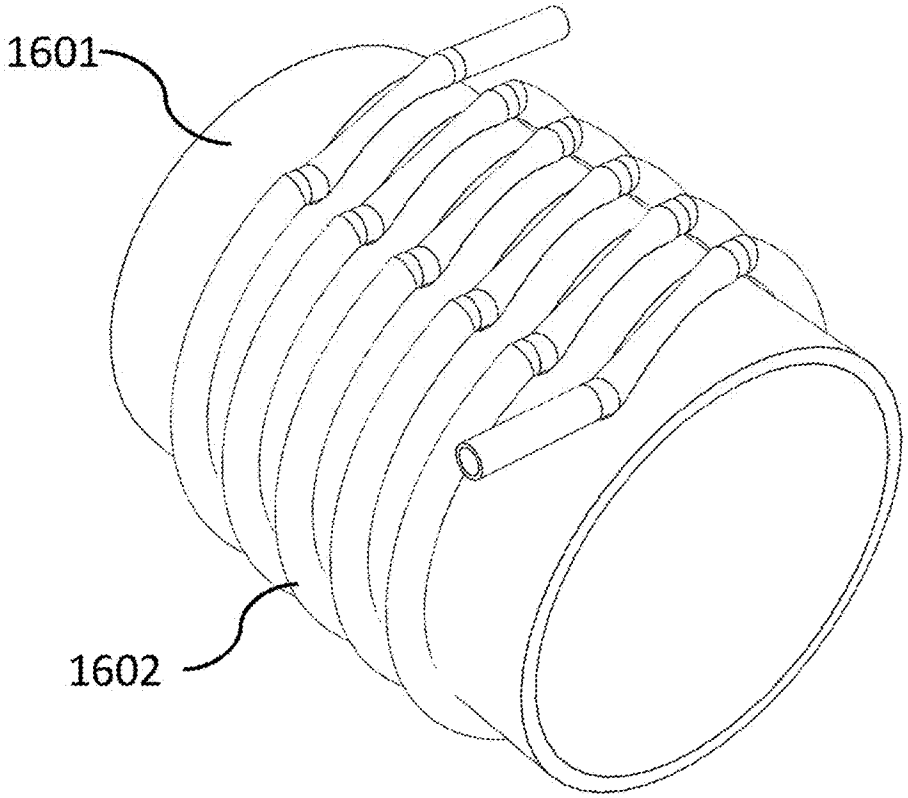
FIG. 16A is a depiction of an assembly view, according to one embodiment.

An assembly view is shown in FIG. 16A. Item 1601 represents the rigid tube. Item 1602 represents the tubing coil. By adding the slots in the rigid tube 1601, the material that opposes the compressive force of the rollers is removed in these areas. Therefore, not only is the tubing slightly recessed, but the rollers are incapable of applying significant forces to the tubing in these areas. This results in the rollers only applying compressive forces to sections of tubing which are parallel to the direction of each roller's travel.

Figure 16B:
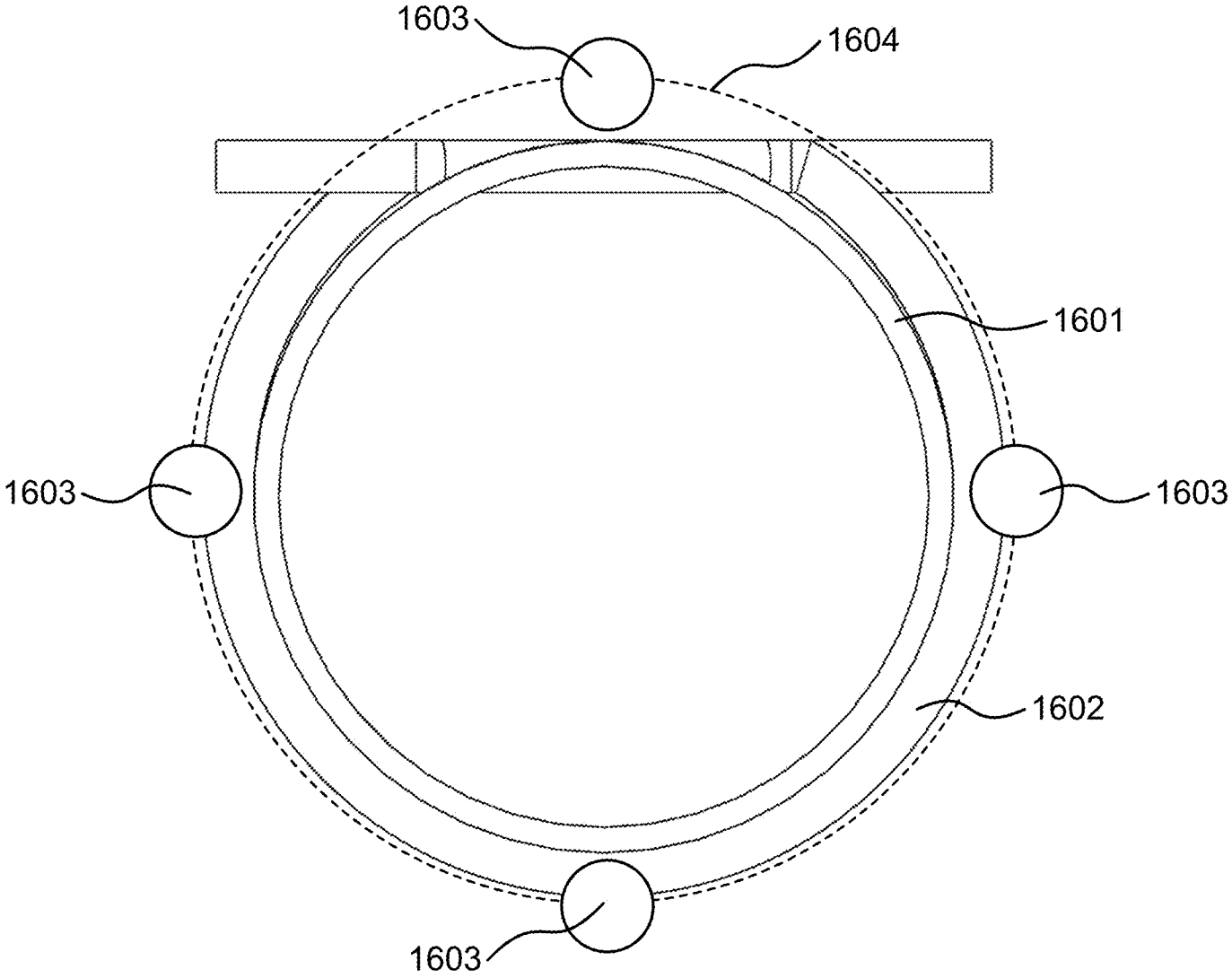
FIG. 16B is a depiction of a front view of FIG. 16A, according to one embodiment.

FIG. 16B is a front-end view of the consumable assembly of FIG. 16A with rollers in the engaged position. Item 1601 represents the rigid tube. Item 1602 represents the tubing. Items 1603 represent engaged rollers at a diameter of 1604. As shown in FIG. 16B, the top roller 1603 is not making contact with tubing 1602, which thus does not apply significant forces to the tubing in the areas where the slots exist.

Figure 17A:
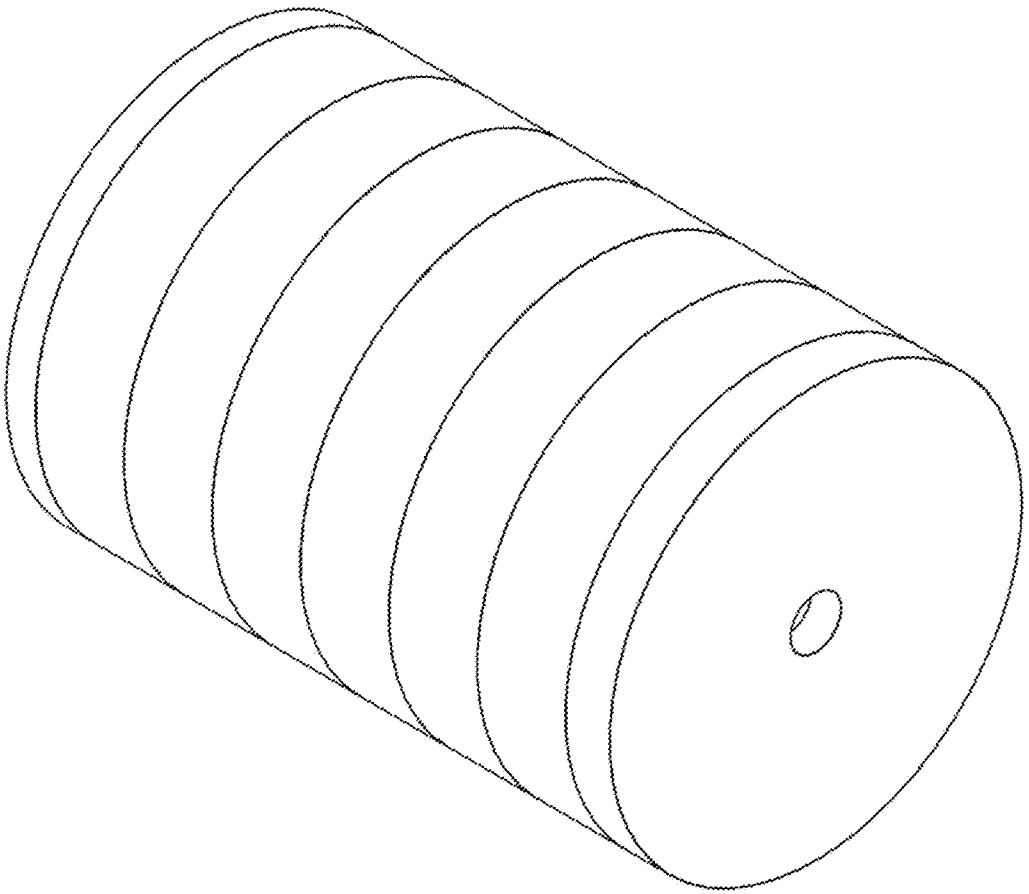
FIG. 17A and FIG. 17B are depictions of a consumable with tube-tensioning features, according to one embodiment.
Figure 17B:
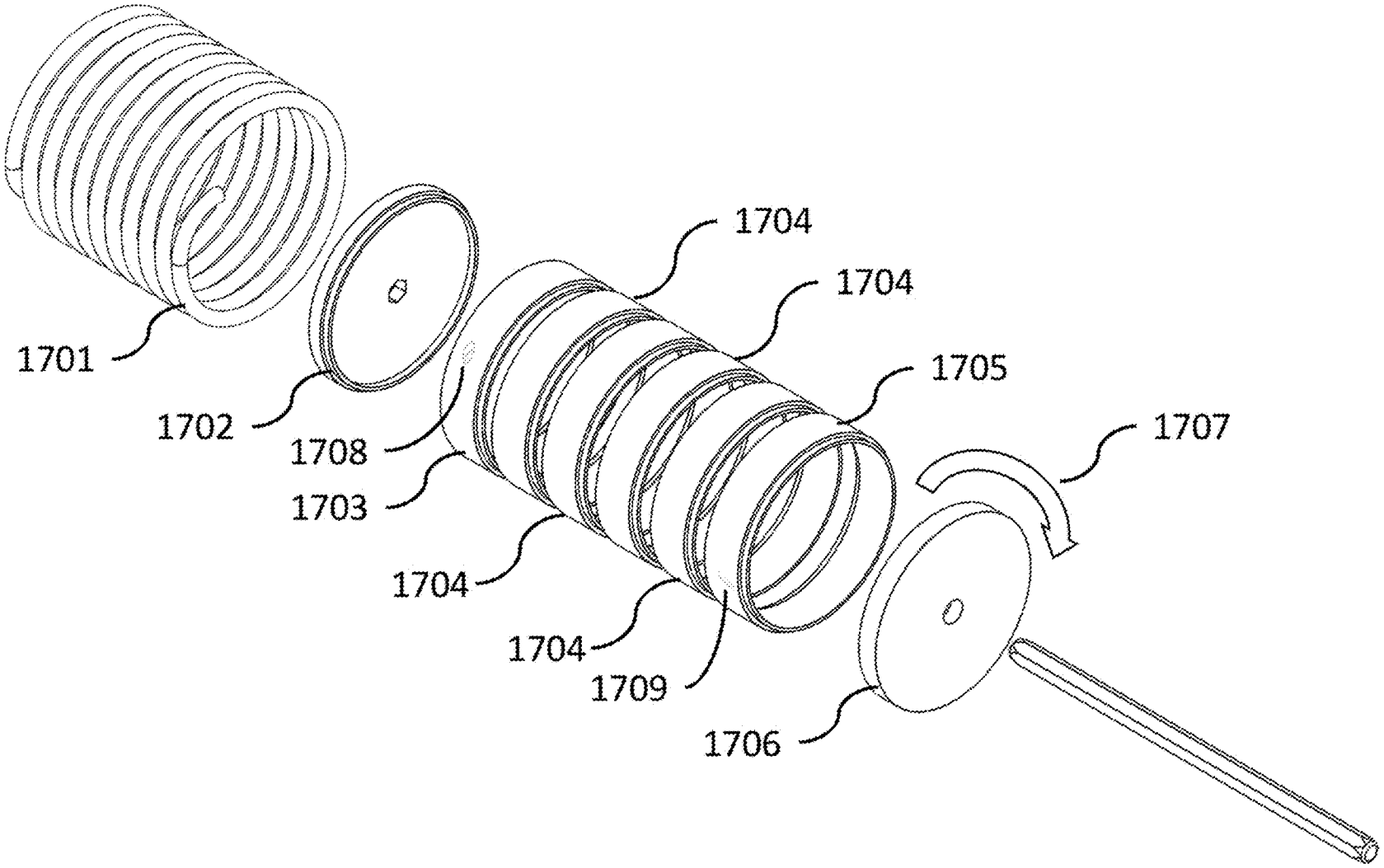
Figure 17C:
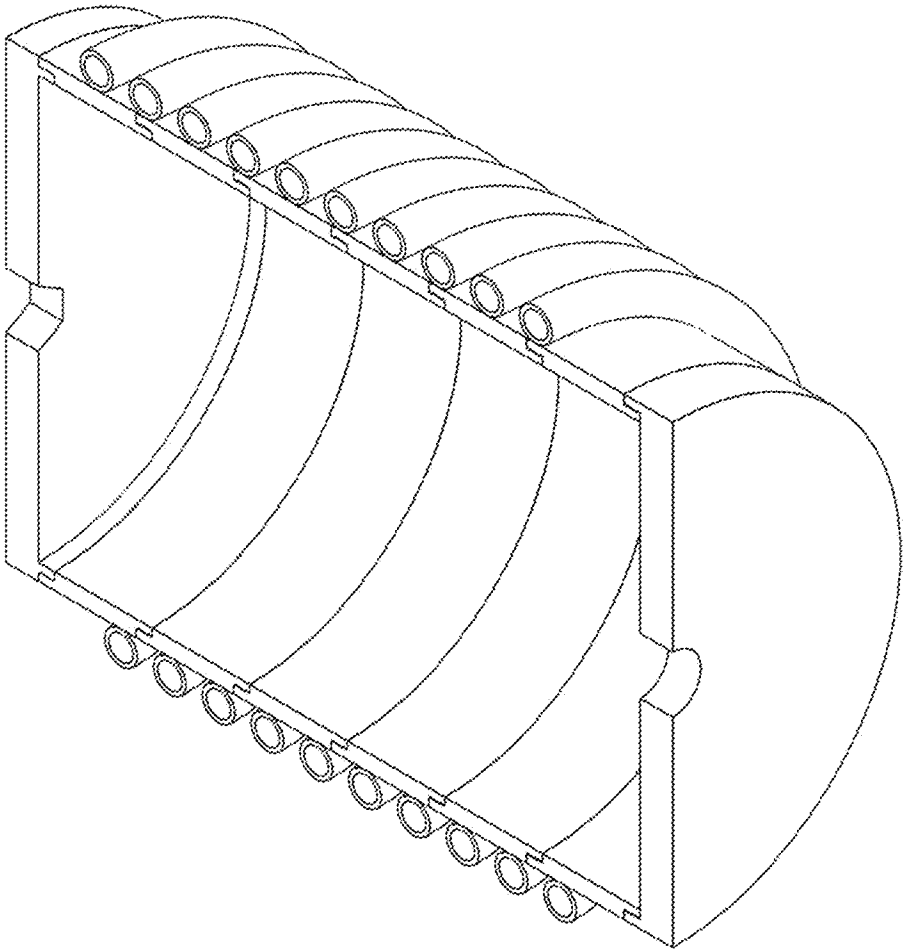
FIG. 17C is a depiction of a cross-sectional view of a consumable assembly with tube-tensioning features, according to one embodiment.

The fourth method to mitigate tube walking involves the construction of the rigid tube 1210 in FIG. 12B out of several sections, which may rotate independent of each other as seen in the assembly view in FIG. 17A. Note that the helical tubing is not shown in FIG. 17A to better demonstrate the concept. An exploded assembly view can be seen FIG. 17B. Item 1701 represents the helical tubing; item 1702 is an end cap; item 1703 is the first section of the rigid tube; items 1704 are center sections of the rigid tube; item 1705 is the last section of the rigid tube; item 1706 is an end cap.

Note that sections 1703, 1704, and 1705 operationally mate with each other such that sections 1703, 1704, and 1705 become axially aligned when joined. The resulting fit allows for relative rotation. Item 1702 and item 1703 are fixed as to rotate together. Item 1706 and item 1705 are fixed as to rotate together. Sections 1703 and 1705 have holes 1708 and 1709 where the tubing may enter the center of the consumable. A cross-sectional view of the complete assembly may be seen in FIG. 17C.

This concept works by means of tensioning the helical tubing such that tension is evenly distributed across the tubing. To use this design, a helical tubing 1701 will exit the consumable through hole 1708 in section 1703, wrap around the center sections 1704 and then enter the consumable through hole 1709 in section 1705. The ends of the helical tubing will then be secured to section 1703 and 1705.

Once the tubing is secured, the user may hold item 1702 rigid and rotate section 1706 clockwise as shown by direction 1707. This rotation causes the helical tubing 1701 to tighten evenly across all sections of the rigid tube.

Note that item 1702 has a hexagon cutout in its center and 1706 has a round cutout. This is to allow the consumable to be installed on the non-rotating central shaft 640 once the consumable is tensioned.

A tool such as a torque wrench may be utilized to apply consistent tension during manufacturing or use. Internal mechanisms (not shown) may be used to maintain the applied tension, such as but not limited to ratchet and pawl, friction clutch, or dowels.

Internal Roller Pump

Figure 18A:
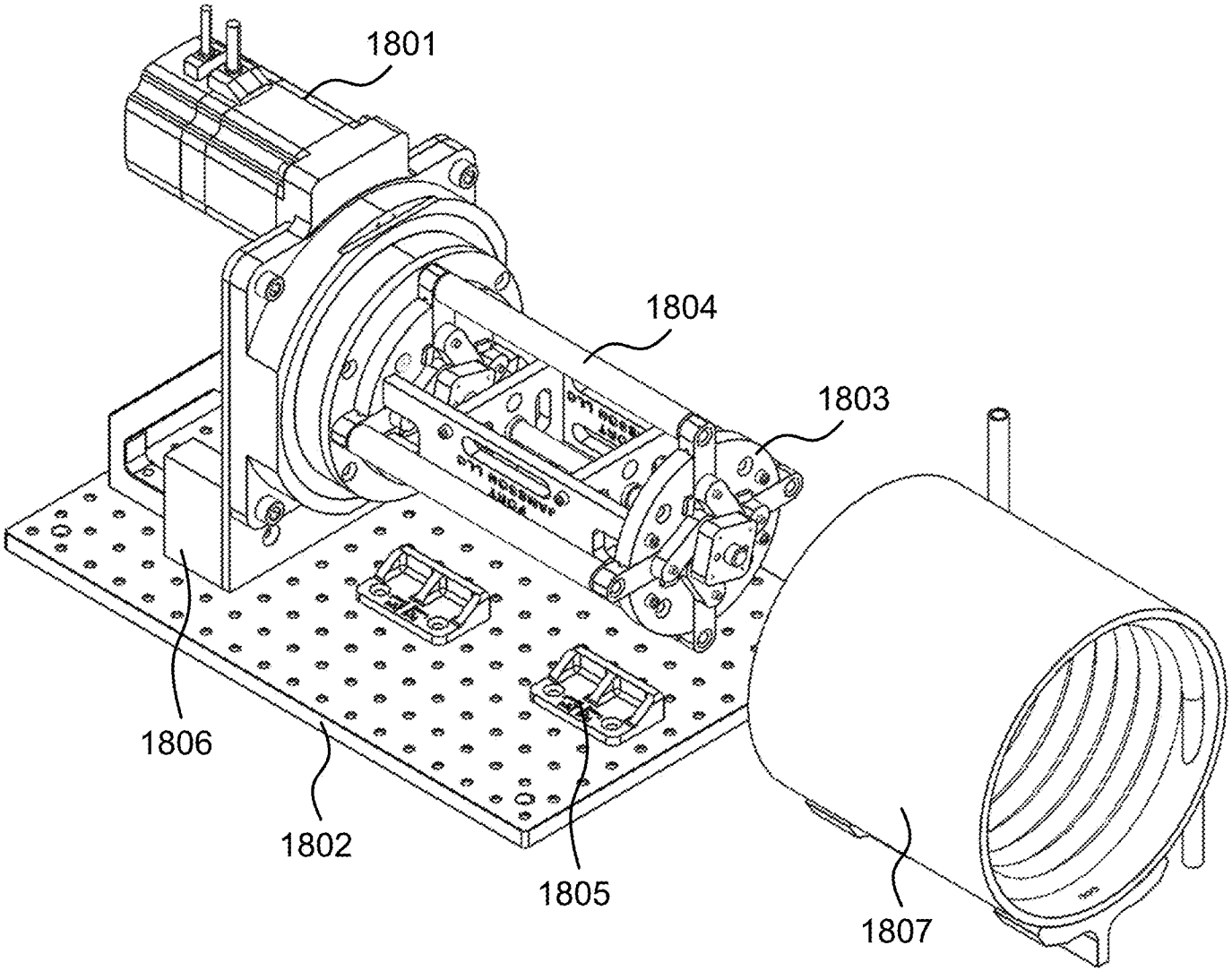
FIG. 18A is depiction of an internal roller pump assembly, according to one embodiment.
Figure 18B:
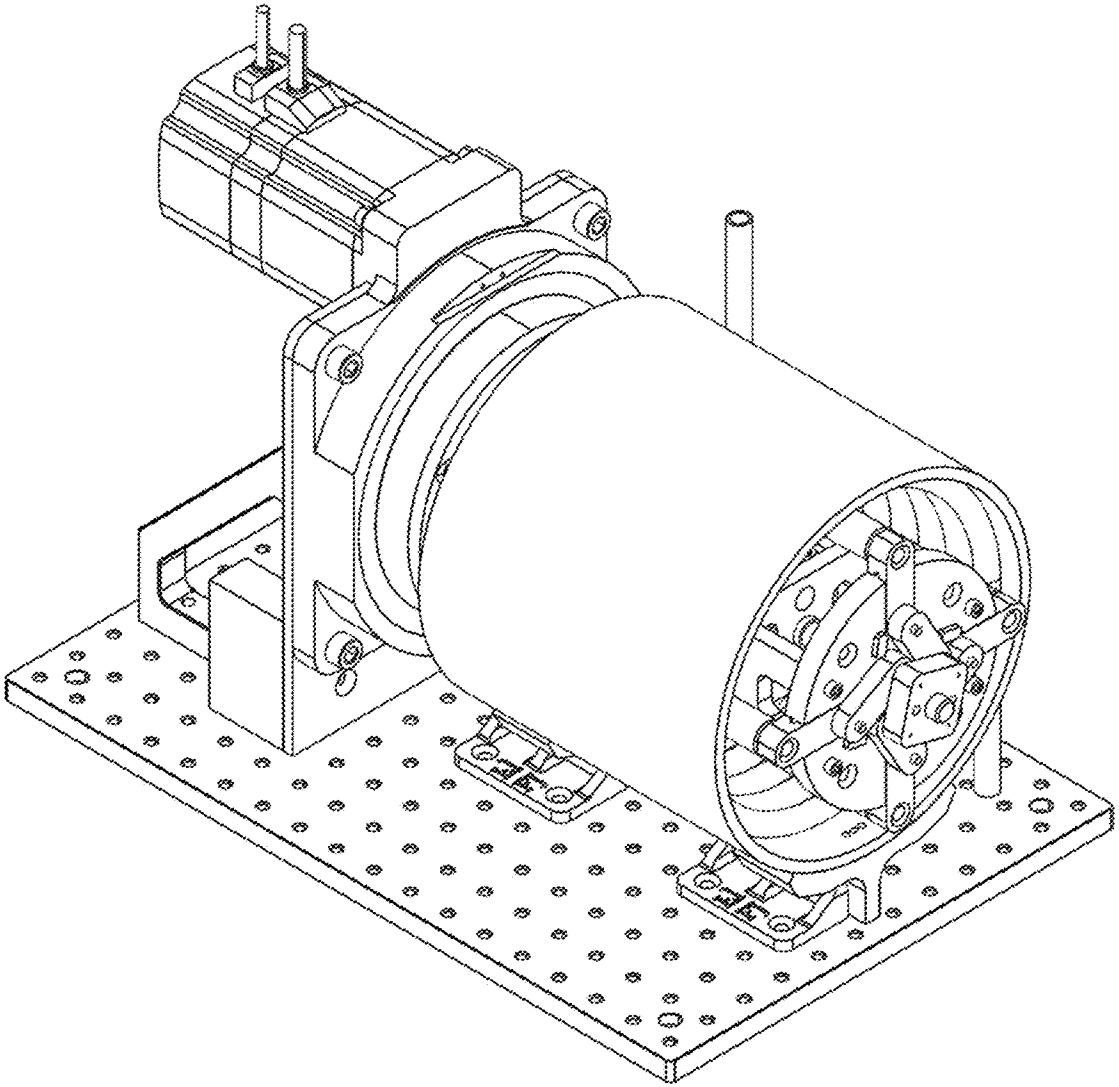
FIG. 18B is an assembly view of an internal roller pump with its consumable installed, according to one embodiment

The second pump system is referred to as an 'internal roller' pump in this document. As the name suggests, the rollers are positioned radially inward from the tubing and/or consumable. Depicted in FIG. 18A is an example of an internal roller pump assembly with its consumable set aligned but not installed, according to one embodiment. FIG. 18B is an assembly view of an internal roller pump with its consumable installed, according to one embodiment. The internal roller pump assembly includes a motor 1801, a rigid base 1802, a rigid cage 1803, roller assemblies 1804, anti-rotation features 1805, motor controller and electronics enclosure 1806, and consumable assembly 1807.

Rigid cage 1803 is mounted to motor 1801 and rotates with the motor's rotor. Roller assemblies 1804 are connected to rigid cage 1803 for compressing the helical tubing. Anti-rotation features 1805 prevent the consumable 1807 from rotating during use.

Figure 19:
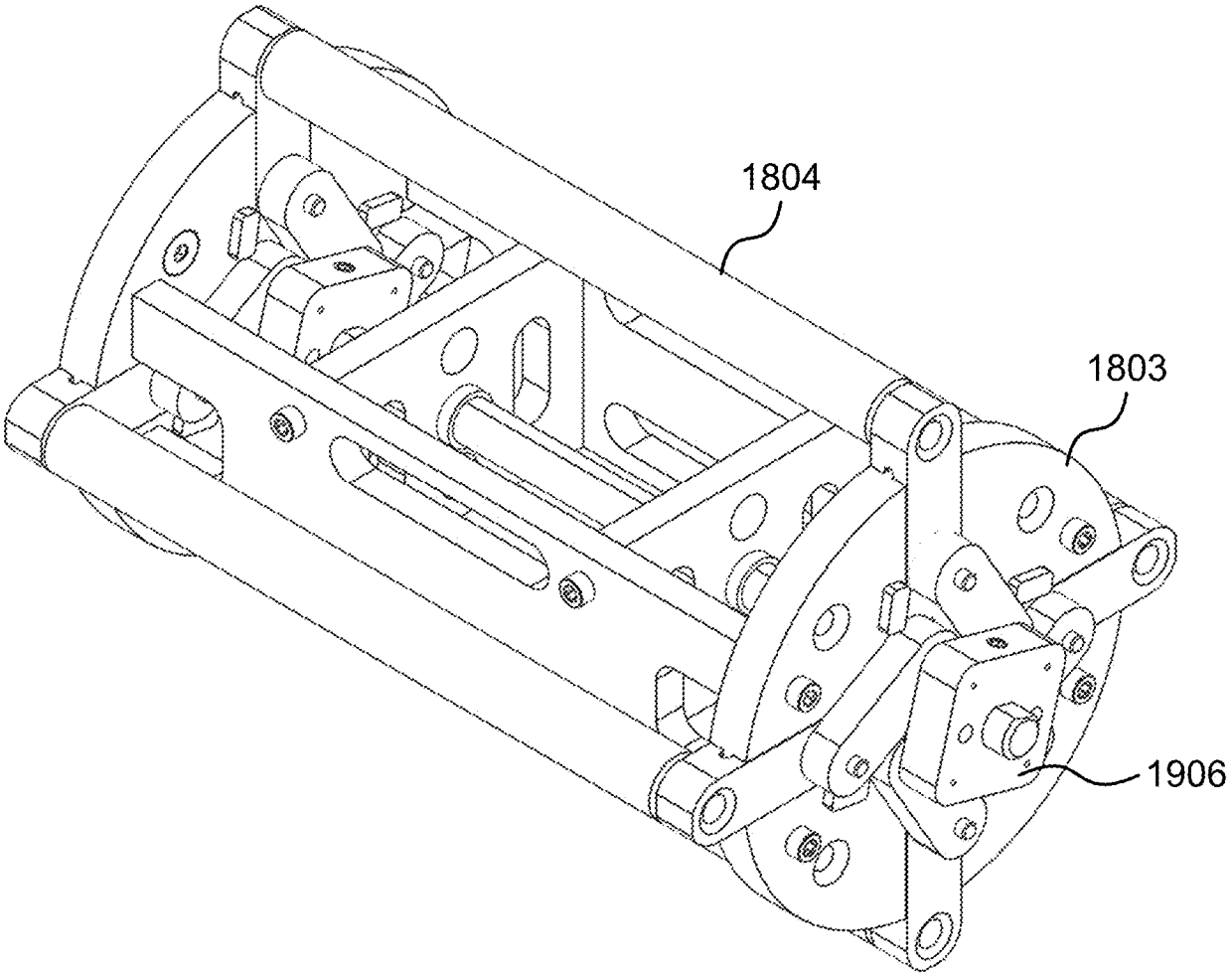
FIG. 19 is a depiction of units of rollers for an internal roller pump assembly, according to one embodiment.

FIG. 19 shows a perspective view of the rigid cage with a set of roller assemblies, according to one embodiment. The rigid cage 1803 includes a central hub 1906 that the roller assemblies 1804 connected to. When central hub 1906 is rotated counter-clockwise, the rollers of the roller assemblies 1804 are extended outward. The mechanism example shown in FIG. 19 is an over-center mechanism. In the over-center mechanism, the rollers can lock into an engaged position even after a counter-clockwise torque is removed.

Figure 20B:
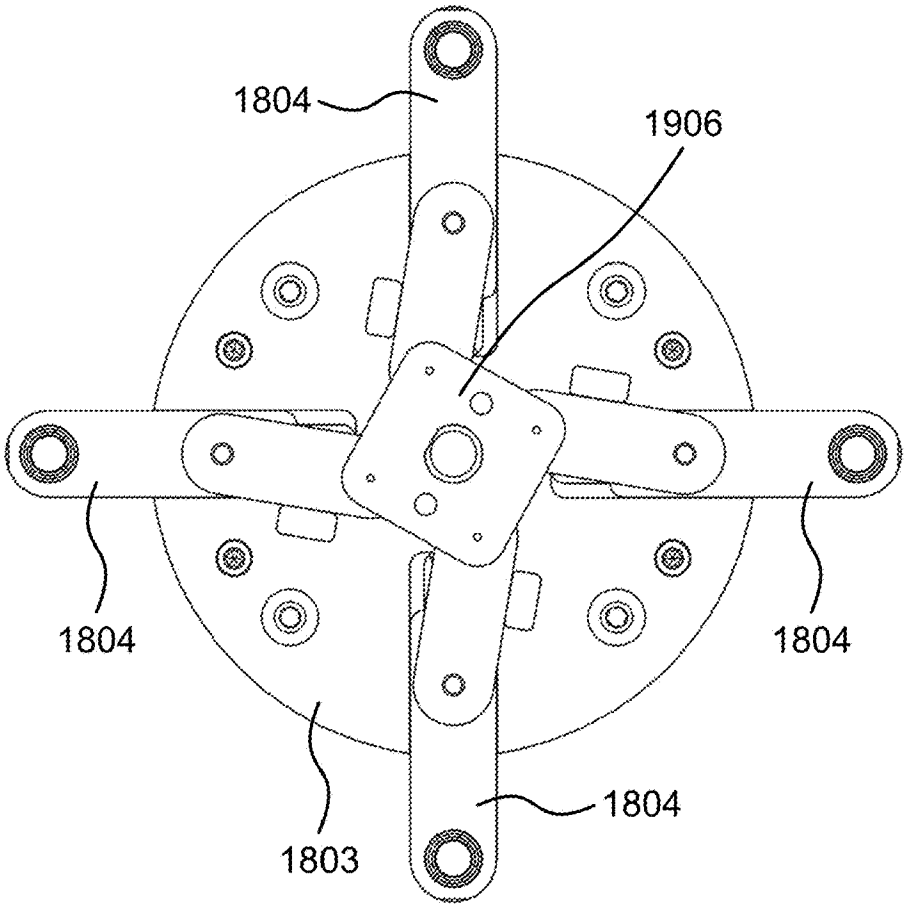
FIGS. 20A and 20B are depictions of an over-center mechanism, according to one embodiment.
Figure 20A:
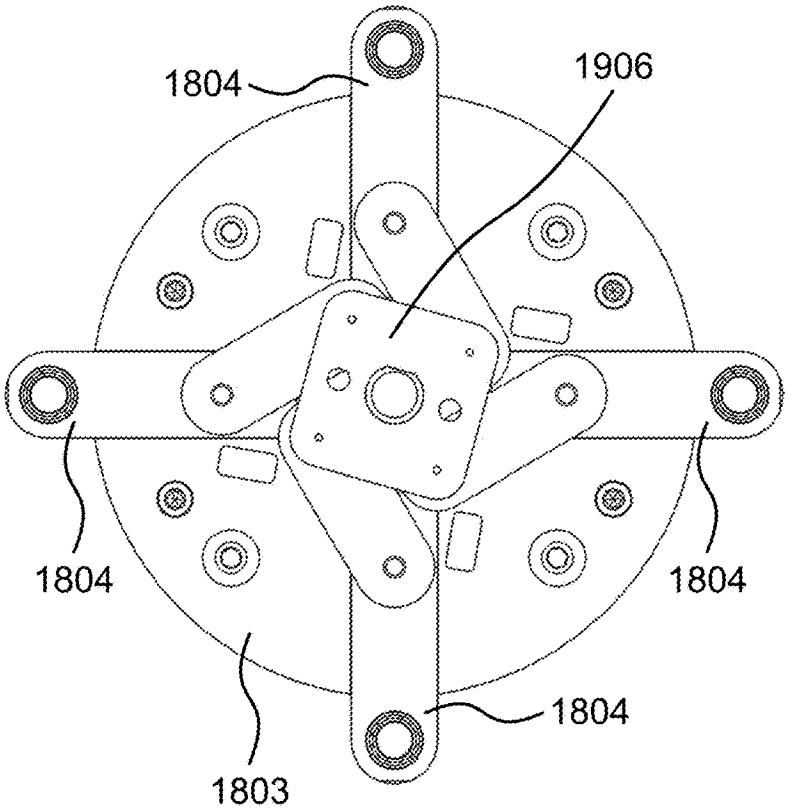

FIG. 20A is a front view of the roller engagement mechanism in a disengaged or retracted position. FIG. 20B is a front view of the roller engagement mechanism in an engaged or extended position.

Figure 21:
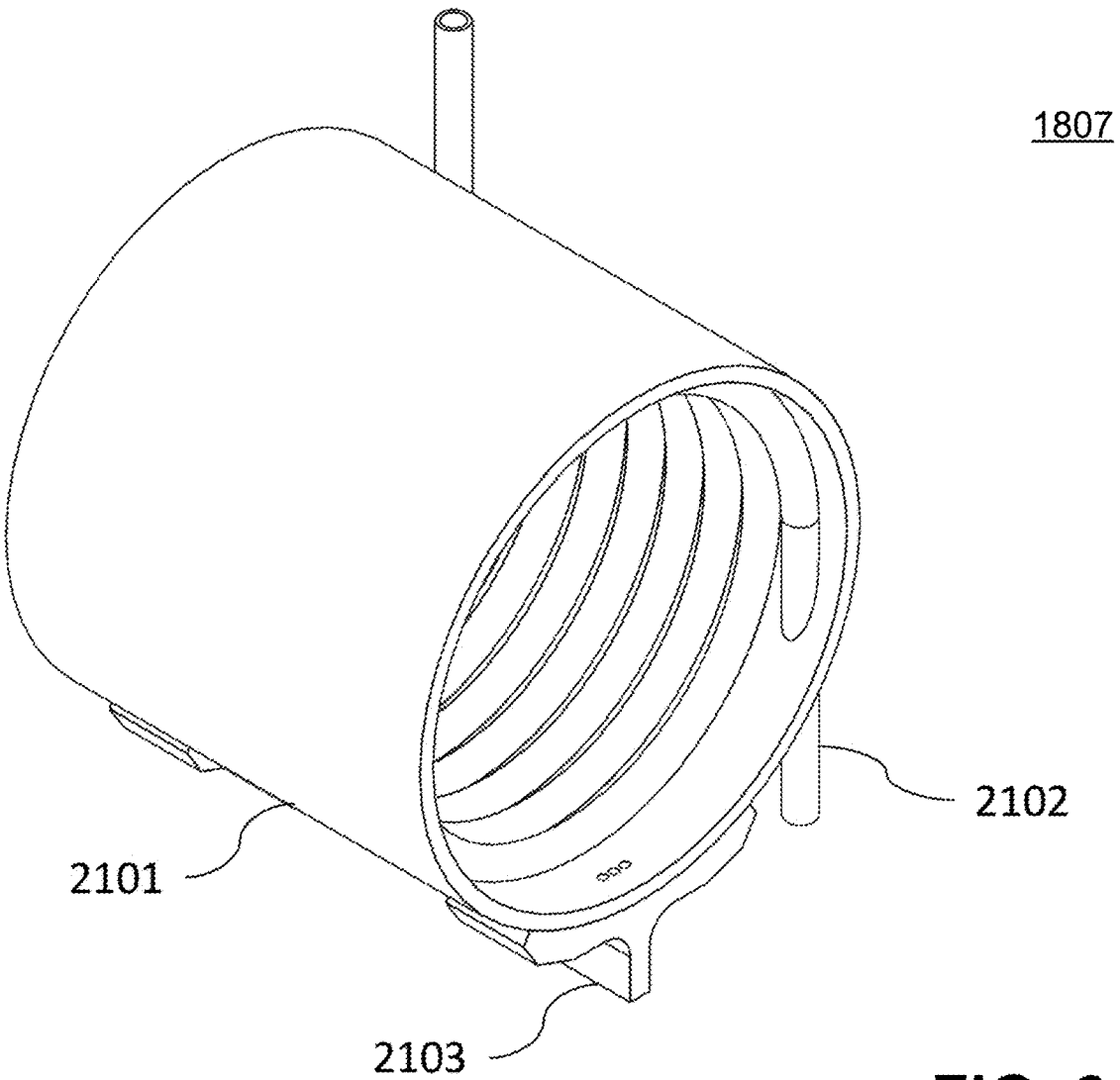
FIG. 21 is a depiction of an isometric view of a consumable assembly for an internal-roller pump, according to one embodiment.

FIG. 21 is an isometric view of consumable assembly 1807. The consumable assembly includes a rigid tube 2101; helical tubing 2102; and an anti-clocking mechanism 2103.

Rigid tube 2101 may be composed of plastic, metal, or any rigid material. Rigid tube 2101 provides a rigid surface to oppose the compressive forces exerted on the tubing by the rollers.

Figure 22B:
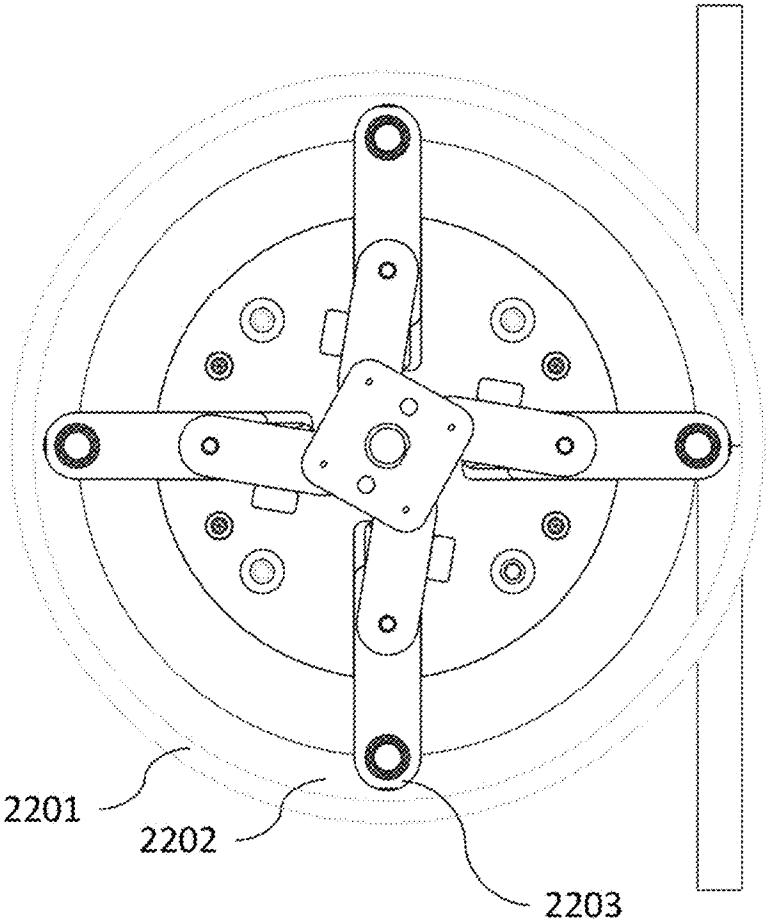
FIGS. 22A and 22B are depictions of a front view of an installed consumable, according to one embodiment.
Figure 22A:
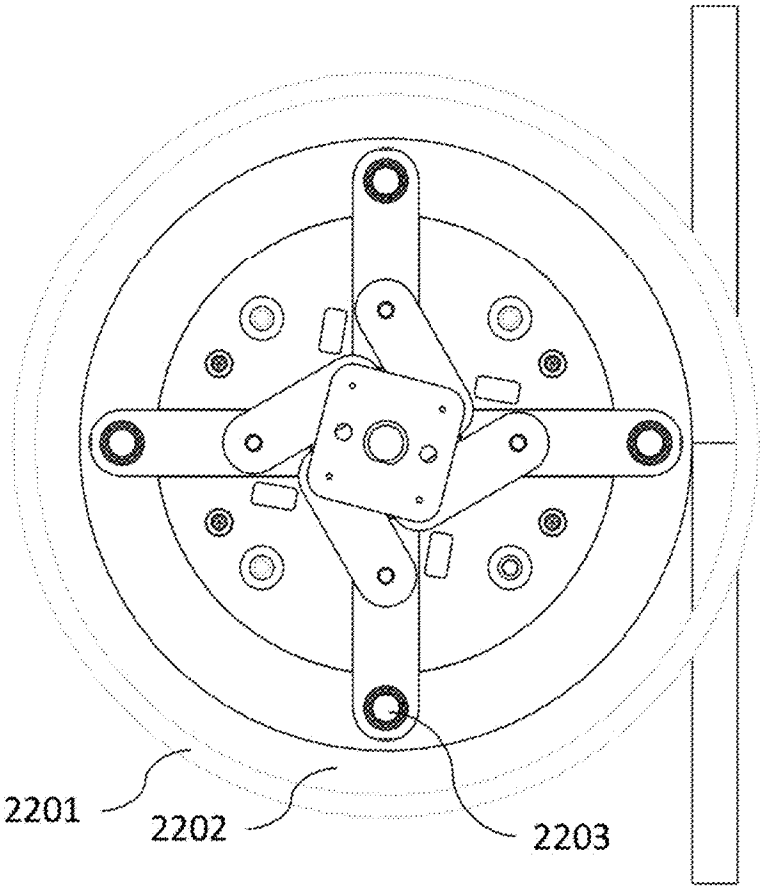

FIG. 22A is a front view of the installed consumable. The rigid tube is shown as item 2201. The helical tubing is shown as item 2202. Note that rollers 2203 are not contacting tubing 2202 in this disengaged or retracted position. This allows the consumable to be installed or removed.

FIG. 22B is a front view of the installed consumable. The rigid tube is shown as item 2201. The helical tubing is shown as item 2202. Note that rollers 2203 are contacting the tubing 2202 in this engaged or extended position. In this configuration the helical tubing is compressed.

Linear Roller Pump

Figure 23A:
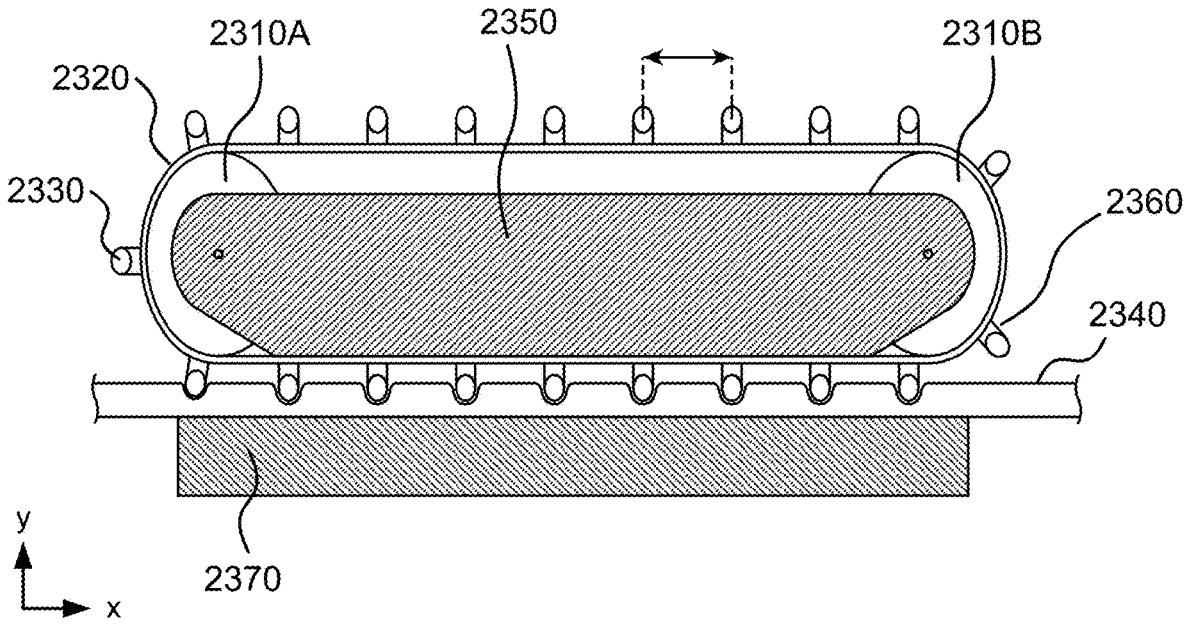
FIG. 23A is a cross-sectional view of a linear roller pump, according to one embodiment.
Figure 23B:
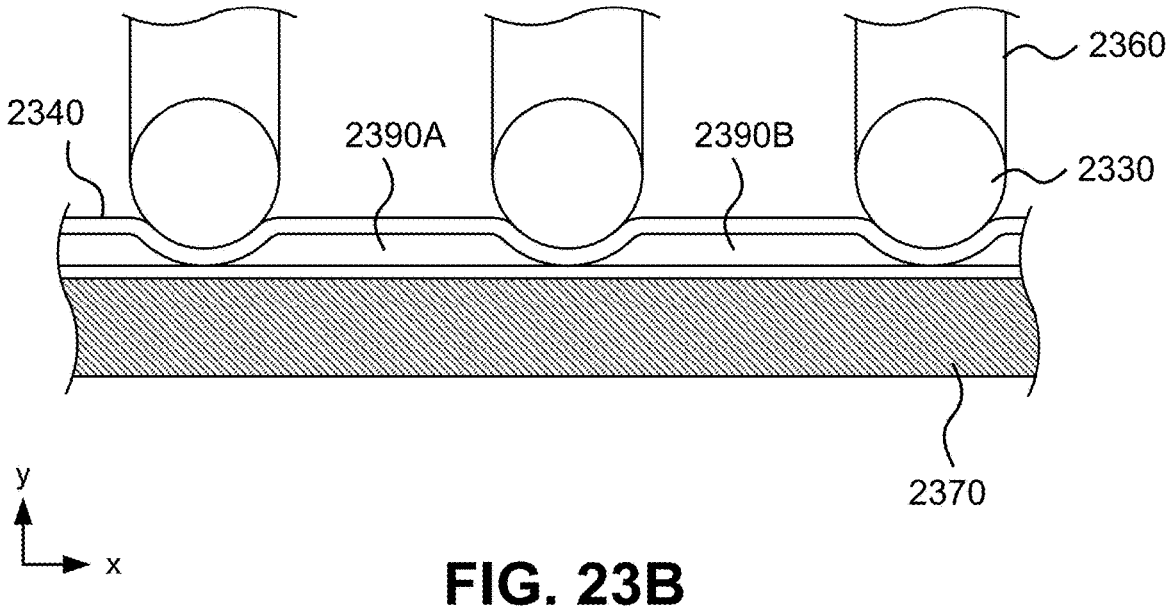
FIG. 23B is a detailed view of two isolated fluid volumes depicted in FIG. 23A, according to one embodiment.

An alternate method is to create a linear peristaltic pump that operates in a method similar to the tracks of a military tank. The fluid isolating pump 350 may be designed to allow the rollers to rotate about multiple axis of rotation. As such, the rollers of the fluid isolating pump 350 are able to translate in a linear fashion. A high-level schematic of this design is shown in FIG. 23A. A zoomed in view of FIG. 23 is shown in FIG. 23B FIG. 23A is a cross-sectional view of a linear roller pump, according to one embodiment. As shown in FIG. 23A, the linear roller pump includes sprockets 2310, a belt or track 2320, rollers 2330, tubing 2340, a rigid frame 2350, roller supports 2360, hard movable surface 2370, and a rigid base (not shown). In some embodiments, sprockets 2310A and 2310B may be driven by a motor (not shown). In other embodiments, one sprocket 2310A may be motor-driven and therefore active, while the other sprocket 2310B may be passive. The belt or track 2320 acts as a conveyer around sprockets 2310A and 2310B. The belt or track 2320 can carry or transport the rollers 2330. The rollers 2330 are used to compress the tubing 2340 and transfer fluid as the rollers 2330 progress down the tubing 2340. Tubing 2340 may be any type of hollow tubing used in the medical or bioprocessing industry, such as TPE, silicone, or PVC tubing. The rigid frame 2350 supports both sprockets 2310A and 2310B. Rigid frame 2350 can also provide a rigid surface for the rollers to transfer the reactive forces from the tubing 2340. The roller supports 2360 may be spring loaded to compensate for any system misalignments. Hard surface 2370 is movable between at least two positions. If hard surface 2370 moves in the −y direction, a gap is opened between hard surface 2370 and the rollers 2330 to allow tubing to be installed between the rollers 2330 and the hard surface 2370. When hard surface 2370 moves in the +y direction to a "clamped" position, the tubing 2340 may be installed in the linear roller pump and ready for fluid transfer. Rigid frame 2350 and hard surface 2370 can both be secured to a common rigid base (not shown) to maintain relative positions.

In some embodiments, the distance between two rollers 2330 is application-dependent and may be adjusted. The fluid volume isolated between two rollers is proportional to the distance between the rollers. To operate the linear roller pump in FIG. 23, either sprocket 2310A or sprocket 2310B may be driven by a motor either clockwise or counterclockwise to transfer fluid.

FIG. 23B is a detailed view of two isolated fluid volumes depicted in FIG. 23, according to one embodiment. FIG. 23B shows how the tubing 2340 is compressed by the rollers 2330 and how the compression isolates and transfers the fluid in a linear roller pump. As shown in FIG. 23B, three rollers 2330 are be pressed against tubing 2340 effectively isolating the fluid in each chamber 2390. A first fluid in chamber 2390A is mechanically isolated from the fluid in a second chamber 2390B and so on. This isolation can allow for the fluid in each chamber to incubate as the fluid progresses through the linear peristaltic pump. The rollers 2330 travel in the x direction and rotate about their own individual axes in the z direction. If the rollers travel in the +x direction, fluid in the chambers are transferred right and vice-versa. The rollers 2330 exert a force in the −y direction. Rigid bodies 2350 and 2370 can resist the forces in the y direction and thus tubing 2340 may be compressed.

Figure 24:
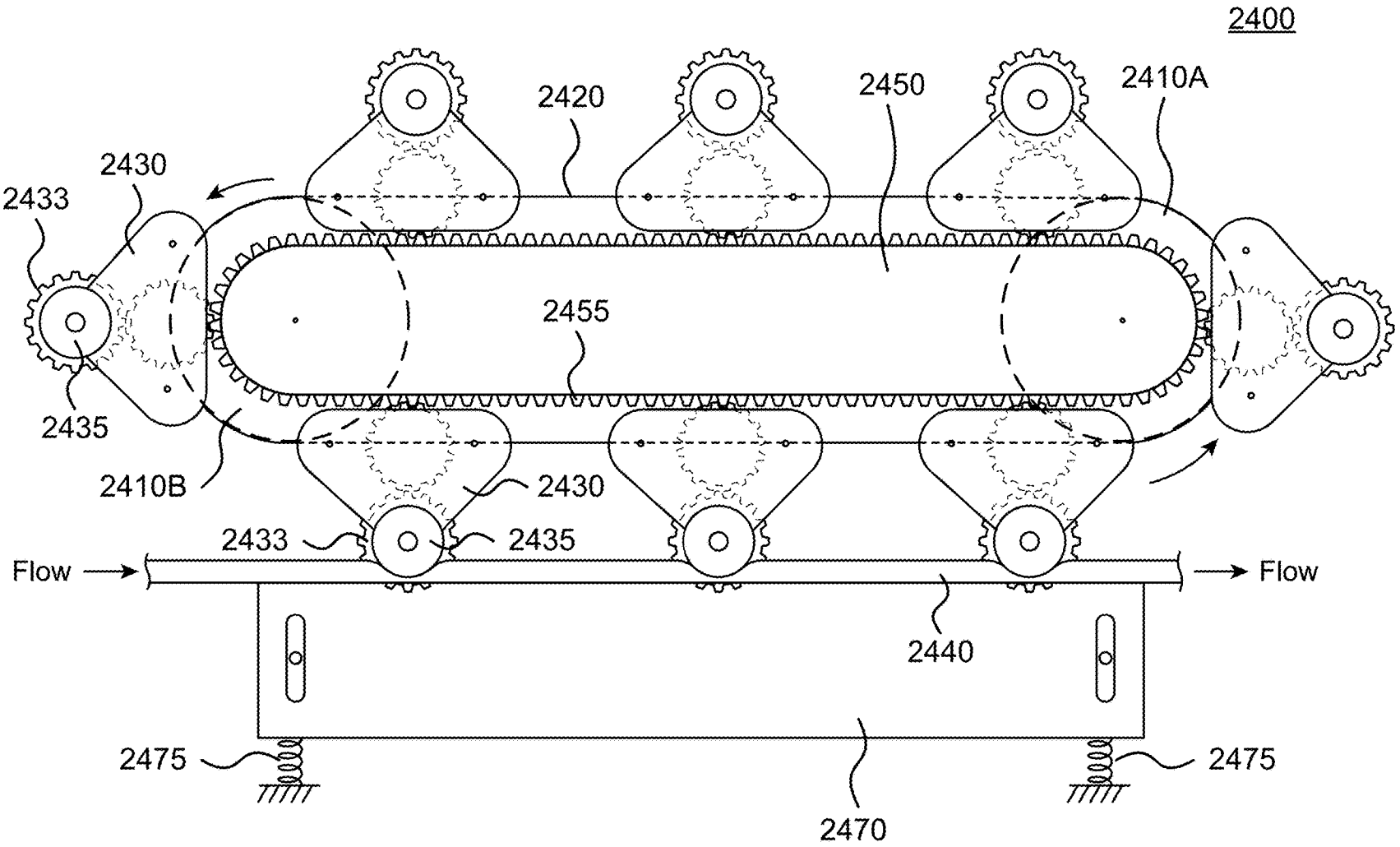
FIG. 24 is a cross-sectional view of a linear roller pump, according to another embodiment.

FIG. 24 is a cross-sectional view of a linear roller pump, according to another embodiment. The linear roller pump 2400 of FIG. 24 includes sprockets 2410, a belt or track 2420, roller assemblies 2430, tubing 2440, a rigid frame 2450, and a rigid body 2470.

The sprockets 2410 are linked to the belt or track 2420 and rotate to drive the belt or track 2420 in a predetermined direction. Similar to the linear roller pump of FIG. 23, the sprockets may be driven by one or more motor (not shown). Additionally, depending on the configuration of the linear roller pump, only one or both sprockets may be driven by a motor.

The roller assemblies 2430 are attached to the belt or track 2420 and move around the rigid frame 2450 following the movement of the belt or track 2420. The roller assemblies 2430 include multiple gears 2433 for causing the rollers 2435 to rotate as the rollers move around the rigid frame 2450. In some embodiments, the gears 2433 are configured to cause the rollers 2435 to roll over the surface of tubing 2440 to prevent friction between the rollers 2435 and the tubing 2440 from causing the tubing 2440 to stretch or move.

The gears 2433 of the roller assemblies 2430 are engaged with teeth 2455 on a surface of the rigid frame 2450. Unlike the gears 2433, the teeth 2455 of the rigid frame 2450 are configured to remain stationary. Thus, as the roller assemblies 2430 move, the teeth 2455 of the rigid frame 2450 cause the gears 2433 to rotate. In some embodiments, each roller assembly 2430 includes multiple gears to adjust the direction and velocity of the rotation of the roller 2435.

The rigid body 2470 includes a compliant member 2475 that allows the rigid body to move up or down (i.e., closer to the rollers or away from the rollers). For example, the compliance members 2475 may be suspensions, springs, pneumatics, or hydraulics. The compliance member 2475 provides a force to push the tubing 2440 against the rollers 2435 of the roller assemblies 2430. Moreover, the compliance member 2475 allows for the linear roller pump 2400 to adjust for varying thicknesses of tubing and for allowing greater manufacturing tolerances and misalignments in the system. Furthermore, the compliance member 2475 allows for easy installation and removal of tubing 2440. That is, the rigid body 2470 can be lowered by compressing the compliance members 2475 to install or remove the tubing 2440.

EXAMPLES

Aspects of the present teachings may be further understood in light of the following examples, which should not be construed as limiting the scope of the present teachings in any way.

The systems and methods herein have the ability to: (i) apply thermal control to the tubing, heating or cooling by convection or conduction to meet thermal incubation requirements; (ii) install in-line static mixer upstream or downstream of pump; (iii) increase or decrease number of rollers, length of pump, speed of pump, inner diameter (ID) and outer diameter (OD) of tubing, material of tubing; (iv) monitor the position of the pump by a motor encoder, stepper motor, or PID loop; (v) orient the pump in any position while also achieving (i)-(iv); (vi) achieve complex workflows with multiple incubations using multiple linear peristaltic pumps; (vii) place multiple helical tubes to increase production; and (viii) using both sides of a peristaltic pump, where a second consumable set is installed in the opposite orientation.

While in Examples 1 and 2, the target products are small molecule chemical compounds, large biological molecules, antibodies, and other chemical and/or biological entities may be generated and isolated via continuous flow using the systems and methods herein. While Example 2 is directed to recombinant proteins, the systems and methods herein are compatible with CRISPR, zinc finger nuclease, homologous recombination, and other techniques in the biotechnology arts.

A. Example 1

A manufacturer produces chemical compound ABC. Chemical compound ABC consists of three types of chemicals, A, B and C. During the manufacturing of chemical compound ABC, chemicals A-C cannot be mixed concurrently. This is because chemicals A and B must be mixed and allowed to react or incubate for at least a threshold amount of time (e.g., 3 minutes) before chemical C is added. Typically, chemical compound ABC has been made in batches due to the complex incubation requirements. To reduce the cost and inconsistencies of batch manufacturing, a fluid isolating pump that achieves continuous processing can used to manufacture of chemical compound ABC. In this example, the operational steps involve: (1) mixing A and B; (2) isolating and incubating the mixed fluid volume via one or more fluid isolating pumps (i.e., fluid isolating pump 350); (3) mixing C with intermediate, A+B mixture; and (4) generating chemical ABC as an output.

Operational Step (1): To manufacture chemical compound ABC, chemicals A and B are dispensed and mixed. For example, chemicals A and B may be dispensed by actuating a peristaltic pump, a gear pump, or a syringe pump. In other examples, at least one of chemical A or B is dispensed by operating the fluid isolating pump 350. That is, the fluid isolating pump 350 may act as a peristaltic pump for one or both chemicals A and B.

Operation Step (2): The mixture of chemicals A and B is supplied to the fluid isolating pump 350 to allow the mixture of chemical A and B to incubate for a predetermined amount of time. For example, the fluid isolating pump 350 is configured to isolate fluid volumes between rollers for 3 minutes. Therefore, when the system herein has been operating, the fluid at one end of the fluid isolating pump 350 is beginning incubation while the fluid at the opposite end of the fluid isolating pump 350 has completed its 3-minute incubation. The fluid isolating pump 350 can also be configured for, but not limited to: cooling, degassing, filtering, and coating functions for continuous flow methods.

Operational Step (3): The fluid that exits the fluid isolating pump is now ready to receive chemical C. As such, chemical C is dispensed (e.g., by actuating peristaltic pump 370) to transfer chemical C into the fully incubated intermediate (i.e., A+B mixture).

Operational Step (4): Chemical compound ABC then enters the collection reservoir 375.

B. Example 2

A manufacturer produces a thioamide as a chemical compound ABC. The methods and systems herein are performing a Willgerodt-Kindler Reaction to yield thioamide ($(C_6H_5)$—$CH_2$—C(═S)—$(N(CH_2CH_2)_2O)$). Chemical A is acetophenone ($((C_6H_5)$—C(═O)—$CH_3)$), chemical B is morpholine ($HN(CH_2CH_2)_2O$), and chemical C is $S_8$. Chemicals A-C are dissolved in organic solvent to yield a fluid state. In a setup similar to Example 1 where acetophenone is stored in bag 310, morpholine is stored in syringe 320A and a slurry of S8 is stored in syringe 320B. When morpholine and acetophenone mix and react, an enamine and water are fully formed at static mixer 335. Water can react with enamine to revert back to the starting morpholine and acetophenone. Thermal control in the fluid isolating pump 350 remove the water, such that enamine is formed and selectively persists as isolated fluid volumes. The enamine is an intermediate, mixture A+B, which subsequently reacts with S8. In turn, thioamide ($(C_6H_5)$—$CH_2$—C(═S)—$(N(CH_2CH_2)_2O)$) is generated and transported to intersection 360. Nickel (II) chloride solution in reservoir 365 is pumped to intersection 360 via peristaltic pump 370. The thioamide in intersection 360 reacts with nickel(ii) chloride to yield a thioamide-nickel complex, which is transported to collection reservoir 375.

While a linear sequence of chemical reactions is employed in this example, parallel or complex scheme of chemical reactions may be employed with an arrangement of multiple linear peristaltic pumps in combination with multiple traditional peristaltic pumps.

C. Example 3

Batch production is often not amenable for efficient and uniform production of large molecule biologics. By using the systems and methods herein, the fluid isolating pump 350 generates a durable and perpetual production environment useful for the efficient and uniform production of biologics.

A manufacturer produces large molecule biologics. In this example, the large molecule biologics are recombinant proteins. In other examples, the large molecule biologics may be enzymes, cytokines, growth factors, hormones, receptors, transcription factors, antibodies, antibody fragments, and so forth. Agar in vessel 310 and extracellular fluids in syringes 320A and 320B are sent to junction 330 and static mixer 335. Within a 1-hour time period, the mixture of agar and extracellular fluid begins incubation in fluid isolating pump 350. If this incubation profile is not met, then an intractable mixture results without an enriched amount of recombinant DNA. The incubated mixture of agar and extracellular fluid contain an enriched amount of recombinant DNA, which is a gene for encoding the recombinant proteins. The incubated mixture of agar and extracellular fluid is sent to a first output chamber. The first output chamber is connected to peristaltic pump 370, wherein peristaltic pump 370 contains cloning vectors in a fluid to increase the output of the genes for encoding the recombinant proteins. The genes for encoding recombinant proteins are sent to a second output chamber. The second output chamber is connected to another peristaltic pump, wherein the other peristaltic pump contains expression vectors in a fluid, such as the promoters, translation initiation sequence, a termination codon, and transcription termination sequence. The promoter and translation initiation sequence dependent steps take place in fluidic junction 360. The termination codon and transcription termination sequence steps take place in collection reservoir 375. In turn, recombinant proteins are formed and sent to another output chamber. A peristaltic pump is connected to the other output chamber, which contains an absorbent which can remove impurities from recombinant proteins without compromising the structure or properties of the recombinant proteins. In turn, purified forms of the recombinant proteins are generated and isolable via continuous manufacturing supported by the systems and methods herein.

D. Example 4

Batch production is often not amenable for efficient and uniform production of target products (small molecule or large molecules) that are contained within a sludge. The target product is extracted from the sludge, which also contains heterogeneous components. This further complicates the extraction process for obtaining the desired target product. By using the systems and methods herein, a helical peristaltic pump assembly generates a durable and perpetual production environment needed to for the efficient and uniform isolation of target product from a seemingly intractable mixture, such as the sludge.

A manufacturer produces dye molecules on the kilogram scale. For example, the dye molecule has a tendency to create a gel barrier during the synthesis. Other impurities in the sludge render traditional washes and pulverizations ineffective at extracting the dye molecule. Also, the amount of material needed when using traditional washes makes the batch production inefficient and impractical. A fluidized sludge and acidic methanol are dispensed and mixed. Within a 1 hour time period, the mixture of the sludge and acidic fluid is incubated using a fluid isolating pump (e.g., a helical fluid isolating pump or a linear fluid isolating pump). The fluid isolating pump assembly is able to accommodate a larger amount of sludge while also supporting purification steps that must meet a strict incubation profile. When the roller assembly rotates, the mixture of fluid enters the tubing of the fluid isolating pump. To maintain the structural integrity of the dye and ensure homogeneity of the mixture, incubation is performed for 45 minutes. The initially added amount of acidic methanol is a maximum amount that can be used to extract the target dye molecule. If additional acidic methanol is used, then the target dye molecule decomposes. After the 45-minute incubation, the mixture of fluid that exits the fluid isolating pump is fully homogenized, transferred to a beaker, and treated with water. In turn, the target dye molecule precipitates out in purified form. A coarse frit-aided vacuum filtration is used to isolate the purified form of the target dye molecule. In turn, purified form of the target dye molecule is isolable via continuous manufacturing supported by the systems and methods herein.

Additional Configuration Consideration

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of ordinary skill in the art will appreciate still additional alternative structural and functional designs through the disclosed principles of the embodiments. Thus, while particular embodiments and applications have been illustrated and described, it is to be understood that the embodiments are not limited to the precise construction and components disclosed herein and that various modifications, changes and variations which will be apparent to those skilled in the art may be made in the arrangement, operation and details of the method and apparatus disclosed herein without departing from the spirit and scope as defined in the appended claims.

What is claimed is:

1. A fluid isolating pump, comprising:

a cage comprising:

a front plate having a front opening, a back plate having a back opening, and a plurality of connecting rods, each connecting rod of the plurality of connecting rods having a front end attached to the front plate and a back end attached to the back plate;

a plurality of roller assemblies, each roller assembly of the plurality of roller assemblies coupled to a corresponding connecting rod of the plurality of connecting rods of the cage, each roller assembly of the plurality of roller assemblies comprising:

one or more arms rotatably attached to the corresponding connecting rod, a connecting bar coupled to the one or more arms, one or more levers rotatably attached to the corresponding connecting rod, one or more suspensions, each suspension of the one or more suspensions coupled to at least one arm of the one or more arms and to at least one lever of the one or more levers, and a roller coupled to the one or more levers;

a cam plate coupled to the connecting bar of each roller assembly of the plurality of roller assemblies, the cam plate comprising:

a plurality of openings, each opening of the plurality of openings having a first end and a second end, wherein the connecting bar of each roller assembly is configured to slide from the first end of a corresponding opening to the second end of the corresponding opening, and a non-rotating central shaft, the non-rotating central shaft axially aligned with the cage, the non-rotating central shaft configured to support a consumable.

2. The fluid isolating pump of claim 1, further comprising:

a central gear mounted on the non-rotating central shaft;

a plurality of peripheral gears, each peripheral gear of the plurality of peripheral gears mounted to a corresponding connecting rod of the plurality of connecting rods of the cage, wherein the plurality of peripheral gears is engaged to the central gear; and wherein each roller assembly of the plurality of roller assemblies further comprises:

a roller gear coupled to the roller of the roller assembly, the roller gear engaged with a corresponding peripheral gear of the plurality of peripheral gears.

3. The fluid isolating pump of claim 2, wherein the plurality of peripheral gears are configured to rotate around the central gear as the cage rotates around the non-rotating central shaft.

4. The fluid isolating pump of claim 3, wherein the roller gear of a roller assembly of the plurality of roller assemblies is configured to rotate the roller based on the rotation of the corresponding peripheral gear of the plurality of peripheral gears.

5. The fluid isolating pump of claim 1, wherein a roller assembly of the plurality of roller assemblies is in a disengaged position when the connecting bar of the roller assembly is in the first end of the corresponding opening, and wherein the roller assembly is in an engaged position when the connecting bar of the roller assembly is in the second end of the corresponding opening.

6. The fluid isolating pump of claim 5, wherein the roller of the roller assembly of the plurality of roller assemblies compresses a tubing of the consumable when the roller assembly is in the engaged position.

7. The fluid isolating pump of claim 6, wherein, when the roller assembly of the plurality of roller assemblies is in the engaged position, the cam plate applies pressure to the connecting bar of the roller assembly, compressing the one or more suspensions.

8. A roller assembly configured to be mounted on an axle comprising:

a first arm configured to be rotatably attached to the axle, a second arm configured to be rotatably attached to the axle, a connecting bar coupled to the first arm and the second arm, a first lever configured to be rotatably attached to the axle, a suspension directly coupled to the first arm and to the first lever, a second lever configured to be rotatably attached to the axle, a second suspension directly coupled to the second arm and to the second lever, and a roller coupled to the first lever and the second lever.

9. The roller assembly of claim 8, further comprising:

a roller gear coupled to the roller of the roller assembly, the roller gear configured to control a rotation of the roller.

10. The roller assembly of claim 9, further comprising:

a peripheral gear configured to be rotatably attached to the axle, the peripheral gear configured to be coupled to a central gear, the peripheral gear configured to control a rotation of the roller gear; and an auxiliary gear between the roller gear and the peripheral gear, the auxiliary gear configured to reverse a direction or rotation of the roller gear.

11. The roller assembly of claim 8, wherein, in an engaged position, the connecting bar of the roller assembly is configured to receive a force compressing at least one of the suspension or the second suspension.

12. The roller assembly of claim 8, wherein at least one of the suspension or the second suspension is configured to apply a compressive force to the roller to press the rollers against a consumable.

13. The roller assembly of claim 8, wherein at least one of the suspension or the second suspension is one of a spring suspension, a hydraulic suspension, and a pneumatic suspension.

14. The roller assembly of claim 8, wherein the first arm is coupled to the first lever.

* * * * *